US005437966A

United States Patent [19]

Haraga et al.

[11] Patent Number: 5,437,966

[45] Date of Patent: Aug. 1, 1995

[54] SILVER HALIDE COLOR NEGATIVE PHOTOGRAPHIC LIGHT SENSITIVE MATERIAL

[75] Inventors: Hideaki Haraga; Toshihiko Yagi; Miki Kon; Hiroshi Shimazaki; Yoshihide Urakawa; Yoshitaka Yamada; Atsuo Ezaki; Syoji Matsuzaka, all of Hino, Japan

[73] Assignee: Konica Corporation, Japan

[21] Appl. No.: 216,771

[22] Filed: Mar. 23, 1994

Related U.S. Application Data

[63] Continuation of Ser. No. 34,179, Mar. 22, 1993, abandoned, which is a continuation of Ser. No. 943,135, Sep. 10, 1992, abandoned, which is a continuation of Ser. No. 634,069, Dec. 26, 1990, abandoned.

[30] Foreign Application Priority Data

| | | | |
|---|---|---|---|
| Jan. 19, 1990 | [JP] | Japan | 2-10968 |
| Jan. 19, 1990 | [JP] | Japan | 2-10973 |
| Feb. 19, 1990 | [JP] | Japan | 2-37766 |
| Feb. 19, 1990 | [JP] | Japan | 2-37767 |

[51] Int. Cl.[6] ..... G03C 1/46

[52] U.S. Cl. ..... 430/505; 430/543; 430/567

[58] Field of Search ..... 430/504, 505, 543, 567

[56] References Cited

U.S. PATENT DOCUMENTS

| | | | |
|---|---|---|---|
| 3,843,369 | 10/1974 | Kumai et al. | 430/506 |
| 4,582,780 | 4/1986 | Giusto et al. | 430/505 |
| 4,724,198 | 2/1988 | Yamada et al. | 430/504 |
| 4,945,037 | 7/1990 | Saitou | 430/567 |
| 4,963,467 | 10/1990 | Ishikawa et al. | 430/567 |
| 5,034,310 | 7/1991 | Ikeda et al. | 430/505 |

FOREIGN PATENT DOCUMENTS

| | | |
|---|---|---|
| 99234 | 1/1984 | European Pat. Off. . |
| 309119 | 3/1989 | European Pat. Off. . |

OTHER PUBLICATIONS

Patent Abstracts of Japan, vol. II, No. 153 (p-577) (2600); May 19, 1987 JPA-61-289349; Dec. 19, 1986.

*Primary Examiner*—Janet C. Baxter

*Attorney, Agent, or Firm*—Jordan B. Bierman; Bierman and Muserlian

[57] ABSTRACT

The present invention describes a silver halide color negative photographic light-sensitive material having an improved graininess and an excellent image quality even when picture-taken under various light sources each having a color temperature different from daylight. A silver halide color photographic material comprises a light-sensitive layer unit containing a red-sensitive silver halide emulsion and a cyan coupler, a light-sensitive layer unit containing a green-sensitive silver halide emulsion and a magenta coupler, and a light-sensitive layer unit containing a blue-sensitive silver halide emulsion and a yellow coupler, wherein RMS granularity of at least one of the light-sensitive layer units has the following relations;

$$1.1\ RMS_0 \leqq RMS_1 \leqq 1.5\ RMS_0 \text{ and}$$

$$0.9\ RMS_0 \leqq RMS_2 \leqq 1.2\ RMS_0$$

wherein $RMS_0$ is an RMS value at a minimum density portion of the layer unit, $RMS_1$ is an RMS value at a density portion of the minimum density+0.15 of the layer unit which is produced by an exposure amount in terms of logH, and $RMS_2$ is an RMS value at a density portion produced by an exposure amount of logH+0.5.

9 Claims, 5 Drawing Sheets

SILVER HALIDE COLOR NEGATIVE PHOTOGRAPHIC LIGHT SENSITIVE MATERIAL

This is a continuation of application Ser. No. 08/034,179, filed Mar. 22, 1993, now abandoned, which is a continuation of application Ser. No. 07/943,135, filed Sep. 10, 1992, now abandoned, which is a continuation of application Ser. No. 07/634,069, filed Dec. 12, 1990, now abandoned.

FIELD OF THE INVENTION

This invention relates to a silver halide color negative photographic light-sensitive material, particularly, to a color negative photographic light-sensitive material having a high sensitive speed and a high image quality and, to be more precise, to a silver halide color negative photographic light-sensitive material having a very few image quality deterioration even under various photographing conditions where any different light sources are used.

BACKGROUND OF THE INVENTION

In recent years, the demands for photographic consumption goods have been kept increased in the market by such a level as high as about 10% per annum. When a photographer desires to keep his memories on photographic pictures, he expects the pictures should be finished in the finest quality whenever he takes pictures at any time and places, so that his shutter chances for taking pictures of subjects are increased.

The chances of taking pictures on the color photographic light sensitive materials having a high speed of not slower than ISO 300 are steadily increased, as the image qualities are improved year by year.

Such high speed color photographic light-sensitive materials are very often used for taking pictures not only in open daylight, but also indoors. In the indoor photography, there normally uses an artificial light source such as an electronic flash —so-called a strobe—, an incandescent tungsten lamp, a fluorescent lamp, and a mercury lamp. Among the indoor photography, for example, in those at a wedding hall, a stage, a show window, an indoor athletic facility, and a night scene, there are many instances where no electronic flash can be used, but one of the various artificial light sources such as an incandescent tungsten lamp, a fluorescent lamp and a mercury lamp are used.

As generally compared to color reversal photographic light-sensitive materials, the color negative photographic light-sensitive materials are relatively wider in latitude, so that they are not particularly necessary to carry out the color correction even when using any one of various light sources and, in addition, they have a further excellent characteristics that a color reproduction can be corrected when carrying out a printing operation.

However, in the case of taking picture on a color negative photographic light-sensitive material by making an exposure to a light source having a color temperature different from those of the so-called daylight colors and then correcting a color reproduction when carrying out a printing operation, the quality of the finished print is often deteriorated and, particularly, the graininess thereof is often conspicuously deteriorated,-.as compared to those of the color printed pictures made by making an exposure to a daylight.

Therefore, for taking pictures on a high speed color negative photographic light-sensitive material by making an exposure to any one of various light sources each having different color temperatures, it has been demanded that the image qualities and, particularly, the graininess, can be so obtained as to be equivalent to those obtained by making an exposure to the daylight.

Heretofore, there have been many attempts to improve the graininess. However, those attempts have still not always been effective to solve the problems posed to the high speed color negative photographic light-sensitive materials.

For example, Japanese Patent Publication Open to Public Inspection —hereinafter referred to as Japanese Patent O.P.I. Publication—No. 62-91945/1987 discloses a technique for improving the graininess in an underexposed area, in which a light-sensitive unit is comprised of three layers; namely, a low speed emulsion layer, a medium speed emulsion layer and a high speed emulsion layer; and the maximum color density of the high speed emulsion layer is set to be not higher than 0.3. In this technique, it could be proved that the graininess around a minimum density+0.2 and the image quality in the underexposed areas were both improved though, the graininess in the areas exposed to various light sources each having different color temperatures were considerably deteriorated as compared to those exposed to the daylight.

There has been a known method in which the graininess can be improved by coating the amount of the silver halide grains more than that used in the conventional type of films. When applying this method to the above-mentioned high speed light-sensitive materials, there are many instances where the graininess thereof is seriously deteriorated in the course of naturally aging the light-sensitive materials and, in addition, it can hardly be said that this method is positively applicable to the high speed light sensitive materials, from the viewpoints of preventing image qualities such as a resolving power from being lowered, and saving the production cost.

On the other hand, as a means for improving an image quality, there have been the known techniques in which a photographically useful reagent such as a development inhibitor is released silver-imagewise at the same time when forming a silver image. In the field of color photographic light-sensitive materials, these techniques include, typically, a technique in which a DIR compound is added. From the viewpoints of emphasizing an interimage effect, —IIE—, and improving color reproduction, graininess and image sharpness, the technique having been most popularly used is that for adding a diffusible DIR compound which releases diffusible development inhibitor. However, while the use of the compound is inevitably useful for obtaining a high image quality in an ordinary photographing operation, the use thereof has the defects that, when taking picture under a light source having a color temperature different from those of daylight, the interimage effect is unbalanced to deteriorate the gradation and, therefore, the color balance between the highlight portions and the shadow portions are off even if a color correction is carried out when the image is printed, so that a satisfactory color reproduction cannot be obtained. In addition to the above, the sensitive speed is sharply lowered and, therefore, this technique is not effective as a means for improving the graininess of such a high speed color photographic light-sensitive material, though the graininess itself may be improved.

As described above, the problem remaining unsolved in the conventional techniques is that, when taking picture on a high speed color negative light-sensitive material by making an exposure to one of various light sources having a color temperature different from those of the daylight, any graininess cannot be obtained as excellent as those obtained in daylight conditions. The invention is to solve the above-mentioned problems under the various restrictive conditions for designing a high speed color negative photographic light-sensitive material, such as an amount of silver contained·a layer thickness·a silver halide grain size·an amount of couplers·an amount of DIR compounds contained·etc.

SUMMARY OF THE INVENTION

It is, accordingly, an object of the invention to provide a high speed silver halide color negative photographic light-sensitive material improved in graininess so that an excellent image quality equivalent to those obtained in a daylight photography can be obtained even when pictures are taken by making an exposure to any one of various light sources each having a color temperature different from those of daylight.

For achieving the above-mentioned object of the invention, the present inventors have proceeded their studies by investigating a variety of artificial light sources and by taking pictures by making an exposure to each of the light sources, particularly with paying their attention to the portions of a color density most concerned in the graininess and the amount of exposure, so that they could achieve the invention.

In short, the object of the invention can be achieved with a silver halide color negative photographic light-sensitive material comprising a support bearing thereon at least one each of a light-sensitive unit containing a red sensitive silver halide emulsion and a cyan coupler, another light-sensitive unit containing a green sensitive silver halide emulsion and a magenta coupler, and a further light-sensitive unit containing a blue sensitive silver halide emulsion and a yellow coupler; wherein Root-Mean-Square (RMS) granularity of at least one of the above-mentioned three light-sensitive units has the relations of 1.1 $RMS_0 \leqq RMS_1 \leqq 1.5\ RMS_0$ and 0.9 $RMS_0 \leqq RMS_2 \leqq 1.2\ RMS_0$, in which $RMS_0$ is an RMS value of a minimum density of the layer unit, $RMS_1$ is an RMS value in an exposure quantity logH which makes the layer unit to have a density of a minimum density+0.15, and $RMS_2$ is an RMS value corresponding to an exposure quantity of logH+0.5.

DETAILED DESCRIPTION OF THE INVENTION

Figure 1:
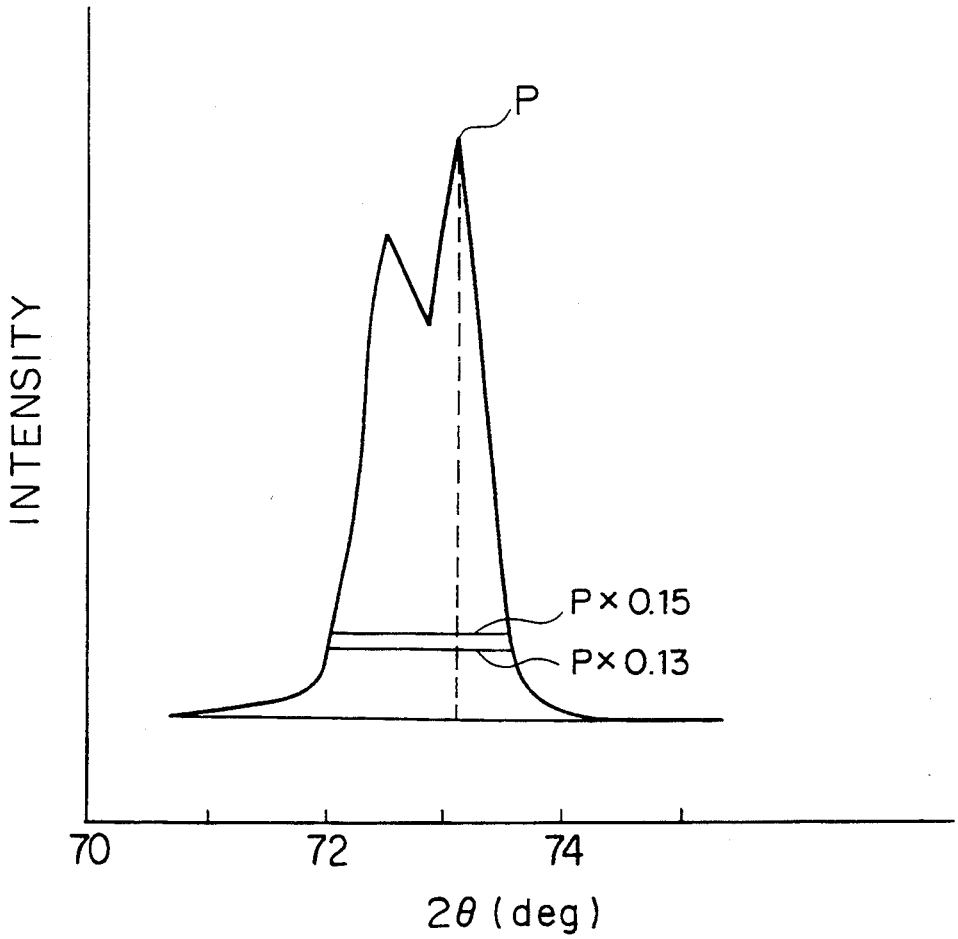
FIGS. 1 through 5 are each the X-ray diffraction patterns of the emulsions, Em-4, Em-5, Em-6, Em-D and Em-E, respectively.

Now, the invention will be detailed below.

First, at least one of the three light-sensitive units is in the relation within the range of the above-given RMS values. Density relation curve D-(logE) shows a relation between color density D and a logarithmic exposure amount, which is used for obtaining the positions for measuring the above-mentioned RMS values, that is so-called a photographic characteristic curve. In the invention, the curves are determined in the following test procedures.

In the meantime, the silver halide color negative photographic light-sensitive materials of the invention desirably have an ISO speed of not lower than 300. The ISO speeds of the light-sensitive materials of the invention are determined in conformity with the following test procedures. —For further details, refer to JIS K 7614-1981 —

1. Test conditions

Allowing a light-sensitive material subject to the tests to stand for one hour in a room under the test conditions at a temperature within the range of 20°±5° C. and a relative humidity within the range of 60±10%, and the light-sensitive material is tested.

2. Exposure (1) On the surface subject to an exposure, the relative spectral energy distributions of the control rays of light are those shown in Table 1 given below.

TABLE 1

| Wavelength, nm | Relative spectral energy(1) |
|---|---|
| 360 | 2 |
| 370 | 8 |
| 380 | 14 |
| 560 | 100 |
| 570 | 97 |
| 580 | 98 |
| 590 | 90 |
| 600 | 93 |
| 610 | 94 |
| 620 | 92 |
| 630 | 88 |
| 640 | 89 |
| 650 | 86 |
| 660 | 86 |
| 670 | 89 |
| 680 | 85 |
| 690 | 75 |
| 700 | 77 |

Footnote (1)The energy at 560 nm is set at a relative value of 100 as the control energy.

(2) The illuminance on the surfaces exposed are varied by making use of an optical wedge. The variations of spectral transmittance factor densities of the optical wedge in the wavelength range of 360 to 700 nm are not higher than 10% in the wavelength range of less than 400 nm, and not higher than 5% in the wavelength range of not less than 400 nm.

(3) Exposure time is set at 1/100 seconds.

3. Development (1) In the course between an exposure and a development, a light-sensitive material subject to tests is kept at a temperature within the range of 20°±5° C. and a relative humidity within the range of 60±10%.

(2) Development is completed within the period between not shorter than 30 minutes and not longer than 6 hours after exposing the light-sensitive material to light.

(3) The development is carried out in the following steps:

| | |
|---|---|
| a. Color developing | 3 min. 15 sec., 38.0 ± 0.1° C. |
| b. Bleaching | 6 min. 30 sec., 38.0 ± 3.0° C. |
| c. Washing | 3 min. 15 sec., 24 to 41° C. |
| d. Fixing | 6 min. 30 sec., 38.0 ± 3.0° C. |
| e. Washing | 3 min. 15 sec., 24 to 41° C. |
| f. Stabilizing | 3 min. 15 sec., 38.0 ± 3.0° C. |

-continued

| | |
|---|---|
| g Drying | Not higher than 50° C. |

The compositions of the processing solutions used in the above-given processing steps are as follows:

| | |
|---|---|
| <Color developer> | |
| 4-amino-3-methyl-N-ethyl-N-(β-hydroxyethyl)-aniline.sulfate | 4.75 g |
| Anhydrous sodium sulfite | 4.25 g |
| Hydroxylamine.½ sulfate | 2.0 g |
| Anhydrous potassium carbonate | 37.5 g |
| Sodium bromide | 1.3 g |
| Trisodium nitrilotriacetate, monohydrate | 2.5 g |
| Potassium hydroxide | 1.0 g |
| Add water to make | 1 liter |
| Adjust pH to be | pH = 10.1 |
| <Bleacher> | |
| Ferric ammonium ethylenediaminetetraacetate | 100.0 g |
| Diammonium ethylenediaminetetraacetate | 10.0 g |
| Ammonium bromide | 150.0 g |
| Glacial acetic acid | 10.0 g |
| Add water to make | 1 liter |
| Adjust pH with aqueous ammonia to be | pH = 6.0 |
| <Fixer> | |
| Ammonium thiosulfate | 175.0 g |
| Anhydrous sodium sulfite | 8.5 g |
| Sodium metasulfite | 2.3 g |
| Add water to make | 1 liter |
| Adjust pH with acetic acid to be | pH = 6.0 |
| <Stabilizer> | |
| Formalin, in an aqueous 37% solution | 1.5 ml |
| Konidux, manufactured by Konica Corp. | 7.5 ml |
| Add water to make | 1 liter |

4. Density measurement

A density is expressed in terms of $\log_{10}(\phi_0/\phi)$. $\phi_0$ represents an illumination flux for measuring a density, and $\phi$ represents a transmission flux in a portion subject to the measurement. The geometric conditions for measuring a density are subject to a parallel flux in the direction of a normal line of the illumination flux. As the control transmission flux, the whole flux transmitted to be diffused in a subaerial space is used and, when using the other measurement methods, a correction is to be carried out by making use of a control density piece. Further, when making a measurement, the surface of an emulsion layer is faced to a photoreceptor side. The densities subject to measurement are the status M densities of blue, green and red and the spectral characteristics thereof are set to be the values shown in Table 2, as the comprehensive characteristics of a light source, an optical system, an optical filter, and a photoreceptor each used in a densitometer.

TABLE 2

Spectral characteristics of status M density (Logarithmically expressed and a control peak set at 5,000)

| Wavelength, nm | Blue | Green | Red |
|---|---|---|---|
| 400 | * | * | * |
| 410 | 2.10 | * | * |
| 420 | 4.11 | * | * |
| 430 | 4.63 | * | * |
| 440 | 4.37 | * | * |
| 450 | 5.00 | * | * |
| 460 | 4.95 | * | * |
| 470 | 4.74 | 1.13 | * |
| 480 | 4.34 | 2.19 | * |
| 490 | 3.74 | 3.14 | * |
| 500 | 2.99 | 3.79 | * |
| 510 | 1.35 | 4.25 | * |
| 520 | ** | 4.61 | * |

TABLE 2-continued

Spectral characteristics of status M density (Logarithmically expressed and a control peak set at 5,000)

| Wavelength, nm | Blue | Green | Red |
|---|---|---|---|
| 530 | ** | 4.85 | * |
| 540 | ** | 4.98 | * |
| 550 | ** | 4.98 | * |
| 560 | ** | 4.80 | * |
| 570 | ** | 4.44 | * |
| 580 | ** | 3.90 | * |
| 590 | ** | 3.15 | * |
| 600 | ** | 2.22 | * |
| 610 | ** | 1.05 | * |
| 620 | ** | ** | 2.11 |
| 630 | ** | ** | 4.48 |
| 640 | ** | ** | 5.00 |
| 650 | ** | ** | 4.90 |
| 660 | ** | ** | 4.58 |
| 670 | ** | ** | 4.25 |
| 680 | ** | ** | 3.88 |
| 690 | ** | ** | 3.49 |
| 700 | ** | ** | 3.10 |
| 710 | ** | ** | 2.69 |
| 720 | ** | ** | 2.27 |
| 730 | ** | ** | 1.86 |
| 740 | ** | ** | 1.45 |
| 750 | ** | ** | 1.05 |
| | | | ** |

Note: *Red slope = 0.260/nm; green slope = 0.106/nm; and blue slope = 0.250/nm
**Red slopw = −0.040/nm; green slope = −0.120/nm; and blue slope = −0.220/nm 5. Determination of photographic speed Using the results obtained by processing a light-sensitive material subject to tests and measuring the density thereof, a photographic speed is determined in the following procedures:

(1) The exposure quantities are each obtained so as to correspond to a density 0.15 higher than the minimum densities of blue, green and red. The resulting exposure quantities are expressed in terms of a lux.second and they are denoted by $H_B$, $H_G$ and $H_R$, respectively.

(2) Either one having a larger exposure quantity between $H_B$ and $H_R$—that is, either one lower in speed—is denoted by $H_S$.

(3) Specific photographic speed S is calculated out in the following equation:

$$S = \sqrt{\frac{2}{H_G \times H_S}}$$

Next, the method of measuring the RMS values and the preferred embodiments each of the invention will be detailed below.

The samples applicable for measuring an RMS value are those treated in an exposure and development process in the same manner as in the foregoing method for testing the ISO speeds. One of the examples of the positions for measuring the RMS value of a blue sensitive layer unit and the method of measuring the same will now be detailed. The positions for measuring the RMS value are three positions, namely, a minimum blue density position at the status M density, —$D_{min}(B)$—, used in the foregoing method for testing the ISO speeds, a density point, —$D_1(B)$—, obtaining $D_{min}(B)+0.15$, and a density point, —$D_2(B)$—, corresponding to an exposure quantity of $\log H_B+0.5$ when the exposure quantity corresponding to $D_1(B)$ is expressed in terms of an $H_B$ lux.second. The RMS values are indicated by a value 1,000 times a standard deviation of the variations in the density values obtained from not less than 1,000 samplings for measuring the density. Such an RMS value as described above is obtained by scanning the density of a sample in the portion subject to measurement by making use of a microdensitometer attached with a Wratten filter W-47, manufactured by Eastman Kodak Co., and having an area of 1800 $\mu m^2$ of a scanning aperture —that has a slit width of 10 $\mu m$ and a slit length of 180 $\mu m$—.

In the green sensitive layer unit and the red sensitive layer unit, the RMS values thereof are measured in the following manner; the status M densities are measured by a green or red density and the color separation filter, Wratten filter W-47, attached to the microdensitometer is replaced by Wratten filter W-99 for the green sensitive layer unit and by Wratten filter W-26 for the red sensitive layer unit, respectively.

The objects of the invention can be achieved in the following manner: At least one of the light-sensitive unit out of the foregoing three light-sensitive units is made it to have the following relations;

$$1.1\ RMS_0 \leqq RMS_1 \leqq 1.5\ RMS_0 \quad (1), \text{ and}$$

$$0.9\ RMS_0 \leqq RMS_2 \leqq 1.2\ RMS_0 \quad (2)$$

wherein $RMS_0$ is an RMS value of a minimum density of the layer unit, $RMS_1$ is an RMS value in an exposure quantity logH which makes the layer unit to have a density of a minimum density+0.15, and $RMS_2$ is an RMS value corresponding to an exposure quantity of logH+0.5. Further, the preferred embodiments of the invention include, for example, those having the relation of $1.25\ RMS_0 \leqq RMS_1 \leqq 1.35\ RMS_0$ and those having the relation of $1.05\ RMS_0 \leqq RMS_1 \leqq 1.15\ RMS_0$. For displaying the effects of the invention, there is no special limitation to the values of $RMS_0$ itself. However, for improving the comprehensive characteristics, particularly the graininess, of a color photographic light-sensitive material, it is preferred that the values of $RMS_0$ are as small as possible. Further, there is also no special limitation to the RMS values obtained on the side of an exposure quantity more than that obtained at the point of measuring an $RMS_2$, however, when setting the RMS value between 0.9 $RMS_0$ and 1.1 $RMS_0$, the effects of the invention can be utmost displayed. In addition, in the case where the effects of the invention are remarkably displayed, an $RMS_1$ value shows not less than 90% of the maximum RMS value in the whole exposure area on at least one of the light sensitive layer units.

The effects of the invention can be maximized when all the three light sensitive layer units satisfy the requirements for both of the RMS values (1) and (2). When applying the invention to two light sensitive layer units, a blue and green light sensitive layer units are preferably used. When applying the invention to only one light sensitive layer unit, a blue light sensitive layer unit is preferably used.

There is no special limitation to any technical means for materializing the invention. However, in the both cases where a light sensitive layer unit is comprised of two layers, namely, a high speed silver halide emulsion layer and a low speed silver halide emulsion layer, and where a light sensitive layer unit is comprised of three layers, namely, the above-given two layers and a medium speed silver halide emulsion layer, it is effective that the requirements for satisfying the foregoing relations (1) and (2) are selected by properly adjusting the density, the coupler and silver halide contents and the silver halide grain size each of the high speed silver halide emulsion layer.

As the more concrete means for materializing the invention, it may be considered to use the following means, namely; a means in which an average iodide composition or a surfacial and internal iodide composition of the silver halide grains to be applied to a high speed silver halide emulsion layer is devised, the size-distributions of the grains is adjusted, the crystal habits and configurations of the grains are optimized, or the grain sizes are made somewhat smaller, thereby improving the graininess with improving the developability and preventing a desensitization; another means in which a plurality of silver halide emulsions each different in grain size are mixed in the high speed silver halide emulsion layer; a further means in which the color density of the high speed silver halide emulsion layer is set to be within the range of 0.3 to 0.8 and, preferably, 0.4 to 0.7; a still further means in which a silver halide content is increased properly without causing any aging deterioration troubles for sharpness and graininess. The above-given means are merely some examples and it is, therefore, to be understood that the means for materializing the invention shall not be limited thereto.

The emulsions applicable to the films of the invention are preferable to be those comprising a core/shell type or a twinned crystal type AgX.

The silver halide color negative light-sensitive materials of the invention are each comprised of a support provided thereon with at least one each of a light-sensitive layer unit containing a red sensitive silver halide emulsion and a cyan coupler, another light-sensitive layer unit containing a green sensitive silver halide emulsion and a magenta coupler, and a further light-sensitive layer unit containing a blue sensitive silver halide emulsion and a yellow coupler. Each of the light sensitive layer units may be comprised of either a single layer or not less than two layers such as those having different speeds from each other. However, in at least any one of the layers of any one of the light sensitive layer units —that is to say, in at least any one of the layers, provided one of the light sensitive layer unit is comprised of not less than two layers—, it is preferable to contain therein a light sensitive silver halide emulsion containing silver iodobromide grains each having both of a core substantially comprising silver iodobromide and a shell covering the core and substantially comprising silver bromide or silver iodobromide having a silver iodide content smaller than that of the core, and it is also preferable that the silver iodide contents of the individual grains of the light sensitive silver halide emulsion have each a relative standard deviation of not higher than 20%.

In the other embodiments of the invention, it is also preferable to contain a silver halide emulsion mainly comprising twinned crystals, and having a monodispersibility and a relatively high silver iodide content inside the grains.

The above-mentioned core/shall type emulsions will be detailed as follows.

In the emulsions, the cores of the silver halide grains thereof are preferably those substantially comprising silver iodobromide containing silver bromide in a proportion of not lower than 5 mol %. It is also preferable that the silver halide grains each have a double layered structure comprising the cores and the shells covering the cores and substantially comprising silver bromide or silver iodobromide having a silver iodide content lower than those of the cores. The silver iodide contents of the cores are to be, desirably, not lower than 10 mol % and, most desirably, within the range of not lower than 20 mol % and not higher than 44 mol %. The silver iodide contents of the shells are, desirably, not higher than 5 mol %.

The cores are allowed to contain silver iodide uniformly or to have a multilayered structure having the plural phases of silver iodide contents different from each other. In the latter case, the silver iodide content in the highest phase is not lower than 5 mol % and, desirably, not lower than 10 mol %. It is also advisable that the silver iodide contents of the shells are lower than in the phase of the highest silver halide content of the cores. In the meantime, the expression, '. . . substantially comprising silver iodobromide . . . ', means that some material comprises mainly silver iodobromide and that it is also allowed to contain the other components in an amount, for example, about 1 mol %.

In a desirable embodiment of the silver halide grains applicable to the photographic emulsion layers of the silver halide photographic light sensitive materials of the invention, the silver halide grains have a structure that, in the case of obtaining a diffraction pattern showing the relation between the diffraction intensity of the (220) face of a silver halide grain and the diffraction angle thereof within the range of the diffraction angles, $2\theta$, between 38° to 42° by making use of a $K\alpha$ ray of Cu, a minimum point appears between the two diffraction maximum points, namely, a diffraction peak corresponding to the core portion for one and a peak corresponding to the shell portion for the other, and the diffraction intensity corresponding to the core portion can be within the range of 1/10 to 3/1 of that of the shell portion. The grains have a diffraction intensity ratio between each of the cores and shells thereof within the range of, desirably, 1/5 to 3/1 and, preferably, 1/3 to 3/1.

When the silver halide grains have the above-described double layered structure, a silver halide emulsion having a high silver iodide content can be used without delaying a development rate, so as to enable a light sensitive material to have an excellent graininess even when a small amount of silver is coated thereon.

There is another embodiment of the silver halide grains contained in the above-mentioned emulsion, wherein the grains have inside the silver iodobromide phase for forming the cores having a silver iodide content within the range of 10 to 40 mol %, and the silver iodobromide phase is covered with a silver halide phase for forming the shells and having a lower silver iodide content and, further, the surfaces of the grains have each a silver iodide contents of not less than 5 mol %. The silver iodide compositions contained in the shells may be uniform or not uniform. The expression, 'a surface has a silver iodide content of not less than 5 mol %', means that an average silver iodide content of a grain surface is not less than 5 mol % when measured in an XPS method. The average silver iodide content of the surface is desirably within the range of not less than 7 mol % to not more than 15 mol %. Such silver halide grains as described above are detailed in Japanese Patent Publication Open to Public Inspection —hereinafter referred to as Japanese Patent O.P.I. Publication —No. 63-106745/1986. This type of silver halide grains may preferably be used, because they have an excellent graininess.

There is a further embodiment of the silver halide grains contained in the above-mentioned emulsion, wherein each of the silver halide grains has the following two elements; namely, an internal nucleus substantially comprising silver iodobromide and/or silver iodide so as to serve as the core, and a plurality of the outer shells —for serving as the shell— provided to the outside of the internal nucleus and substantially comprising silver bromide and/or silver iodobromide; also wherein the outermost shell of each silver halide grain has a silver iodide content of not more than 10 mol % and, a high silver iodide containing shell having a silver iodide content of not less than 6 mol % is provided to the inside of the outermost shell and an intershell is interposed between the outermost shell and the high silver iodide containing shell so that the intershell may have a silver iodide content to be intermediate between both of the silver iodide contents of the above-mentioned shells; and, further wherein the silver iodide content of the intershell is not less than 3 mol % higher than that of the outermost shell and, at the same time, the silver iodide content of the high silver iodide containing shell is not less than 3 mol % higher than that of the intershell. Such silver halide grains are detailed in Japanese Patent O.P.I. Publication No. 61-245151/1986. The silver halide grains can also preferably be used, because they have an excellent graininess.

In the above-described emulsion, the individual silver iodobromide grains have each the relative standard deviation of the silver iodide content are not more than 20%. The emulsions of the invention can preferably be used when the iodide contents among the grains are uniform.

From the viewpoints of obtaining a uniform chemical and/or spectral sensitization, it is also preferable that the silver iodide contents of the individual silver halide grains are uniform.

In the emulsions, the silver iodide contents of the individual silver halide grains and an average silver iodide content thereof can be obtained in an electron probe microanalyzing method —an EPMA method—.

The EPMA method is a technique in which a sample is prepared well dispersively so as not to bring emulsion grains into contact with each other, and then the resulting sample is elementally analyzed in the submicron portions thereof through X rays excited by applying an electron beam to the sample.

The halogen composition of the individual grains can be determined in the above-mentioned EPMA method in the manner that the intensities of characteristic X rays of the silver and iodides contained in each grain are obtained by measuring the X rays radiating from each of the grains.

When obtaining the silver iodide contents each of at least 50 grains in the EPMA method, an average silver iodide content can be derived from the average contents obtained.

No peculiar specifications are particularly required for the apparatuses for the above-mentioned measurement. However, in the examples of the invention of which will be detailed later, the silver iodide contents were measured through an X ray microanalyzer, Model JXA 8621, manufactured by NEC. For eliminating the damages caused by electron beams, the measurements were carried out by cooling the samples.

The relative standard deviations of the silver iodide contents of the individual grains are each expressed by a value obtained by 100-times multiplying the value obtained by dividing the value of the standard deviation of a silver iodide content by the value of an average silver iodide content, provided, the silver iodide contents of at least 50 emulsion grains are measured as described above.

The above-mentioned relative standard deviation value is required to be not higher than 20% when measuring the distribution of the silver iodide contents of the grains in the EPMA method. However, as mentioned before, the silver iodide contents of the individual grains are preferable to be uniform, and the relative standard deviation values are to be not more than 15% and, preferably, not more than 10%.

The emulsions having an excellent uniformity of such a silver iodide contents as mentioned above can be materialized in the various means of improving the uniformity of the silver iodide contents. For example, such a emulsion can be materialized by devising the conditions for preparing a silver halide emulsion.

For example, it is effective to use such a method as disclosed in Japanese Patent Application No. 63-224002/1988 in which iodide ions are supplied from fine silver iodide grains, and another method such as that disclosed in Japanese Patent O.P.I. Publication No. 1-183417/1989 in which fine silver iodide grains are grown to be seed grains in an Ostwald's ripening process.

The silver halides preferably capable of constituting the above-mentioned emulsions are silver iodobromide containing silver iodide in a proportion of not more than 30 mol %. Among them, the most desirable silver halide is silver iodobromide containing silver iodide within the range of 2 mol % to 20 mol %.

For making both of a high speed and a high image quality compatible, it is desirable to make the average silver iodide content of silver halide used in the whole emulsion layer to be not less than 8 mol %, as described in Japanese Patent O.P.I. Publication No. 60-128443/1985. It has been known that a graininess can remarkably be improved when increasing an average silver iodide content of silver halide. On the contrary, however, there have the defects that causing the delays in the rates of developing, desilvering and fixing operations, when the silver iodide content is increased in a certain extent. The above-mentioned emulsion can overcome the defect with increasing the silver iodide content, so that the problems described above can be solved.

Next, the twinned crystal type emulsions will now be detailed below.

In the invention, the term, 'twinned crystal', means a silver halide crystal having not less than one twin plane in one grain. The classification of the twinned crystal configurations are detailed in Klein and Moisar, 'Photographische Korrespondenz', vol 99, p. 99, and ibid., vol. 100, p. 57. When a twinned crystal has two or more twin planes, the planes may be parallel or not parallel to each other.

In the invention, the expression, '. . . mainly comprises a twinned crystal . . . ', means that the proportion of twinned crystal grains occupied in the whole grains of an emulsion is not less than 60% in number. In the emulsions of the invention, the proportion thereof is, desirably, not less than 80% and, preferably, within the range of 95 to 100%.

The above-mentioned emulsion is comprises twinned crystal grains having, desirably, two or more parallel twin plane, more desirably, even numbers of the parallel planes and, preferably, two or more of the planes.

Herein, the expression, '. . . mainly comprises twin planes each having two or more parallel twin planes . . . ', means that the proportion of the twinned crystal grains each having two or more parallel twin planes is not less than 50%, more desirably, not less than 60% and, preferably, not less than 70%, each to be contained in an emulsion.

The emulsions may be comprised of any types of the twinned crystal grains such as those having {111} faces, {100} faces and/or the combination of the above two faces. Among the grains, those having {111} faces are preferably be used.

When using the twinned crystal grains each having two or more parallel twin planes and projecting each of the grains in the direction vertical to the twinned crystal face thereof, the ratio of the grain diameter converted into a circle to the grain thickness, —the space between two parallel outer surfaces each also parallel to the parallel twin planes—, is within the range of, desirably, not less than 1 to not more than 20, more desirably, not less than 1.2 to less than 8 and, preferably, not less than 1.5 to less than 5.0.

The above-mentioned emulsions are preferably monodispersion.

In the invention, the term, 'monodispersion', means that silver halide is contained in the whole grain constituting the emulsion, and the amount by weight of the silver halide having a grain size within the range of ±20% round an average grain size $\bar{d}$ of the whole grain is not less than 70% desirably not less than 80% and, preferably, not less than 90%, each of the amount by weight of the whole silver halide, in the emulsions of the invention.

Herein, an average grain size $\bar{d}$ is defined as a grain size $d_i$ obtained when a grain having a grain size $d_i$ maximizes a product $n_i \times d_i^3$ of frequency $n_i$ and $d_i^3$, provided, the effective numerals are limited to 3 columns and the columns of the minimum numeral are rounded to the nearest whole number.

The term, 'a grain size', means a grain diameter obtained when the projective image area of a grain is converted into a circular image having the same area as in the projective image.

Such a grain size as defined above can be obtained in the manner, for example, that a grain is photographed after it is magnified 10,000 to 50,000 times through an electron microscope, and the diameter of the grain printed or the area of the grain projected is practically measured, provided, the numbers of the grains subject to measurement is not less than 1,000 at random.

Among the emulsions, the particularly preferable highly monodispersed emulsions are those having a grain distribution of not more than 20% and, more dirably, not more than 15%, in which the grain distribution degrees are defined by the following equation:

$$\frac{\text{Standard grain size deviation}}{\text{Average grain size}} \times 100 = \text{Distribution degree (\%) or Variation coefficient}$$

Herein, the grain size measurement method is to be in conformity with the above-described measurement method, and the average grain size is obtained in terms of arithmetical mean.

$$\text{An average grain size} = \frac{\Sigma d_i n_i}{\Sigma n_i}$$

The silver halide emulsions are preferable to have an average grain size within the range of, desirably, 0.1 to 10.0 μm, more desirably, 0.2 to 5.0 μm and, preferably, 0.3 to 3.0 μm.

In the light sensitive materials of the invention, the emulsions of the invention applicable thereto contain each silver iodide, however, they are preferable to be silver iodobromide emulsions.

In particular, the above-mentioned emulsions are comprised of silver iodobromide having an average silver iodide content within the range of, desirably, 4 to 20 mol % and, preferably, 5 to 15 mol %.

However, the emulsions shall not always be limited to the silver iodobromide emulsions, but they may be comprised of any other silver halides containing silver iodide. For example, even when using a silver iodobromide emulsion in an actually desired light sensitive material, the emulsion is allowed to contain silver chloride, provided, the effects of the invention cannot be spoiled.

The emulsions each have the phase of a high silver iodide content in the inside of the grains thereof. This means that the emulsions each contain silver halide grains having the phase of a high silver iodide content inside the grains thereof.

In silver halide grains, the expression, '. . . have the phase of a high silver iodide content inside the grains . . . ', means that the phase of a high silver iodide content is covered thereon with a phase of a low silver iodide content that is lower in the silver iodide content than in the former phase or with a phase of a silver halide not containing any silver iodide, such as a phase of silver chlorobromide —hereinafter referred collectively to a phase of low silver iodide content—.

In the grains, the silver iodide content of a phase of a high silver iodide content is within the range of, desirably, 15 to 45 mol %, more desirably, 20 to 42 mol % and, preferably, 25 to 40 mol %.

The above-mentioned phase of a low silver iodide content, which is lower than in the phase of the high silver iodide content, may be present on the outermost layer of each grain. In this case, the average silver iodide content is, desirably, not more than 6 mol % and, preferably, within the range of 0 to 4 mol %. Further, any one of the other silver iodide containing phases —that may be an intermediate phase such as those having a silver iodide content intermediate between the two phases —may be interposed between the low silver iodide content phase —that can be served as the outermost layer— and the high silver iodide content phase.

When such an intermediate phase is provided, the silver iodide content thereof is within the range of, desirably, 10 to 22 mol % and, preferably, 12 to 20 mol %.

Also when such an intermediate phase is provided, the silver iodide content, that is intermediate between that of the outermost phase —that is, a low silver iodide content phase— and that of the intermediate phase, or between that of the intermediate phase and that of the high silver iodide content phase provided inside, is to have a difference of, desirably, not less than 6 mol % and, preferably, not less than 10 mol %.

In the above-described embodiments, it is also allowed to make other silver halide phase around the center of the high silver iodide content phase provided inside, between the high silver iodide content phase provided inside and the intermediate phase, or between the intermediate phase and the outermost phase —that is, the low silver iodide content phase—.

The volume of the outermost phase—that is, the low silver iodide content phase—is within the range of, desirably, 4 to 70 mol % and, preferably, 10 to 50 mol %, of the volume of the whole grains. In the case where the intermediate phase is provided, the volume thereof is within the range of, desirably, 5 to 60 mol % and, preferably, 20 to 55 mol %, of the volume of the whole grain.

The above-mentioned phases each may be comprised of a single phase having a uniform composition, the group consisting of the phases having the compositions varied stepwise, the continuous phases having the compositions continuously variable in any one of the desired phases, or the combinations of the above-mentioned phases.

Another embodiment of the emulsions is that silver iodide localized on grains does not form a substantially uniform phase, but the silver iodide is varied continuously toward the outer side from the center of each of the grains. In this case, the silver iodide content is preferably reduced in a monotone toward the outer side of each of the grains from the point where the silver iodide content inside of each of the grains is maximized.

The silver iodide content at the point where the silver iodide content is maximized is within the range of, desirably, 15 to 45 mol % and, preferably, 25 to 40 mol %.

The silver iodide content of a grain surface phase is desirably not more than 6 mol % when the grains are comprised of silver iodobromide or silver chlorobromide and, preferably, within the range of 0 to 4 mol % when the grains are comprised of silver iodobromide.

The emulsions should preferably satisfy at least one of the following requirements (1) through (4):

(1) When comparing an average silver iodide content $J_1$ obtained in an X ray fluorometry with a grain surface silver iodide content $J_2$ obtained in an X ray excited photoelectron spectroscopy, the relation of $J_1 > J_2$ is to be satisfied.

The X ray excited photoelectron spectroscopy is as follows:

In advance of measuring an emulsion subject to a measurement in the X ray excited photoelectron spectroscopy, the emulsion is to be pretreated in the following manner: First, A pronase solution is added to the emulsion and the mixture thereof is stirred at 40° C. for one hour, so that the gelatin of the emulsion is decomposed. Next, the grains of the emulsion are precipitated in a centrifugal separation treatment and the resulting supernatant liquid is removed. The above-mentioned washing step is repeated three times and the grains of the emulsion are redispersed in ethanol. The redispersed emulsion grains are thinly coated on a mirror-polished silicon wafer, so that a sample for the measurement can be prepared.

In the X ray excited photoelectron spectroscopy, the measurement can be carried out by making use of an apparatus such as Model ESCA/SAM 560 manufactured by PHI Co. and X rays for excitation such as Mg-Kα rays, and under the conditions of an X ray source voltage of 15 KV, an X ray source current of 40 mA, and a pass energy of 50 eV.

For obtaining the surface halide composition in the above-mentioned manner, each of Ag3d, Br3d and I3d3/2 electrons is detected. The composition ratios thereof are culculated out by making use of the integral intensities of each peak and in a relative sensitivity coefficient method. When using 5.10, 0.81, and 4.592 as the relative sensitivity coefficients of Ag3d, Br3d, and I3d 3/2, respectively, the composition ratios can be given in terms of an atomic percentage.

(2) When comparing an average silver iodide content $J_1$ obtained in the X ray fluorometry with an average value $J_3$ obtained by measuring, in an X ray microanalysis, the silver iodide contents on silver halide crystals each not less than 80% apart from the center of the crystal in the direction of the grain diameter of the silver halide grains subject to the measurement, the relation of $J_1 > J_3$ is to be satisfied.

The above-described X ray microanalysis is as follows:

Silver halide grains are dispersed in an electron microscopic observation grid to which an electron microscope is loaded with an energy dispersion type X ray analyzing apparatus, and one grain is so magnified as so adjusted as to make it come in sight of a CRT field of vision while cooling it with liquid nitrogen. Then, the intensities of AgL$\alpha$ and IL$\alpha$ rays are integrated. After providing an intensity ratio of IL$\alpha$ rays to AgL$\alpha$ rays in advance, a silver iodide contents of the emulsion grains can then be calculated out by making use of a calibration curve.

(3) Using CuK$\alpha$ rays as a radiation source and in a (420) X ray diffraction signal, the signal at a height of a maximum peak height$\times$0.13 is to be generated continuously extending over the diffraction angles of not narrower than 1.5 degrees.

At a height of a maximum height$\times$0.15, the signal is to be generated continuously extending over the diffraction angles of, desirably, not narrower than 1.5 degrees, more desirably, not narrower than 1.8 degrees and, preferably, not narrower than 2.0 degrees.

The expression, 'a signal is generated continuously', mentioned herein means that, at a signal height of a maximum peak height$\times$0.13 or $\times$0.15, the signal is generated continuously extending over not narrower than 1.5 degrees, that is to say, the signal is generated without being separated into two or more waveforms.

The above-mentioned (420) X ray diffraction signal, which is being generated by CuK$\alpha$ rays as the radiation source, has more desirably two or three peaks and preferably three peaks.

The above-mentioned X ray diffraction signal can be obtained in an X ray diffractometry which has been known as a method of investigating the crystal structure of silver halides.

In this case, a variety of characteristic X rays may be used as the X ray radiation sources. Among the X ray radiation sources, the above-mentioned CuK$\alpha$ rays using Cu as the targets thereof are most widely applied.

For example, when silver iodobromide has a rock-salt structure, the (420) diffraction spectrum may generally be observed at the angles of $2\theta = 71$ to 74 degrees. The signal intensity is relatively high and has a wide angles. Therefore, the resolving power can be so excellent as to be optimum in checking up the crystal structures of silver halide grains.

When measuring the X ray diffraction of emulsion grains, it is needed to measure the diffraction in a powder radiography, after removing gelatin and mixing a standard sample of, for example, silicon.

When performing the measurement, 'A Series of Basic Chemical Analyses', Vol 24, titled 'X ray Analyses', published by Kyoritsu Publishing Co., for example, may be referred.

(4) When measuring the average silver iodide content of individual silver halide grains in the above-mentioned X ray microanalysis, the relative standard deviation of the measured values is to be not higher than 20%.

It is, desirably, not higher than 15% and, preferably, not higher than 12%.

The term, 'a relative standard deviation', mentioned herein means a value$\times$100 obtained by dividing the value of the standard deviation of a silver iodide content by the average silver iodide content of the grains subject to measurement, when measuring the silver iodide contents of at least 100 emulsion grains.

The emulsion can be prepared, for example, in the following procedures: In the case of preparing a silver halide photographic emulsion by supplying an aqueous silver salt solution and an aqueous halide solution in the presence of a protective colloid;

The emulsion can desirably be prepared in the following manner;

(A) A nuclear grain preparing step is so provided as to keep a mother liquid to have a pBr within the range of 2.0 to 0.7 from the initial stage of the precipitation of silver halide having a silver iodide content within the range of 0 to 5 mol % until an intermediate stage of not less than one half the whole of the precipitation stage;

(B) Following the above-mentioned nuclear grain preparing step, a seed grain preparing step is so provided as to form silver halide seed grains which have substantially monodispersive globular twinned crystals prepared by containing a silver halide solvent in an amount within the range of $10^{-5}$ to 2.0 mols per mol of silver halide, into the mother liquid; and (C) Next, a seed grain enlarging and growing step is provided, in which an aqueous silver salt solution, an aqueous halide solution and/or fine silver halide grains are added.

The term, 'a mother liquid', mentioned herein means a liquid supplied to the processing steps of preparing a silver halide emulsion up to the completion of a photographic emulsion —in the mother liquid are allowed to contain a silver halide emulsion—.

The silver halide grains formed in the above-described nuclear grain preparing step are twinned crystal grains comprising silver iodobromide containing silver iodide in a proportion within the range of 0 to 5 mol %.

In the case where the above-described preparation method is adopted, the twinned crystal grains can be prepared in the following manner: Extending over a period starting from the initial stage of the nuclear grain preparing step until a period of not shorter than one half of the whole period, the bromide ion concentration in an aqueous protective colloid solution is kept within the range of 0.01 to 5 mol % per liter, that is, within the range of pBr=2.0 to $-0.7$ and, desirably, 0.03 to 5 mol % per liter, that is, pBr=1.5 to $-0.7$, and an aqueous silver salt or an aqueous silver salt and an aqueous silver halide are added to the above-mentioned resulting mixture.

The above-mentioned nuclear grain preparing step is defined as a step precedent to the seed grain preparing step. The period for carrying out the nuclear grain preparing step includes not only a period from the point of time when starting the addition of an aqueous silver salt into a protective colloid solution to the point of time when none of the new crystal nucleus is substantially produced, but also a period of further growing grains after the above-mentioned period.

In the above-described process, there is no limitation to the nuclear grain size distribution and the nuclear grains may be either of the monodispersion type or the polydispersion type There term, 'polydispersion', herein means that a grain has a variation coefficient —that is synonymous with the foregoing 'grain distribution degree'— of not less than 25%. Such nuclear grains contain twinned crystal grains in a proportion of, desirably, not less than 50% to the whole nuclear grains in number, more desirably, not less than 70% and, most desirably, not less than 90%.

Next, out of the grain preparing process, the above-mentioned seed grain preparing step (B), in which the nuclear grains prepared in the nuclear grain preparing step are ripened in the presence of the silver halide solvent so that the seed grains comprising the monodispersive globular grains can be obtained, will now be detailed.

The ripening treatment made under the presence of the silver halide solvent —hereinafter referred to simply as a ripening —may be presumed to be different from the so-called Ostwald ripening treatment in which small sized grains are dissolved to grow large sized grains when the large and small sized grains are present together and a grain size distribution is generally considered to be widened. For the seed grains prepared of the nuclear grains obtained in the above-mentioned nuclear grain preparing step, the requirements for ripening the seed grains are that, the mother liquid of an emulsion, which was treated through the foregoing nuclear grain preparing step in which twinned crystal grains are prepared by making use of silver halide having a silver iodide content within the range of 0 to 5 mol %, such mother liquid is ripened in the presence of a silver halide solvent in a proportion within the range of $10^{-5}$ to 2.0 mol % per mol of silver. Thereby substantially monodispersed and globular shaped seed grains can be obtained. The expression, '. . . substantially monodispersed . . . ', herein means that the foregoing grain size distribution defined as before is less than 25%.

The expression, 'substantially globular shaped grains' herein means those of which a face such as {111} or {100} face is so slightly roundish as to hardly discriminate when observing the resulting silver halide grains through an electron microscope and, the same grains having a ratio C=L/l within the range of 1.0 to 2.0 and, desirably, 1.0 to 1.5, wherein L represents a maximum grain size and l represents a minimum grain size, each in the directions of the depth, width and height of a grain, when setting three dimensional axes orthogonally crossed each other over a point positioned around the gravity center inside the grains.

In the above-mentioned method, the globular shaped grains are occupied in a proportion of not less than 60%, more desirably, not less than 80% and, preferably, almost 100% each in number, among the whole grains.

In the above-described seed grain preparing step, the silver halide solvents applicable thereto include, for example, (a) organic thioethers such as those described in U.S. Pat. Nos. 3,271,157, 3,531,289, and 3,574,628; Japanese Patent O.P.I. Publication Nos. 54-1019/1979, and 54-158917/1979; and Japanese Patent Examined Publication No. 58-30571/1983; (b) thiourea derivatives such as those described in Japanese Patent O.P.I. Publication Nos. 55-29829/1980 and 55-77737/1980; (c) silver halide solvents having a thiocarbonyl group sandwiched between an oxygen or a sulfur atom and a nitrogen atom, such as those described in Japanese Patent O.P.I. Publication No. 53-82408/1978; (d) indazoles described in Japanese Patent O.P.I. Publication No. 54-100717/1979; (e) sulfites; (f) thiocyanates; (g) ammonia; (h) ethylenediamines such as those described in Japanese Patent O.P.I. Publication No. 57-196228/1982; (i) substituted mercaptotetrazoles such as those described in Japanese Patent O.P.I. Publication No. 57-202531/1982; (j) water soluble bromides; and (k) benzoimidazole derivatives such as those described in Japanese Patent O.P.I. Publication No. 58-54333/1983.

Next, the typical examples of the silver halide solvent (a) through (k) will be given below.

(a)

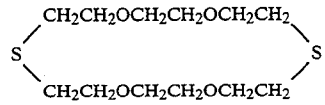

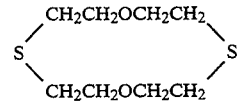

$HOCH_2CH_2SCH_2CH_2SCH_2CH_2OH$ $CH_2NHCOCH_2CH_2COOH$
|
$CH_2SCH_2CH_2SC_2H_5$ $CH_2NHCOC_3H_7$
|
$CH_2SCH_2CH_2SCH_2CH_2COOH$

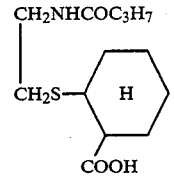

(b)

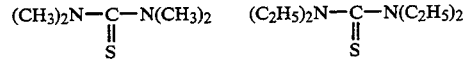

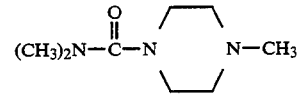

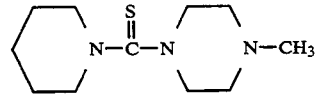

-continued (c)

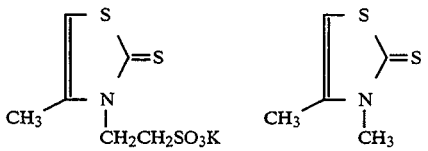

(d)

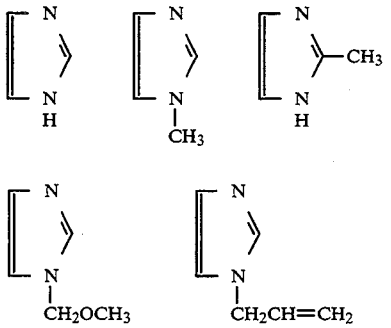

(e) $K_2SO_3$, $Na_2SO_3$ (f) $NH_4SCN$, KSCN (g) $NH_3$ (h) $(HOCH_2CH_2)_2NCH_2CH_2N(CH_2CH_2OH)_2$ $(CH_3\underset{\underset{OH}{|}}{C}HCH_2)_2NCH_2CH_2N(CH_2\underset{\underset{OH}{|}}{C}HCH_3)_2$ $(C_2H_5)_2NCH_2CH_2N(CH_2CH_2OH)_2$ $(C_2H_5\underset{\underset{OH}{|}}{C}HCH_2)_2NCH_2CH_2N(CH_2\underset{\underset{OH}{|}}{C}HC_2H_5)_2$ (i)

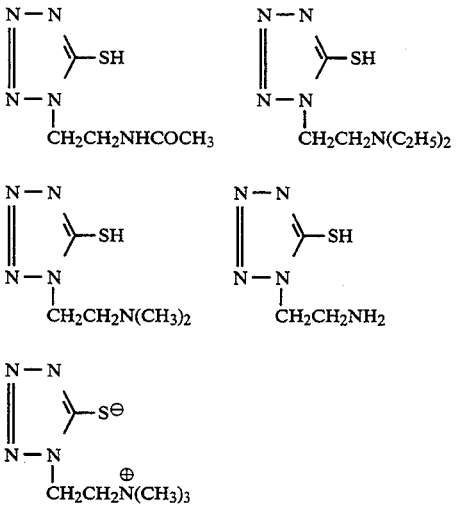

(j) NaBr, $NH_4Br$, KBr (k)

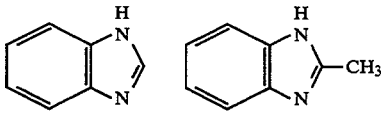

-continued

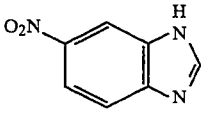

The above-given solvents may be used in combination of two or more kinds of them. The preferable solvents include, for example, thioethers, thiocyanates, thioureas, ammonia, and bromides and, particularly, the combination of ammonia and a bromide.

These solvents may be used preferably in a proportion within the range of $10^{-5}$ to 2 mols per mol of silver halides used.

The pH thereof is within the range of 3 to 13 and, preferably, 6 to 12. The temperatures thereof are within the range of 30° to 70° C. and, preferably, 35° to 50° C.

In one example of the preferable embodiments in which the above-described preparation method is adopted, an emulsion containing suitable seed grains can be obtained by making combination use of ammonia in a proportion within the range of 0.4 to 1.0 mols per liter and potassium bromide in a proportion within the range of 0.03 to 0.5 mols per liter, each at a temperature within the range of 35° to 45° C. and then by carrying out a ripening treatment for a period within the range of 30 seconds to 10 minutes.

In the period of carrying out the foregoing seed grain preparing step, an aqueous silver salt may also be added thereto for the purpose of controlling the ripening treatment.

The foregoing seed grain preparing step (C) for enlarging silver halide grains can be achieved in the course of precipitating silver halide by controlling the following factors; namely, the pAg, pH and temperatures during an Ostwald ripening, the concentration of the silver halide solvent and the composition of the silver halide, and the adding rates of the silver salt and the halide solution.

As are found in Japanese Patent O.P.I. Publication Nos. 51-39027/1976, 55-142329/1980, 58-113928/1983, 54-48521/1979 and 58-49938/1983, the conditions required for enlarging the seed grains obtained in the above-described method are that an aqueous silver salt solution and an aqueous halide solution are added into the above-mentioned resulting seed grains in a double jet method, and the grains are gradually grown with keeping the adding rate so as not to form any new further nucleus according to the enlargement of the grains and also not to produce any Ostwald repening. The other conditions required for enlarging the grains is, as described in The Society of Photographic Science and Technology of Japan, 'The Summary of the Annual Convention 1983', p. 88, that seed grains are enlarged by adding, dissolving and then recrystallizing silver halide fine grains. The seed grains can also be enlarged by satisfying the requirements. However, the grains may preferably be enlarged by satisfying the former requirements.

When preparing the emulsion, the requirements for growing silver halide grains are to be satisfied at a pAg within the range of 5 to 11 and, preferably, 6.0 to 9.5, a temperature within the range of 40° to 85° C. and, preferably, 60° to 80° C., and a pH within the range of 1.5 to 5.8 and, preferably, 1.8 to 4.0.

When growing the grains, it is desirable to add an aqueous silver nitrate solution and an aqueous halide solution in a double jet method. The iodide components thereof may be added as silver iodide into the system. The adding rates are desirably those at which any new nuclei may not further be produced and the grain size distribution may not be widened, that is to say, those of 30 to 100% of the adding rate at which the new nuclei may not further be produced.

When preparing the emulsions of the invention, there may be some instances where the stirring conditions may be essential. As the particularly preferable stirrers, those given, for example, in Japanese Patent O.P.I. Publication No. 62-160128/1987 may desirably be used, in which a nozzle for adding a solution is arranged close to the mother liquid inlet of such a stirrer so as to be dipped into a liquid. In this case, the revolution of the stirrer is, desirably, within the range of 400 to 1,200 rpm.

For constituting the light sensitive materials of the invention, it is allowed to use, if required, the other emulsions that those of the invention, in combination. In this case, any one of other emulsions having any silver halide compositions may be used in combination. That is to say, it is allowed to use, for example, silver bromide, silver iodobromide, silver iodochlorobromide, silver chlorobromide or silver chloride, or any one of the mixtures thereof.

As the above-mentioned core/shell type emulsions or the other emulsions which may be used in combination, if required, —hereinafter referred collectively to as the emulsions applicable to the invention—, those having a grain-size-distribution, which are defined below, may desirably be used. As defined in the formula, $S/\bar{r} \times 100 \leqq 16\%$ in which S and $\bar{r}$ represent a standard deviation of grain sizes and an average grain size, respectively. The emulsions mentioned above is desirably a monodispersive emulsion.

The configurations of the silver halide grains of the emulsions of the invention including, for example, the above-mentioned monodispersive emulsions may be of the cubic, octahedral or tetradecahedral and, in addition, the configurations thereof may also be of the globular or tabular, or any one of the configurations.

Such a monodispersed emulsion as mentioned above is preferably used, because it is excellent in graininess and, at the same time, it is also excellent in image sharpness in the grain size areas having a relatively few light cattering. The monodispersed emulsions are detailed in, for example, Japanese Patent O.P.I. Publication Nos. 54-48521/1979, 54-99419/1979, 56-16124/1981 and 56-78831/1981; U.S. Pat. No. 4,444,877; Japanese Patent O.P.I. Publication Nos. 57-182730/1982, 58-49938/1983 and 58-37635/1983; U.S. Pat. No. 4,446,228; and Japanese Patent O.P.I. Publication Nos. 58-106532/1983, 58-107530/1983, 58-126531/1983, 58-149037/1983, 59-10947/1984, 59-29243/1984, 59-72440/1984, 59-140443/1984, 59-148049/1984, 59-177535/1984 and 59-152438/1984.

The emulsions applicable to the invention are desired to have a low fog. The various means of reducing the fogs produced on silver halide emulsions have been already known. For example, it can be achieved by making use of an additive, namely, a known antifoggant. In particular, it is effective to use a silver halide prepared by devising the conditions of growing a silver halide emulsion, and in the conditions of hardly producing fog. For example, as given in the patent application filed on Feb. 1st, 1990, in the preparation of a silver halide emulsion with the use of an aqueous ammoniacal silver nitrate solution, a low fog silver halide emulsion can be prepared by producing silver halide at a pH of not higher than 7.5.

The low fog type silver halide emulsions are preferably those having a proportion of the fogged grains of not more than 1/200 in an unsensitized emulsion. The expression, 'a proportion of the fogged grains of not more than 1/200 in an unsensitized emulsion', mentioned herein means that the fogged grain number is not more than 1/200 of the whole grain number when a silver halide emulsion having not subjected to a chemical sensitization is coated on a support member and it is then developed.

As mentioned above, the emulsions which can desirably be improved in the graininess or the fogginess caused by aging are those having a proportion of the fogged grains of not more than 1/200 in an unsensitized emulsion and those are also subjected to a chemical sensitization. The emulsions can be improved in fogginess and preservability with keeping a high sensitive speed, when the emulsion is suitably subjected to a chemically sensitization and the resulting emulsion is used in a light sensitive material.

The term, 'fogged grains', mentioned herein means those subjected to a color development process for forming a dye image and, at that time, they are reduced to silver stoms with the silver halide remaining in an unexposed area. In this case, the other grains than the fogged grains can be discriminated by counting the color point numbers of the dye cloud, or by observing directly a developed image through an electron microscope. The color developers applicable to the color development process of this case include, for example, the following ones:

| | |
|---|---|
| <Color developer 1> | |
| Processing time: 3 min. 15 sec. | |
| Processing temperature: 38° C. | |
| 4-amino-3methyl-N-ethyl-N-β-hydroxyethylaniline sulfate | 4.75 g |
| Anhydrous sodium sulfite | 4.25 g |
| Hydroxylamine.½ sulfate | 2.0 g |
| Anhydrous potassium carbonate | 37.5 g |
| Sodium bromide | 1.3 g |
| Trisodium nitrilotriacetate, monohydrate | 2.5 g |
| Potassium hydroxide | 1.0 g |
| Add water to make | 1 liter |
| Adjust pH to be | pH = 10.1 |
| <Developer 2> | |
| Processing time: 3 min. 15 sec. | |
| Processing temperature: 38° C. | |
| potassium carbonate | 30.0 g |
| Potassium hydrogen carbonate | 2.5 g |
| Potassium carbonate | 4.0 g |
| Sodium bromide | 0.6 g |
| Potassium iodide | 1.2 mg |
| hydroxyamine sulfate | 2.5 g |
| Sodium chloride | 0.6 g |
| Diethylenetriamine pentaacetate | 1.0 g |
| 4-amino-3-methyl-N-ethyl-N-β-hydroxyethylaniline nitrate | 4.8 g |
| Potassium hydroxide | 1.2 g |
| Add water to make | 1 liter |
| Adjust pH with potassium hydroxide or a 50% sulfuric acid solution to be | pH = 10.06 |

The developing rate of the fogged grains is extremely rapid as compared to that of the grains other than the fogged grains and, therefore, the other grains can readily be discriminated. The numbers of the fogged grains contained in the unsensitized emulsion can be counted as the numbers of the colored points, for example, by making the color developing time 50% longer.

Therefore, the numbers of the whole silver halide grain and the numbers of the fogged grains contained in a light sensitive material can be confirmed in the following manner; for example, immediately after completing a color developing step, a stopping step and a washing step are carried out, and then after a gelatin degluing agent agent is decomposed, the confirmation of these numbers can be made by observing the light sensitive material through a scanning type electron microscope. Thereby, the proportion of the fogged grains can also be confirmed in the emulsion applicable to a light sensitive material.

Next, an example of the measurements of the proportion of fogged grains contained in an unsensitized light sensitive material is give below.

An emulsion for coating use is prepared by adding an emulsion subject to measurement with the generally known additives for photographic use, such as a spreading agent, a thickener, and a layer hardener, and the magenta coupler M-Cp given below. The resulting emulsion is coated on a triacetyl cellulose film support so that the silver content may be in an amount of 7 mg/100 $cm^2$ and then dried up.

M-Cp

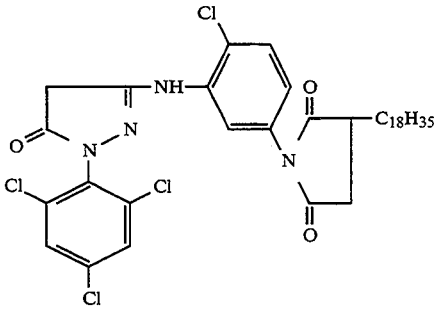

The resulting sample was divided into two parts, namely, Sample A and Sample B. Sample A is subjected to the following processing steps:

| Processing steps -at 38° C.- | |
|---|---|
| Color developing | 5 min. 30 sec. |
| Bleaching | 4 min. 30 sec. |
| Washing | 3 min. |
| Fixing | 4 min. |
| Washing | 3 min. |
| Stabilizing | 2 min. |
| Drying | |

In each of the processing steps, the compositions of the processing solutions are as follows:

| | |
|---|---|
| <Color developer> | |
| 4-amino-3-methyl-N-ethyl-N-β-hydroxyethylaniline.sulfate | 4.75 g |
| Anhydrous sodium sulfite | 4.25 g |
| Hydroxylamine.½ sulfate | 2.0 g |
| Anhydrous potassium carbonate | 37.5 g |
| Sodium bromide | 1.3 g |
| Trisodium nitrilotriacetate, monohydrate | 2.5 g |
| Potassium hydroxide | 1.0 g |
| Add water to make | 1 liter |
| Adjust pH to be | pH = 10.1 |
| <Bleacher> | |
| Ammonium ethylenediaminetetraacetate | 100.0 g |
| Diammonium ethylenediaminetetraacetate | 10.0 g |

-continued

| | |
|---|---|
| Ammonium bromide | 150.0 g |
| Glacial acetic acid | 10.0 ml |
| Add water to make | 1 liter |
| Adjust pH with aqueous ammonia to be | pH = 6.0 |
| <Fixer> | |
| Ammonium thiosulfate | 175 0 g |
| Anhydrous sodium sulfite | 8.5 g |
| Sodium metasulfite | 2.3 g |
| Add water to make | 1 liter |
| Adjust pH with acetic acid to be | pH = 6.0 |
| <Stabilizer> | |
| Formalin in an aqueous 37% solution | 1.5 ml |
| Konidux manufactured by Konica Corp. | 7.5 ml |
| Add water to make | 1 liter |

A photograph is taken on each of the processed samples through an optical microscope, and the numbers of the color points are counted on each of the samples so that the numbers thereof may be counted as the numbers of the fogged grains in an unsensitized emulsion. At the same time, after sample B is fogged by light, it is processed with the same type of the developer as that used in the above-described case and is then stopped and washed with a 3% acetic acid solution.

A photograph is taken on each of the sample obtained through an optical microscope in the same manner as in the case of sample A, and the whole number of the silver halide grains are obtained.

The emulsions applicable to the invention contain the fogged grains which are counted before carrying out the chemical sensitization in a proportion of, desirably, not more than 1/200, more desirably, not more than 1/500 and, preferably, not more than 1/1,000.

In the invention, each of the red-, green- and blue-sensitive layer units may have either a single layer structure or a two or more layers structure. Regardless of that each of the light sensitive layer units has a single layer structure or a two or more layer structure, the emulsions of the invention are allowed to be used in any photographic light sensitive materials each having any layer structures and are also able to display the effects of the invention, when the emulsions are contained in at least either one of the layers. Among the structures thereof, when the light sensitive layer unit has a two layer structure of a high speed layer and a low speed layer, the emulsions of the invention are preferably used in the high speed layer and, when the light sensitive layer unit has a three layer structure of a high speed layer, a medium speed layer and a low speed layer, the emulsions of the invention are preferably used in the high speed layer or in both of the high speed layer and the medium speed layer. It is the matter of course that the emulsions of the invention may be used in the low speed layer, when the light sensitive unit has a two or three layer structure.

It is further allowed to use, at the same time, the combination of the emulsions of the invention and any other silver halide emulsions each different in crystal habits and/or in monodispersibility from those of the emulsions of the invention.

The light sensitive silver halide emulsions may be chemically sensitized in any ordinary methods, namely, a sulfur sensitizing method, a selenium sensitizing method, a reduction sensitizing method and a noble metal sensitizing method in which a gold compound or any one of the other noble metal compounds is used independently or in combination.

The light sensitive silver halide emulsions may also be optically sensitized in any desired wavelength regions, by making use of any one of the dyes which have been known as the sensitizing dyes in the field of photographic techniques. Such sensitizing dyes may be used independently or in combination. Together with the sensitizing dyes, it is also allowed to use a dye not inherently having any spectral sensitizing functions in itself, or a compound substantially incapable of absorbing any visible rays of light, each of which is the so-called supersensitizer for enhancing the sensitizing functions of the sensitizing dyes, in the emulsions.

The sensitizing dyes applicable thereto include, for example, cyanine dyes, merocyanine dyes, compounded cyanine dyes, compounded merocyanine dyes, holopolar cyanine dyes, hemicyanine dyes, styryl dyes, and hemioxonol dyes.

Among the above-given sensitizing dyes, the particularly useful ones include, for example, cyanine dyes, merocyanine dyes and compounded merocyanine dyes.

For the purposes of preventing a silver halide emulsion from being fogged and keeping the photographic characteristics of the emulsion stable in the courses of preparing, preserving and photographically processing the emulsion, the compounds having been known as an antifoggant or a stabilizer may be added in the courses of a chemical sensitization, at the completion thereof, and/or in the period of the digestion prior to the emulsion coating operation.

As a binder —or, a protective colloid— for the silver halide emulsions, gelatin may advantageously be used. It is also allowed to use gelatin derivatives, the graft polymers of gelatin and other high molecular substances, the other proteins, sugar derivatives, cellulose derivatives, and hydrophilic colloids including, for example, synthetic hydrophilic high molecular substances such as a monomers or copolymers.

The emulsion layers and the other hydrophilic colloidal layers of the light sensitive materials used therein the silver halide emulsions of the invention can be hardened by cross linking binder molecules —or, protective colloids— and then by making use of one or more than two kinds of hardeners for enhancing the layer hardness.

The above-mentioned hardeners may be added in an amount capable of hardening a light sensitive material so that no hardener is necessarily added in any processing solutions and, however, the hardeners may also be added in the processing solutions.

As the hardeners, it is allowed to add, independently or in combination, aldehydes such as formaldehyde, glyoxal and glutaraldehyde, N-methylol compounds such as dimethylol urea and methyloldimethylhydantoine, dioxane derivatives such as 2,3-dihydroxydioxane, active vinyl compounds such as 1,3,5-tracyrylyl-hexahydro-s-triazine and 1,3-vinylsulfonyl-2-propanol, active halide compounds such as 2,4-dichloro-6-hydroxy-s-triazine, and mucohalogenoacids such as mucochloric acid and mucophenoxychloric acid.

The emulsion layers and/or the other hydrophilic colloidal layers of the light sensitive materials may also be added by a plasticizer for the purpose of enhancing the softness of these layers. The preferably applicable plasticizers include, for example, the compounds given in Research Disclosure No. 17643, Article XII A.

The emulsion layers and the other hydrophilic colloidal layers of the light sensitive material may also be added by a water insoluble or hardly soluble synthetic polymer dispersions —or, the latexes—, for the purposes of improving the dimensional stability and so on.

When making use of the emulsions relating to the invention in a color light sensitive material and when carrying out a color developing process, the emulsion layers are applied thereinto with a color coupler capable of producing a dye upon reaction with the oxidized products of an aromatic primary amine type developing agent such as a p-phenylenediamine derivative or an aminophenol derivative. The color couplers are usually so selected as to produce the dyes capable of absorbing the photosensitive spectral rays from each of the emulsion layers. In this case, yellow couplers are used in a blue sensitive emulsion layer, magenta couplers in a green sensitive emulsion layer, and cyan couplers in a red sensitive emulsion layer, respectively. It is, however, allowed to prepare a silver halide color photographic light sensitive material in any methods different from the above-mentioned combination so as to meet the application of the light sensitive material.

The above-mentioned color couplers include, for example, a colored coupler having a color compensation effect, and a compound capable of releasing, upon reaction with the oxidized products of a developing agent, the photographically useful fragments including, for example, a development inhibitor, a development accelerator, a bleach accelerator, a developing agent, a silver halide solvent, a color toner, a layer hardener, a foggant, an antifoggant, a chemical sensitizer, a spectral sensitizer, and a desensitizer. Besides the above-given fragments, it is also allowed to use the so-called DIR compounds capable of releasing a development inhibitor and improving the sharpness and graininess of an image. The effects of the invention can be emphasized particularly when making use of a diffusible DIR compound.

The yellow couplers applicable thereto include, for example, the widely known acylacetanilide type couplers and, among them, a benzoylacetanilide type and pivaloylacetanilide type compounds may advantageously used.

The yellow couplers applicable thereto include, typically, those described in, for example, U.S. Pat. No. 2,875,057; West German Patent No. 1,547,868; British Patent No. 1,425,020; Japanese Patent Examined Publication No. 51-10783/1976; and Japanese Patent O.P.I. Publication No. 58-95346/1983.

The magenta couplers applicable thereto include, for example, those of the known 5-pyrazolone type, pyrazolobenzimidazole type, pyrazolotriazole type, open chained acylacetonitrile type and indazolone type couplers.

The typical examples of the magenta couplers applicable thereto include those described in, for example, U.S. Pat. No. 3,891,445; West German Patent No. 1,810,464; West German OLS Patent Publication No. 2,408,665; Japanese Patent Examined Publication No. 40-6031/1965; and Japanese Patent O.P.I. Publication No. 53-55122/1978.

The cyan couplers generally applicable thereto include, for example, a phenol type or naphthol type couplers. The typical examples of the cyan couplers preferably applicable thereto include those described, for example, U.S. Pat. No. 3,893,044; and Japanese Patent O.P.I. Publication No. 58-98731/1983.

The hydrophobic compounds, such as a color coupler, a colored coupler, a DIR compound, an image stabilizer, a color fog inhibitor, a UV absorbent, and a fluorescent whitening agent, each may be dispersed in a silver halide emulsion in any one of various methods such as a solid dispersion method, a latex dispersion method, and an oil drop-in-water type emulsification.-dispersion method. One of the above-given methods is to be selected so as to meet the chemical structures of the above-given hydrophobic compounds such as the couplers.

The above-given color fog inhibitors may be used for preventing each of a color contamination, a sharpness deterioration and a noticeable graininess, each caused by the migration of the oxidized products of a developing agent or an electron transferring agent between the emulsion layers of a light sensitive material.

The color fog inhibitors may be contained in either an emulsion layer in itself or in an interlayer interposed between the two emulsion layers adjacent to each other.

The above-mentioned image stabilizers may be contained in a light sensitive material, for the purpose of preventing a dye image from being deteriorated. The compounds thereof preferably applicable include, for example, those given in Research Disclosure No. 17643, Article VII J.

The hydrophilic colloidal layers of a light sensitive material, such as a protective layer and an interlayer, are also allowed to contain the above-mentioned UV absorbents, for the purposes of preventing the light sensitive material from being fogged by the electric discharge generated by making a frictional charge on the light sensitive material, and also preventing images from being deteriorated by UV rays.

For the purpose of preventing the magenta couplers of a light sensitive material from being deteriorated by formalin, during the preservation of the light sensitive material, a formalin scavenger may be used in the light sensitive material.

In the above-mentioned light sensitive materials, the silver halide emulsion layers and/or the other hydrophilic colloidal layers are allowed to contain a compound capable of varying the developability of the light sensitive material, such as a development accelerator and a development inhibitor, and a bleach accelerator. The compounds preferably applicable as the development accelerators include, for example, those described in Research Disclosure No. 17643, Article XXI, Items B through D. The development inhibitors include, for example, those described in Research Disclosure No. 17643, XXI, Item E. Besides the above, a black-and-white developing agent and/or the precursors thereof may also be used for the purpose of accelerating a development or for the other purposes.

For the purposes of making the sensitive speeds and contracts higher and accelerating the development rates, the emulsion layers of the photographic light sensitive materials of the invention are allowed to contain the derivatives of polyalkylene oxide or the ethers, esters and amines thereof, thioether compounds, thiomorpholines, quaternary ammonium compounds, urethane derivatives, urea derivatives, and imidazole derivatives.

For the purpose of emphasizing the whiteness of a white background and, at the same time, not making the white background showy, a fluorescent whitening agent may also be contained therein. Such fluorescent whitening agents preferably applicable thereinto include, for example, those described in Research Disclosure No. 17643, Article V.

The light sensitive materials may further be provided thereto with auxiliary layers such as a dilter layer, an antihalation layer and an anti-irradiation layer. Such layers and/or the emulsion layers are allowed to contain a dye capable of making it effluent or being bleached in the course of a development process.

A matting agent may be added into the silver halide emulsion layers and/or the other hydrophilic colloidal layers of the light sensitive materials, for the purposes of reducing the gloss of the light sensitive materials, improving the writability thereof, and preventing the light sensitive materials from getting adhered to each other.

An antistatic agent for preventing an electric staticity generation may also be added into the light sensitive materials. The antistatic agent may be used in either a tistaticity preventive layer arranged to the side of a support on which no emulsion is coated, or the other protective layer than the emulsion layers, which is arranged to the side of the support on which the emulsion layer is coated. The antistatic agents preferably applicable thereto include, for example, the compounds described in Research Disclosure No. 17643, Article XIII.

A variety of surfactants may further be used in the photographic emulsion layers and/or the other hydrophilic colloidal layers watch of the light sensitive materials, for the purposes of improving the coatability, slidability, emulsifying dispersibility, adhesion preventability and photographic characteristics such as a development acceleration, layer hardening property and sensitization.

The supports applicable to the light sensitive materials of the invention include, for example; a sheet of paper laminated with an α-olefin polymer such as polyethylene, polypropylene or with an ethylene/butene copolymer; a flexible reflection type support made of synthetic paper or the like; a film comprising a synthetic or semisynthetic high molecular substance such as cellulose acetate, cellulose nitrate, polystyrene, polyvinyl chloride, polyethyleneterephthalate, polycarbonate and polyamide; a flexible support comprising the above-mentioned film provided onto a reflective layer; a support made of glass, metal or ceramic.

The particularly useful coating methods include, for example, an extrusion or curtain coating method each capable of coating two or more kinds of layers at the same time. However, a backer coating method may also be used depending upon the purposes. It is allowed to select any coating speeds in the above-mentioned coating methods.

The color negative photographic light sensitive materials of the invention each comprise each of blue-, green- and red-sensitive silver halide emulsion layers and hydrophilic nonlight sensitive colloidal layers. In the invention, there is no special limitation at all to the arrangements of the above-mentioned layers onto any one of the above-mentioned supports.

For obtaining a dye image on a light sensitive material of the invention, the light sensitive material is subjected to a color photographic process after exposing the light sensitive material to light. Such a color process comprises a color developing step, a bleaching step, a fixing step, a washing step and, if required, a stabilizing step. In place of the processing step of making use of a bleacher and the processing step of making use of a stabilizer, a monobath type bleach-fixer may be used so that a bleach-fixing step may be carried out and, otherwise, it is also allowed to carry out a monobath type processing step so as to use a monobath type developing, bleaching and fixing solution capable of carrying out every one of the color developing, bleaching and fixing steps in a single bath.

The temperatures of each of the processing solutions used therein are so selected as to be within the range of 10° C. to 65° C. It is, however, allowed to keep the temperatures exceeding 65° C. and, preferably, within the range of 25° C. to 45° C.

EXAMPLES

The typical embodiments of the invention will now be detailed below. It is, however, to be understood that the embodiments of the invention shall not be limited thereto.

In all the following examples, the amounts of the materials added into the silver halide photographic light sensitive materials are indicated in terms of grams per sq. meter, unless otherwise expressly stated, and the amounts of silver halides and colloidal silver are indicated in terms of the amounts of silver used.

Example 1

Onto a triacetyl cellulose film support, each of the layers having the following compositions was arranged in order from the support side, so that the multilayered color photographic light sensitive materials, comparative samples 101 and 102, were prepared.

| Sample 101 -for comparison- | |
|---|---|
| Layer 1: An antihalation layer HC-1 | |
| Black colloidal silver | 0.2 |
| UV absorbent UV-1 | 0.23 |
| High boiling solvent Oil-1 | 0.18 |
| Gelatin | 1.4 |
| Layer 2: An interlayer IL-1 | |
| Gelatin | 1.3 |
| Layer 3: A low speed red sensitive emulsion layer RL | |
| Silver iodobromide emulsion having an average grain size of 0.4 μm | 1.0 |
| Sensitizing dye SD-1 | $1.8 \times 10^{-5}$ mols/mol of Ag |
| Sensitizing dye SD-2 | $2.8 \times 10^{-4}$ mols/mol of Ag |
| Sensitizing dye SD-3 | $3.0 \times 10^{-4}$ mols/mol of Ag |
| Cyan coupler C-1 | 0.70 |
| Colored cyan coupler CC-1 | 0.066 |
| DIR compound D-1 | 0.03 |
| DIR compound D-3 | 0.01 |
| High boiling solvent Oil-1 | 0.64 |
| Gelatin | 1.2 |
| Layer 4: A medium speed red sensitive emulsion layer RM | |
| Silver iodobromide emulsion having an average grain size of 0.7 μm | 0.8 |
| Sensitizing dye SD-1 | $2.1 \times 10^{-5}$ mols/mol of Ag |
| Sensitizing dye SD-2 | $1.9 \times 10^{-4}$ mols/mol of Ag |
| Sensitizing dye SD-3 | $1.9 \times 10^{-4}$ mols/mol of Ag |
| Cyan coupler C-1 | 0.25 |
| Colored cyan coupler CC-1 | 0.027 |
| DIR compound D-1 | 0.01 |
| High boiling solvent Oil-1 | 0.26 |
| Gelatin | 0.6 |
| Layer 5: A high speed red sensitive emulsion layer RH | |
| Silver iodobromide emulsion having an average grain size of 0.8 μm | 1.45 |
| Sensitizing dye SD-1 | $1.9 \times 10^{-5}$ mols/mol of Ag |
| Sensitizing dye SD-2 | $1.7 \times 10^{-4}$ mols/mol of Ag |
| Sensitizing dye SD-3 | $1.7 \times 10^{-4}$ mols/mol of Ag |
| Cyan coupler C-1 | 0.07 |
| Cyan coupler C-2 | 0.14 |
| Colored cyan coupler CC-1 | 0.02 |
| DIR compound D-1 | 0.025 |
| High boiling solvent Oil-1 | 0.17 |
| Gelatin | 1.2 |
| Layer 6: An interlayer IL-2 | |
| Gelatin | 0.8 |
| Layer 7: A low speed green sensitive emulsion layer GL | |
| Silver iodobromide emulsion having an average grain size of 0.4 μm | 1.1 |
| Sensitizing dye SD-4 | $6.8 \times 10^{-5}$ mols/mol of Ag |
| Sensitizing dye SD-5 | $6.2 \times 10^{-4}$ mols/mol of Ag |
| Magenta coupler M-1 | 0.54 |
| Magenta coupler M-2 | 0.19 |
| Colored magenta coupler CM-1 | 0.06 |
| DIR compound D-2 | 0.017 |
| DIR compound D-3 | 0.01 |
| High boiling solvent Oil-2 | 0.81 |
| Gelatin | 1.8 |
| Layer 8: A medium speed green sensitive emulsion layer GM | |
| Silver iodobromide emulsion having an average grain size of 0.7 μm | 1.7 |
| Sensitizing dye SD-6 | $1.9 \times 10^{-4}$ mols/mol of Ag |
| Sensitizing dye SD-7 | $1.2 \times 10^{-4}$ mols/mol of Ag |

-continued

| Sample 101 -for comparison- | |
|---|---|
| Sensitizing dye SD-8 | $1.5 \times 10^{-5}$ mols/mol of Ag |
| Magenta coupler M-1 | 0.12 |
| Magenta coupler M-2 | 0.03 |
| Colored magenta coupler CM-1 | 0.04 |
| DIR compound D-2 | 0.018 |
| High boiling solvent Oil-2 | 0.30 |
| Gelatin | 0.8 |
| Layer 8: A high speed green sensitive emulsion layer GH | |
| Silver iodobromide emulsion having an average grain size of 1.0 μm | 1.3 |
| Sensitizing dye SD-6 | $1.2 \times 10^{-4}$ mols/mol of Ag |
| Sensitizing dye SD-7 | $1.0 \times 10^{-4}$ mols/mol of Ag |
| Sensitizing dye SD-8 | $3.4 \times 10^{-6}$ mols/mol of Ag |
| Magenta coupler M-1 | 0.06 |
| Magenta coupler M-3 | 0.02 |
| Colored magenta coupler CM-1 | 0.04 |
| High boiling solvent Oil-2 | 0.31 |
| Gelatin | 1.2 |
| Layer 10: A yellow filter layer YC | |
| Yellow colloidal silver | 0.05 |
| Color antistaining agent SC-1 | 0.1 |
| High boiling solvent Oil-2 | 0.13 |
| Gelatin | 0.7 |
| Formalin scavenger HS-1 | 0.09 |
| Formalin scavenger HS-2 | 0.07 |
| Layer 11: A low speed blue sensitive emulsion layer BL | |
| Silver iodobromide emulsion having an average grain size of 0.4 μm | 0.9 |
| Silver iodobromide emulsion having an average grain size of 0.7 μm | 0.9 |
| Sensitizing dye SD-9 | $5.2 \times 10^{-4}$ mols/mol of Ag |
| Sensitizing dye SD-10 | $1.9 \times 10^{-5}$ mols/mol of Ag |
| Yellow coupler Y-1 | 0.75 |
| Yellow coupler Y-2 | 0.28 |
| DIR compound D-1 | 0.03 |
| High boiling solvent Oil-2 | 0.18 |
| Gelatin | 1.3 |
| Formalin scavenger HS-1 | 0.08 |
| Layer 12: A high speed blue sensitive emulsion layer BH | |
| Silver iodobromide emulsion having an average grain size of 1.0 μm | 0.6 |
| Sensitizing dye SD-9 | $1.8 \times 10^{-4}$ mols/mol of Ag |
| Sensitizing dye SD-10 | $7.9 \times 10^{-5}$ mols/mol of Ag |
| Yellow coupler Y-1 | 0.08 |
| Yellow coupler Y-2 | 0.03 |
| High boiling solvent Oil-2 | 0.074 |
| Gelatin | 1.30 |
| Formalin scavenger HS-1 | 0.05 |
| Formalin scavenger HS-2 | 0.12 |
| Layer 13: The first protective layer Pro-1 | |
| Finely grained silver iodidobromide having an average grain size of 0.08 μm and an AgI content of 1 mol % | 0.4 |
| UV absorbent UV-1 | 0.07 |
| UV absorbent UV-2 | 0.10 |
| High boiling solvent Oil-1 | 0.07 |
| High boiling solvent Oil-3 | 0.07 |
| Formalin scavenger HS-1 | 0.13 |
| Formalin scavenger HS-2 | 0.37 |
| Gelatin | 1.3 |
| Layer 14: The second protective layer Pro-2 | |
| Alkali soluble matting agent having an average particle size of 2 μm | 0.13 |
| Polymethyl methacrylate having an average particle size of 3 μm | 0.02 |
| Lubricant WAX-1 | 0.04 |
| Gelatin | 0.6 |

C-1

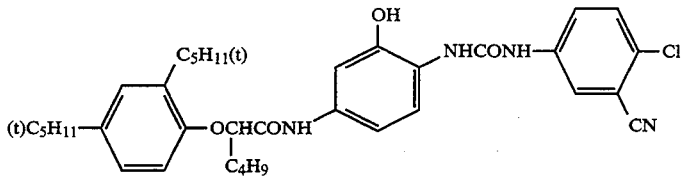

-continued
Sample 101 -for comparison-
C-2
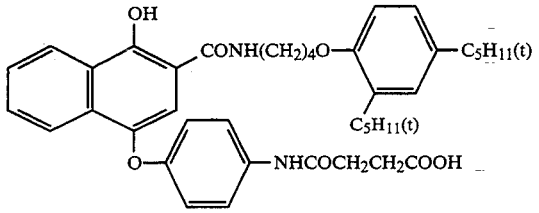
M-1
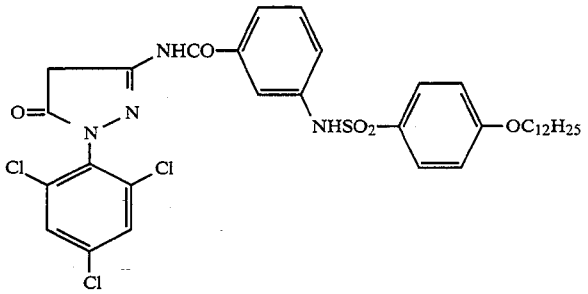
M-2
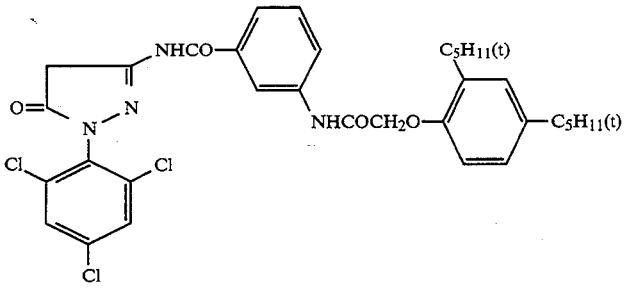
M-3
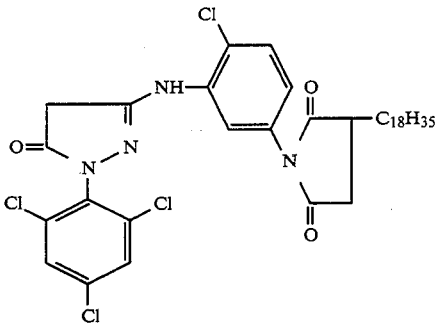
Y-1
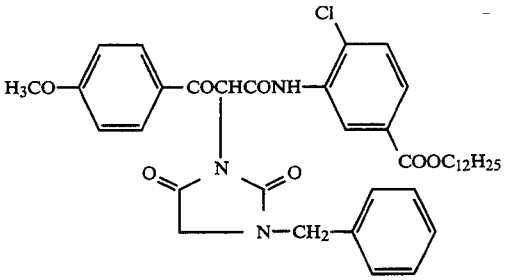

-continued
Sample 101 -for comparison-
Y-2
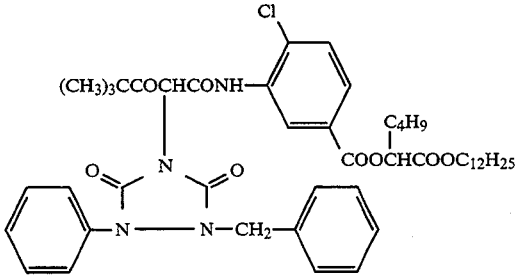
CC-1
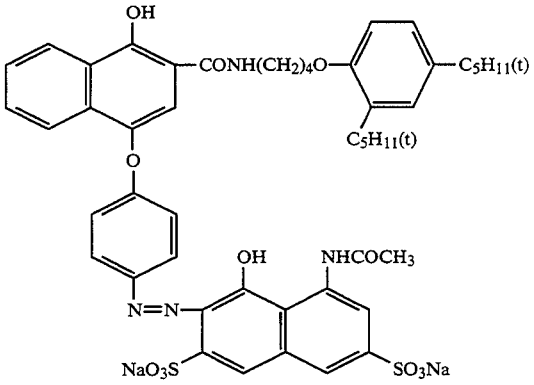
CM-1
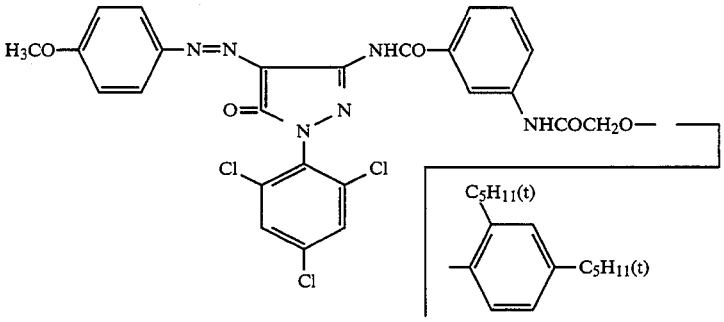
D-1
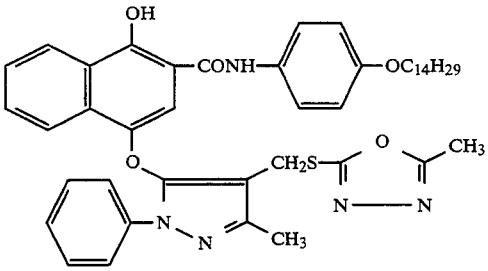
D-2
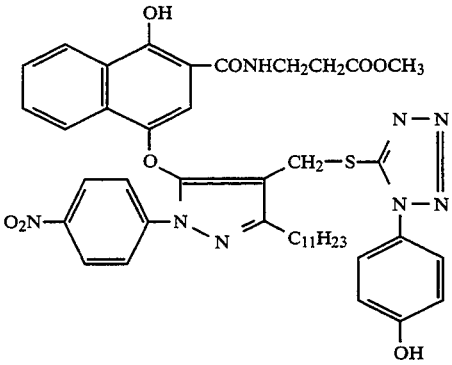

-continued
Sample 101 -for comparison-
D-3
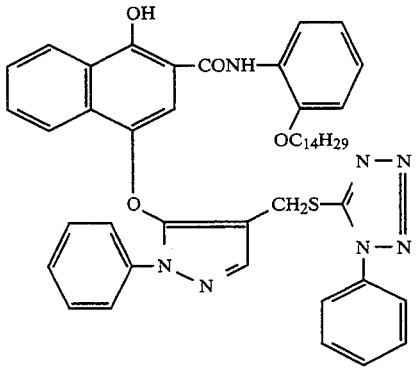
Oil-1
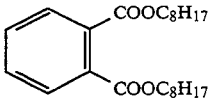
Oil-2
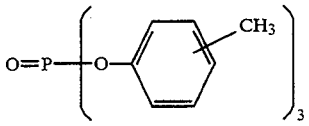
Oil-3
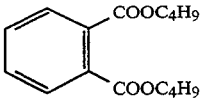
SC-1
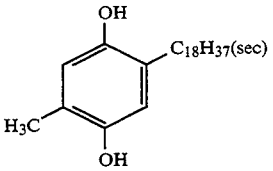
UV-1
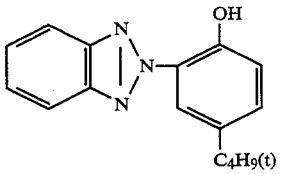
UV-2
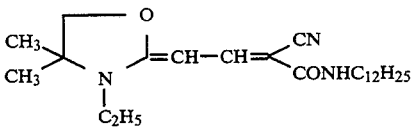
WAX-1
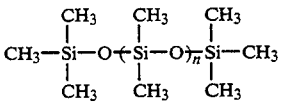
Weight average molecular weight Mw = 3,000
Su-1
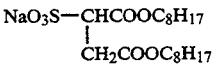

-continued
Sample 101 -for comparison-
Su-2
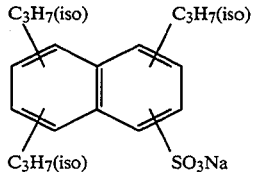
HS-1
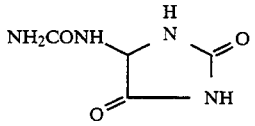
HS-2
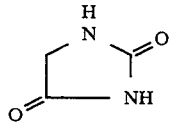
(SD-1)
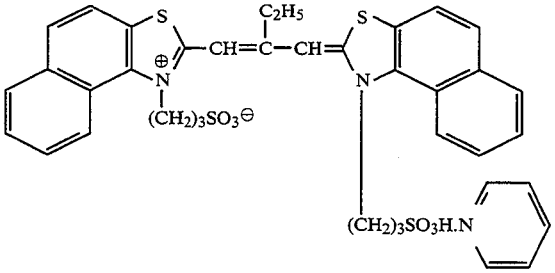
(SD-2)
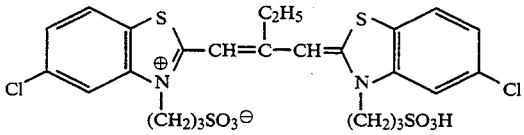
(SD-3)
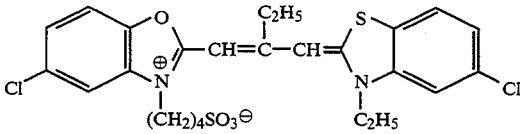
(SD-4)
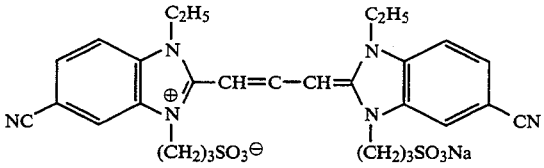
(SD-5)
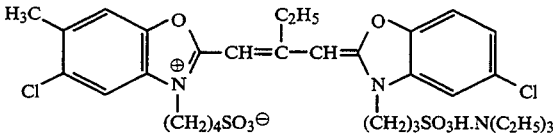
(SD-6)
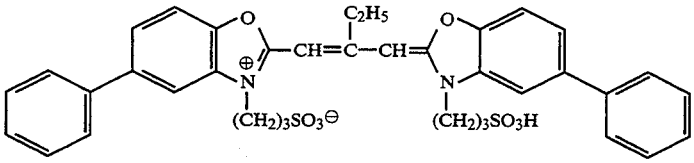

-continued

Sample 101 -for comparison- (SD-7)

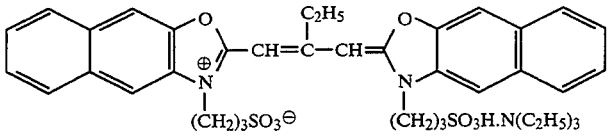

(SD-8)

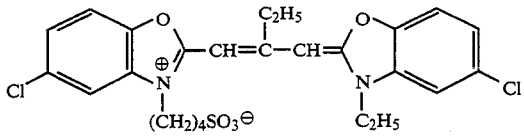

(SD-9)

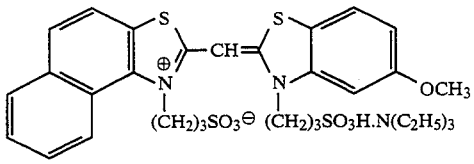

(SD-10)

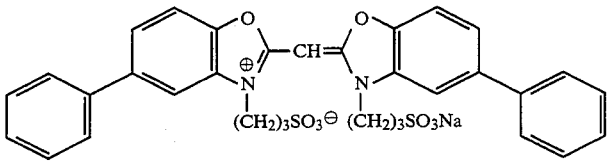

H-1

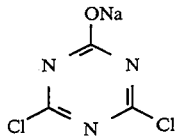

H-2 $(CH_2{=}CHSO_2CH_2)_2O$

ST-1

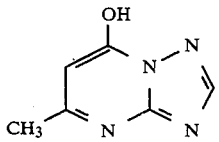

AF-1

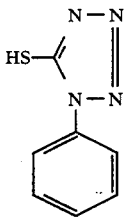

AF-2

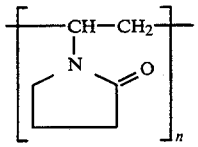

n: Polymerization degrees

Besides the above-given compositions, coating aid Su-1, dispersing aid Su-2, a viscosity controller, layer hardeners H-1 and H-2, stabilizer ST-1, antifoggant AF-1, and two kinds of AF-2s, namely, one having Mw: 10,000 and another having Mw: 1,100,000, were each added.

The average grain or particle sizes are each indicated by a grain or particle size converted into a cube. The emulsions were each subjected to the optimum gold.sulfur sensitization.

Sample 102 -for comparison-

| Layer 1: An antihalation layer HC-1 | |
|---|---|
| Black colloidal silver | 0.18 of Ag |
| Gelatin | 0.40 |

-continued

| Sample 102 -for comparison- | |
|---|---|
| Layer 2: An interlayer | |
| 2,5-di-t-pentadecyl hydroquinone | 0.18 |
| EX-1 | 0.07 |
| EX-3 | 0.02 |
| U-1 | 0.08 |
| U-2 | 0.08 |
| HBS-1 | 0.10 |
| HBS-2 | 0.02 |
| Gelatin | 1.04 |
| Layer 3: The first red sensitive emulsion layer | |
| Silver iodobromide emulsion having an average grain size of 0.70μ | 0.50 of Ag |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| Sensitizing dye IV | $4.0 \times 10^{-5}$ |
| EX-2 | 0.350 |
| HBS-1 | 0.005 |
| HBS-2 | 0.012 |
| Gelatin | 1.08 |
| Layer 4: The second red sensitive emulsion layer | |
| Silver iodobromide having an average grain size of 0.75μ | 1.08 of Ag |
| Sensitizing dye I | $5.1 \times 10^{-5}$ |
| Sensitizing dye II | $1.4 \times 10^{-5}$ |
| Sensitizing dye III | $2.3 \times 10^{-4}$ |
| Sensitizing dye IV | $3.0 \times 10^{-5}$ |
| EX-2 | 0.300 |
| EX-3 | 0.050 |
| EX-10 | 0.004 |
| HBS-2 | 0.050 |
| Gelatin | 1.17 |
| Layer 5: The third red sensitive emulsion layer | |
| Silver iodobromide emulsion having an average grain size of 1.00μ | 1.44 of Ag |
| Sensitizing dye IX | $5.4 \times 10^{-5}$ |
| Sensitizing dye II | $1.4 \times 10^{-5}$ |
| Sensitizing dye III | $2.4 \times 10^{-4}$ |
| Sensitizing dye IV | $3.1 \times 10^{-5}$ |
| EX-5 | 0.150 |
| EX-3 | 0.055 |
| EX-4 | 0.060 |
| EX-11 | 0.005 |
| HBS-1 | 0.32 |
| Gelatin | 1.47 |
| Layer 6: An interlayer | |
| HBS-2 | 0.01 |
| Gelatin | 1.06 |
| EX-12 | 0.02 |
| Layer 7: The first green sensitive emulsion layer | |
| Silver iodobromide emulsion having an average grain size of 0.65μ | 0.36 of Ag |
| Sensitizing dye X | $1.5 \times 10^{-5}$ |
| Sensitizing dye V | $3.0 \times 10^{-5}$ |
| Sensitizing dye VI | $1.0 \times 10^{-4}$ |
| Sensitizing dye VII | $3.8 \times 10^{-4}$ |
| R-4 | 0.017 |
| EX-6 | 0.260 |
| EX-1 | 0.021 |
| EX-7 | 0.030 |
| EX-8 | 0.025 |
| HBS-1 | 0.100 |
| HBS-4 | 0.060 |
| Gelatin | 0.68 |
| Layer 8: The second green sensitive emulsion layer | |
| Silver iodobromide emulsion having an average grain size of 0.70μ | 0.72 of Ag |
| Sensitizing dye X | $1.0 \times 10^{-5}$ |
| Sensitizing dye V | $2.1 \times 10^{-5}$ |

-continued

| Sample 102 -for comparison- | |
|---|---|
| Sensitizing dye VI | $7.0 \times 10^{-5}$ |
| Sensitizing dye VII | $2.6 \times 10^{-4}$ |
| R-4 | 0.019 |
| EX-6 | 0.150 |
| EX-8 | 0.010 |
| EX-1 | 0.008 |
| EX-7 | 0.012 |
| HBS-1 | 0.60 |
| HBS-4 | 0.050 |
| Gelatin | 0.99 |
| Layer 9: The third green sensitive emulsion layer | |
| Silver iodobromide emulsion having an average grain size of 1.0μ | 1.08 of Ag |
| Sensitizing dye X | $1.2 \times 10^{-5}$ |
| Sensitizing dye V | $3.5 \times 10^{-5}$ |
| Sensitizing dye VI | $8.0 \times 10^{-5}$ |
| Sensitizing dye VII | $3.0 \times 10^{-4}$ |
| EX-6 | 0.065 |
| EX-1 | 0.025 |
| HBS-2 | 0.55 |
| Gelatin | 1.57 |
| Layer 10: A yellow filter layer | |
| Yellow colloidal silver | 0.05 of Ag |
| EX-12 | 0.04 |
| HBS-1 | 0.02 |
| Gelatin | 0.95 |
| Layer 11: The first blue sensitive emulsion layer | |
| Silver iodobromide emulsion having an average grain size of 0.6μ | 0.22 of Ag |
| Sensitizing dye VIII | $3.5 \times 10^{-4}$ |
| EX-9 | 0.85 |
| EX-8 | 0.12 |
| EX-11 | 0.030 |
| HBS-1 | 0.28 |
| Gelatin | 1.15 |
| Layer 12: The second blue sensitive emulsion layer | |
| Silver iodobromide emulsion having an average grain size of 0.80μ | 0.41 of Ag |
| Sensitizing dye VIII | $2.1 \times 10^{-4}$ |
| EX-9 | 0.20 |
| EX-10 | 0.015 |
| HBS-1 | 0.03 |
| Gelatin | 0.41 |
| Layer 13: The third blue sensitive emulsion layer | |
| Silver iodobromide emulsion having an average grain size of 1.2μ | 0.69 of Ag |
| Sensitizing dye VIII | $2.2 \times 10^{-4}$ |
| EX-9 | 0.20 |
| HBS-1 | 0.07 |
| Gelatin | 0.62 |
| Layer 14: The first protective layer | |
| Silver iodobromide emulsion having an average grain size of 0.07μ | 0.07 of Ag |
| U-1 | 0.11 |
| U-2 | 0.17 |
| HBS-1 | 0.90 |
| Gelatin | 1.00 |
| Layer 15: The second protective layer | |
| Polymethyl acrylate particle having a particle size of about 1.5 | 0.54 |
| S-1 | 0.05 |
| S-2 | 0.05 |
| Gelatin | 0.72 |

Besides the above-given compositions, gelatin hardeners H-1 and H-2, antifoggants AF-1 and AF-2, and a surfactant were added into each of the layers.

The structures of the compounds used in the examples:

U-1
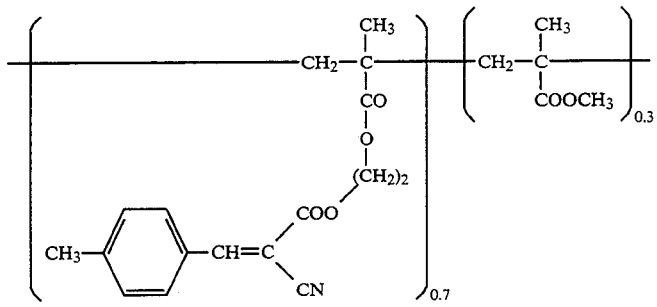
U-2
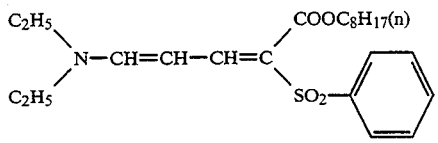
EX-1
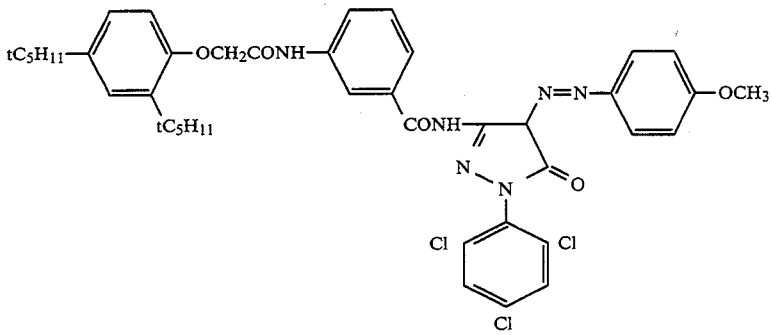
EX-2
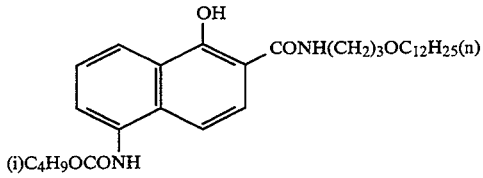
EX-3
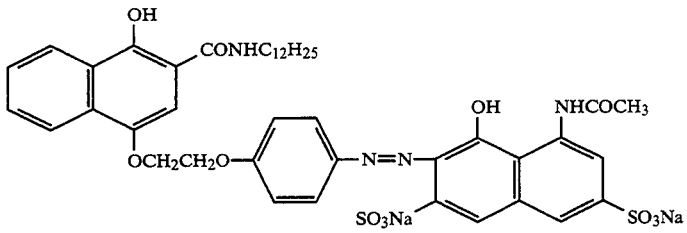
EX-4
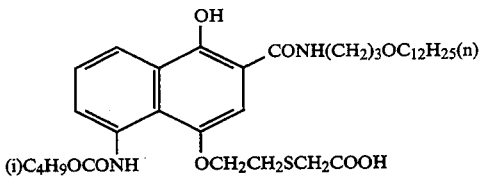
EX-5
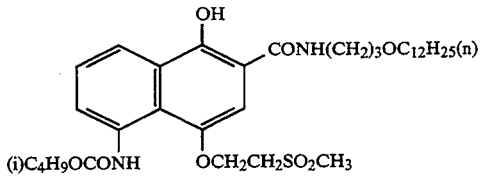

-continued
EX-6
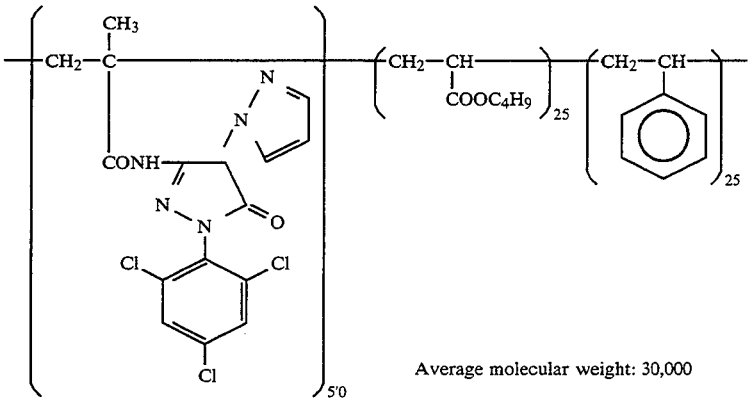
Average molecular weight: 30,000
EX-7
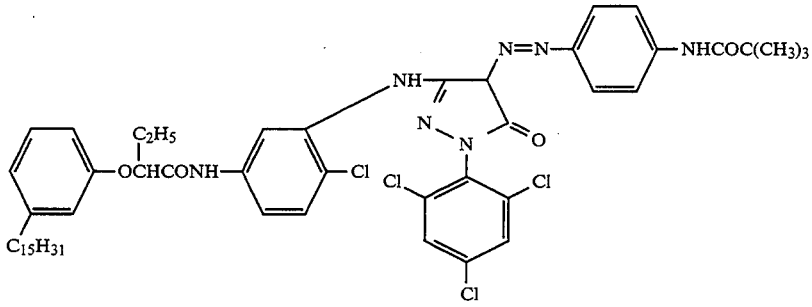
EX-8
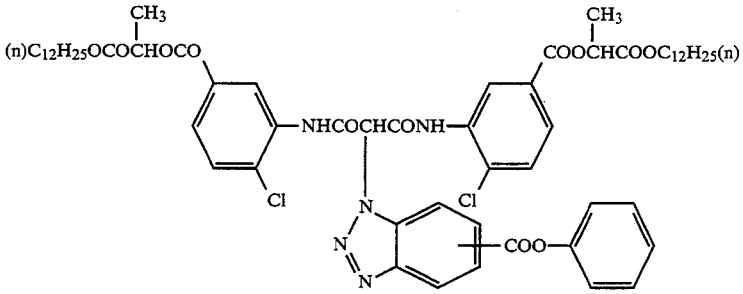
EX-9
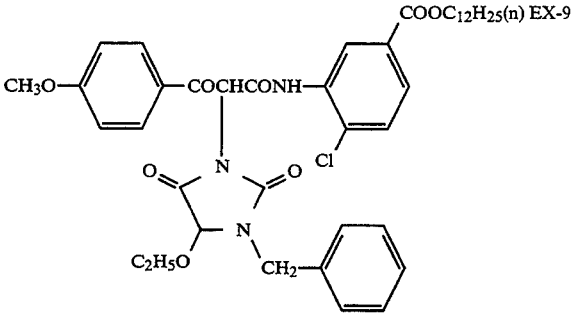
EX-10
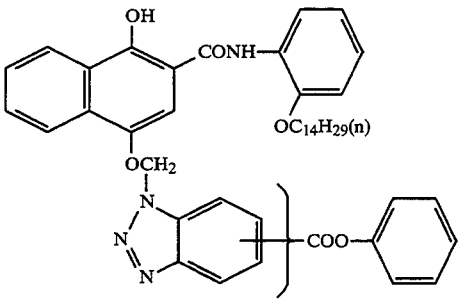

-continued
EX-11
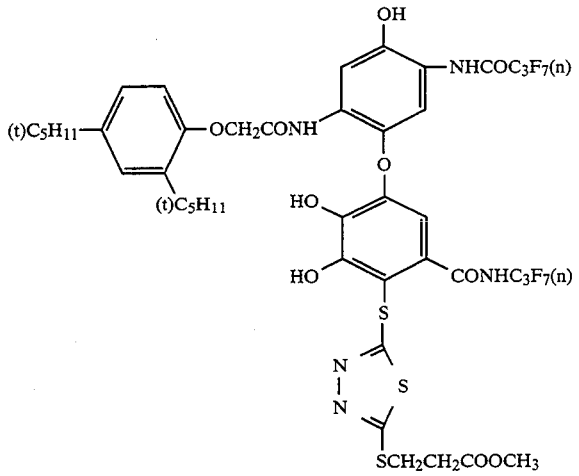
EX-12
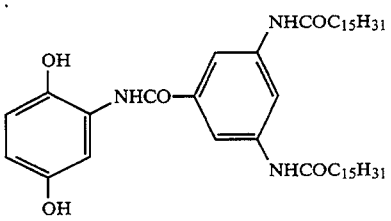
Tricresyl phosphate HBS-1
Dibutyl phthalate HBS-2
Bis(2-ethylhexyl)phthalate HBS-3
HBS-4
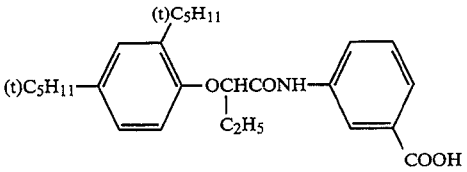
H-1
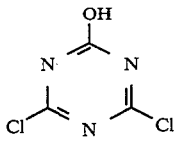
H-2
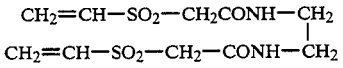
S-1
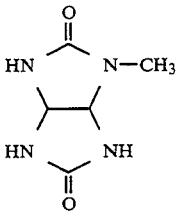
S-2
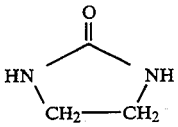
| Sensitizing dyes |
|---|
| I |
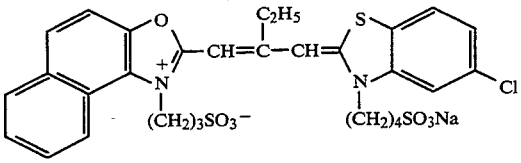

-continued
| Sensitizing dyes | |
|---|---|
| II | 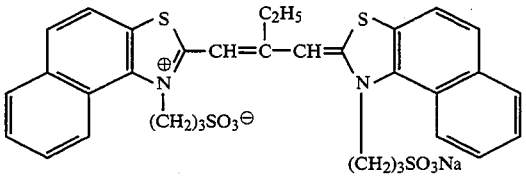 |
| III | 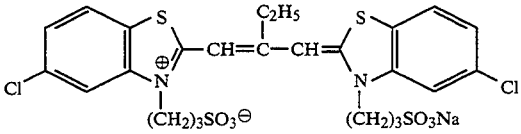 |
| IV | 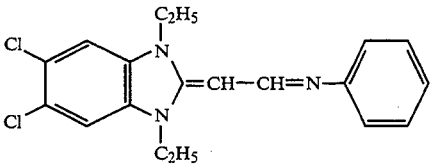 |
| V | 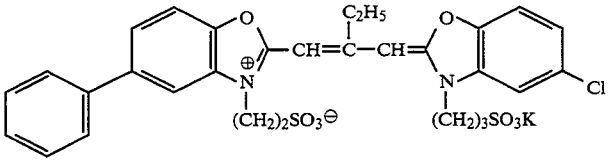 |
| VI | 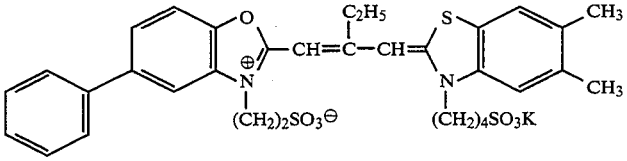 |
| VII | 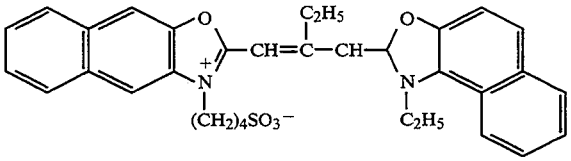 |
| VIII | 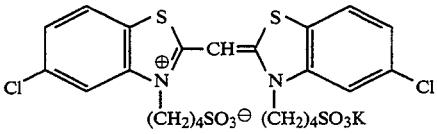 |
| IX | 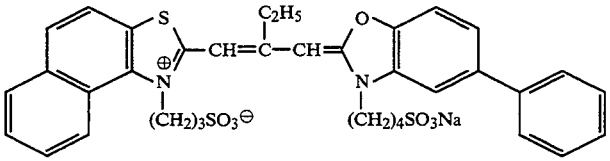 |
| X | 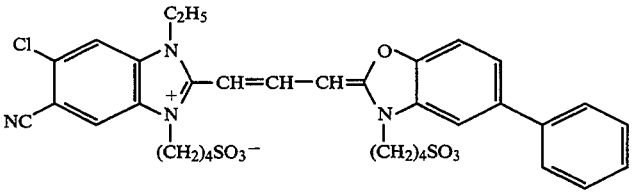 |

-continued

| Sensitizing dyes | |
|---|---|
| R-4 | (Compounds given in Japanese Patent O.P.I. Publication Nos. 57-154234/1982 and 58-162949/1983) |

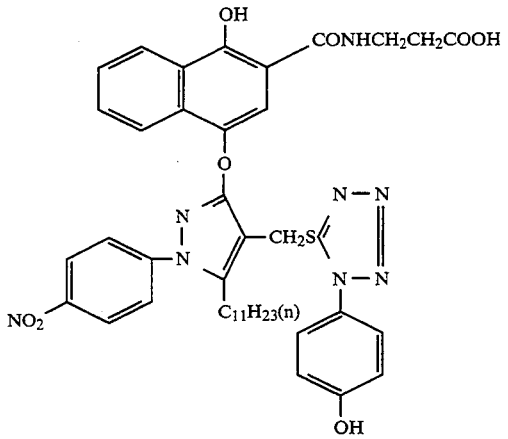

Further, samples 103 through 107 each having the layer arrangements given in Table 1 were prepared by making use of blue light sensitive layer units BU-1 through BU-4 in place of layers 11 and 12 in comparative sample 101 and green light sensitive layer units GU-1 and GU-2 in place of layers 7 through 9, respectively.

| Blue light sensitive layer unit 1 BU-1 | |
|---|---|
| Layer 11: A low speed blue sensitive emulsion layer BL | |
| Silver iodobromide emulsion having an average grain size of 0.4 μm<br>Silver iodobromide emulsion having an average grain size of 0.7 μm | 0.60 |
| Sensitizing dye SD-9 | $5.2 \times 10^{-4}$ mols/mol of Ag |
| Sensitizing dye SD-10 | $1.9 \times 10^{-5}$ mols/mol of Ag |
| Yellow coupler Y-1 | 0.46 |
| Yellow coupler Y-2 | 0.18 |
| DIR compound D-1 | 0.03 |
| High boiling solvent Oil-2 | 0.15 |
| Gelatin | 1.3 |
| Formalin scavenger HS-1 | 0.08 |
| Layer 12: A high speed blue sensitive emulsion layer BH | |
| Silver iodobromide emulsion having an average grain size of 1.0 μm | 1.2 |
| Sensitizing dye SD-9 | $1.8 \times 10^{-4}$ mols/mol of Ag |
| Sensitizing dye SD-10 | $7.9 \times 10^{-5}$ mols/mol of Ag |
| Yellow coupler Y-1 | 0.30 |
| Yellow coupler Y-2 | 0.10 |
| High boiling solvent Oil-2 | 0.14 |
| Gelatin | 1.30 |
| Formalin scavenger HS-1 | 0.05 |
| Formalin scavenger HS-2 | 0.12 |

| Blue light sensitive layer unit 2 BU-2 | |
|---|---|
| Layer 11: A low speed blue sensitive emulsion layer BL | |
| Silver iodobromide emulsion having an average grain size of 0.4 μm<br>Silver iodobromide emulsion having an average grain size of 0.7 μm | 0.5 |
| Sensitizing dye SD-9 | $5.2 \times 10^{-4}$ mols/mol of Ag |
| Sensitizing dye SD-10 | $1.9 \times 10^{-5}$ mols/mol of Ag |
| Yellow coupler Y-1 | 0.65 |
| Yellow coupler Y-2 | 0.24 |
| DIR compound D-1 | 0.03 |
| High boiling solvent Oil-2 | 0.18 |
| Gelatin | 1.3 |
| Formalin scavenger HS-1 | 0.08 |
| Layer 12: A high speed blue sensitive emulsion layer BH | |
| Silver iodobromide emulsion having an average grain size of 1.0 μm | 1.0 |
| Sensitizing dye SD-9 | $1.8 \times 10^{-4}$ mols/mol of Ag |
| Sensitizing dye SD-10 | $7.9 \times 10^{-5}$ mols/mol of Ag |
| Yellow coupler Y-1 | 0.15 |
| Yellow coupler Y-2 | 0.03 |
| High boiling solvent Oil-2 | 0.06 |
| Gelatin | 1.30 |
| Formalin scavenger HS-1 | 0.05 |
| Formalin scavenger HS-2 | 0.12 |

| Blue light sensitive layer unit 3 BU-3 | |
|---|---|
| Layer 11: A low speed blue sensitive emulsion layer BL | |
| Silver iodobromide emulsion having an average grain size of 0.4 μm<br>Silver iodobromide emulsion having an average grain size of 0.7 μm | 0.5 |
| Sensitizing dye SD-9 | $5.2 \times 10^{-4}$ mols/mol of Ag |
| Sensitizing dye SD-10 | $1.9 \times 10^{-5}$ mols/mol of Ag |
| Yellow coupler Y-1 | 0.62 |
| Yellow coupler Y-2 | 0.22 |
| DIR compound D-1 | 0.03 |
| High boiling solvent Oil-2 | 0.17 |
| Gelatin | 1.3 |
| Formalin scavenger HS-1 | 0.08 |
| Layer 12: A high speed blue sensitive emulsion layer BH | |
| Silver iodobromide emulsion having an average grain size of 0.86 μm | 1.0 |
| Sensitizing dye SD-9 | $1.8 \times 10^{-4}$ mols/mol of Ag |
| Sensitizing dye SD-10 | $7.9 \times 10^{-5}$ mols/mol of Ag |
| Yellow coupler Y-1 | 0.15 |
| Yellow coupler Y-2 | 0.05 |

| Blue light sensitive layer unit 4 BU-4 |
|---|

-continued

| | |
|---|---|
| Layer 11: A low speed blue sensitive emulsion layer BL | |
| Silver iodobromide emulsion having an average grain size of 0.4 μm | 0.3 |
| Sensitizing dye SD-9 | $6.5 \times 10^{-4}$ mols/mol of Ag |
| Sensitizing dye SD-10 | $2.4 \times 10^{-5}$ mols/mol of Ag |
| Yellow coupler Y-1 | 0.45 |
| Yellow coupler Y-2 | 0.17 |
| DIR compound D-1 | 0.03 |
| High boiling solvent Oil-2 | 0.13 |
| Gelatin | 1.0 |
| Formalin scavenger HS-1 | 0.06 |

The following medium speed blue sensitive emulsion layer was interposed between Layers 11 and 12.

| | |
|---|---|
| Layer 11b: A medium speed blue sensitive emulsion layer BM | |
| Silver iodobromide emulsion having an average grain size of 0.7 μm | 0.25 |
| Sensitizing dye SD-9 | $3.9 \times 10^{-4}$ mols/mol of Ag |
| Sensitizing dye SD-10 | $1.4 \times 10^{-5}$ mols/mol of Ag |
| Yellow coupler Y-1 | 0.16 |
| Yellow coupler Y-2 | 0.07 |
| High boiling solvent Oil-2 | 0.08 |
| Gelatin | 0.4 |
| Formalin scavenger HS-1 | 0.02 |
| Layer 12: A high speed blue sensitive emulsion layer BH | |
| Silver iodobromide emulsion having an average grain size of 1.0 μm | 0.9 |
| Sensitizing dye SD-9 | $1.8 \times 10^{-4}$ mols/mol of Ag |
| Sensitizing dye SD-10 | $7.9 \times 10^{-5}$ mols/mol of Ag |
| Yellow coupler Y-1 | 0.15 |
| Yellow coupler Y-2 | 0.05 |
| High boiling solvent Oil-2 | 0.074 |
| Gelatin | 1.30 |
| Formalin scavenger HS-1 | 0.05 |
| Formalin scavenger HS-2 | 0.12 |

Green light sensitive layer unit 1 GU-1

| | |
|---|---|
| Layer 7: A low speed blue sensitive emulsion layer GL | |
| Silver iodobromide emulsion having an average grain size of 0.4 μm | 1.1 |
| Sensitizing dye SD-4 | $6.8 \times 10^{-5}$ mols/mol of Ag |
| Sensitizing dye SD-5 | $6.2 \times 10^{-4}$ mols/mol of Ag |
| Magena coupler M-1 | 0.54 |
| Magenta coupler M-2 | 0.19 |
| Colored magenta coupler CM-1 | 0.06 |
| DIR compound D-2 | 0.017 |
| DIR compound D-3 | 0.01 |
| High boiling solvent Oil-2 | 0.81 |
| Gelatin | 1.8 |
| Layer 8: A medium speed green sensitive emulsion layer GM | |
| Silver iodobromide emulsion having an average grain size of 0.7 μm | 0.7 |

-continued

| | |
|---|---|
| Sensitizing dye SD-6 | $1.9 \times 10^{-4}$ mols/mol of Ag |
| Sensitizing dye SD-7 | $1.2 \times 10^{-4}$ mols/mol of Ag |
| Sensitizing dye SD-8 | $1.5 \times 10^{-5}$ mols/mol of Ag |
| Magenta coupler M-1 | 0.07 |
| Magenta coupler M-2 | 0.03 |
| Colored magenta coupler CM-1 | 0.04 |
| DIR compound D-2 | 0.018 |
| High boiling solvent Oil-2 | 0.30 |
| Gelatin | 0.8 |
| Layer 9: A high speed green sensitive emulsion layer GH | |
| Silver iodobromide emulsion having an average grain size of 1.0 μm | 1.7 |
| Sensitizing dye SD-6 | $1.2 \times 10^{-4}$ mols/mol of Ag |
| Sensitizing dye SD-7 | $1.0 \times 10^{-4}$ mols/mol of Ag |
| Sensitizing dye SD-8 | $3.4 \times 10^{-6}$ mols/mol of Ag |
| Magenta coupler M-1 | 0.09 |
| Magenta coupler M-3 | 0.04 |
| Colored magenta coupler CM-1 | 0.04 |
| High boiling solvent Oil-2 | 0.31 |
| Gelatin | 1.2 |

Green light sensitive layer unit 2 GU-2

| | |
|---|---|
| Layer 7 and 8: The same as in GU-1 | |
| Layer 9: A high speed green sensitive emulsion layer GH | |
| Silver iodobromide emulsion having an average grain size of 0.86 μm | 1.7 |
| Sensitizing dye SD-6 | $1.2 \times 10^{-4}$ mols/mol of Ag |
| Sensitizing dye SD-7 | $1.0 \times 10^{-4}$ mols/mol of Ag |
| Sensitizing dye SD-8 | $3.4 \times 10^{-6}$ mols/mol of Ag |
| Magenta coupler M-1 | 0.07 |
| Magenta coupler M-3 | 0.03 |
| Colored magenta coupler CM-1 | 0.04 |
| High boiling solvent Oil-2 | 0.28 |
| Gelatin | 1.2 |

TABLE 1

| Sample No. | Remarks | Green light sensitive layer unit | Blue light sensitive layer unit |
|---|---|---|---|
| 103 | Comparison | Same as Sample 101 | BU-1 |
| 104 | Invention | " | BU-2 |
| 105 | " | " | BU-3 |
| 106 | " | " | BU-4 |
| 107 | " | GU-1 | BU-3 |
| 108 | " | GU-2 | BU-3 |

The resulting comparative samples 101 through 103 and the inventive samples 104 through 108 were each exposed to light, developed, and then measured in the foregoing RMS measurement method. The results of the measurements are shown in Table-2 in terms that the RMS values of the minimum densities of both of the green and blue light sensitive layer units of Sample 101 are each regarded as the relative values of 100, respectively.

TABLE 2

| Sample | | Green light sensitive layer unit | | | | | Blue light sensitive layer unit | | | | | |
|---|---|---|---|---|---|---|---|---|---|---|---|---|
| | | Relative RMS value | | | $RMS_1/$ | $RMS_2/$ | Relative RMS value | | | $RMS_1/$ | $RMS_2/$ | ISO |
| No. | Remarks | $G_0$* | $G_1$ | $G_2$ | $RMS_0$ | $RMS_0$ | $B_0$ | $B_1$ | $B_2$ | $RMS_0$ | $RMS_0$ | speed |
| 101 | Comparison | 100 | 155 | 145 | 1.55 | 1.45 | 100 | 165 | 160 | 1.65 | 1.60 | 380 |
| 102 | Comparison | 95 | 125 | 120 | 1.31 | 1.26 | 120 | 180 | 170 | 1.50 | 1.42 | 380 |
| 103 | Comparison | 100 | 150 | 145 | 1.50 | 1.45 | 125 | 180 | 195 | 1.44 | 1.56 | 420 |

TABLE 2-continued

| Sample No. | Remarks | Green light sensitive layer unit Relative RMS value $G_0$* | $G_1$ | $G_2$ | $RMS_1/RMS_0$ | $RMS_2/RMS_0$ | Blue light sensitive layer unit Relative RMS value $B_0$ | $B_1$ | $B_2$ | $RMS_1/RMS_0$ | $RMS_2/RMS_0$ | ISO speed |
|---|---|---|---|---|---|---|---|---|---|---|---|---|
| 104 | Invention | 100 | 150 | 145 | 1.50 | 1.45 | 95 | 130 | 110 | 1.37 | 1.16 | 400 |
| 105 | Invention | 100 | 155 | 140 | 1.55 | 1.40 | 95 | 115 | 95 | 1.21 | 1.00 | 380 |
| 106 | Invention | 95 | 140 | 140 | 1.47 | 1.47 | 100 | 125 | 105 | 1.25 | 1.05 | 400 |
| 107 | Invention | 105 | 145 | 120 | 1.38 | 1.14 | 100 | 120 | 105 | 1.20 | 1.05 | 420 |
| 108 | Invention | 95 | 125 | 105 | 1.32 | 1.11 | 95 | 110 | 95 | 1.16 | 1.00 | 380 |

*$G_0$; Relative RMS value at a minimum green density
$G_1$; Relative RMS value at a minimum green density + 0.15
$G_2$; Relative RMS value obtained in an exposure quantity of logH + 0.5 in which logH is an exposure quantity at the point of measurement of $G_1$ Next, the resulting samples 101 through 108 were each cut into 35 mm size. The 35 mm sized sample pieces were each put into normal type metal-made cartridges and were then loaded, respectively, in a camera, Model Konica FT-1 Motor with Hexanon AR F/1,8 85 mm lens, manufactured by Konica Corp. which was set at ISO speed of 400. With the sample-loaded camera, a standard neutral grey reflector board having a reflectance of 18% was exposed, in an automatic TTL light metering system, to a blue lamp light source having a color temperature of 5,800 K —that was a daylight type tungsten lamp—, so that each of the reflector board in full size was photographed. Then, the similar photographs were taken by replacing the light source by a tungsten lamp having a color temperature of 3,100 K.

The photographing was made in twice each by making use of the respective light sources; the photographing was made for measuring the ISO speed of each of the samples in the same development process —hereinafter referred to as Process A— for one, and that was made in the following development process—hereinafter referred to as Process B— for another.

Process B

In this process, a series of running treatments was continued until a replenisher was put in an amount three times as much as the capacity of a stabilizer tank.

| Processing step | Processing time | Processing temperature | Replenishing quantity |
|---|---|---|---|
| Color developing | 3 min. 15 sec. | 38° C. | 540 ml |
| Bleaching | 45 sec. | 38° C. | 155 ml |
| Fixing | 1 min. 45 sec. | 38° C. | 500 ml |
| Stabilizing | 90 sec. | 38° C. | 775 ml |
| Drying | 1 min. | 40 to 70° C. | — |

Note:
Replenishing quantities indicated above are in terms of $m^2$ of the light sensitive material processed.

The stabilizing step was carried out in a three-tank counter current system, in which the replenisher was put into the final stabilizer tank and the over flow was flowed in the tank precedent to the final stabilizer tank.

Further, a part of the over flow —in an amount of 275 ml/$m^2$— was flowed from the stabilizer tank following the fixer tanl to the stabilizer tank.

The composition of the color developer used therein was as follows:

| | |
|---|---|
| Potassium carbonate | 30 g |
| Sodium hydrogencarbonate | 2.7 g |
| Potassium sulfite | 2.8 g |
| Sodium bromide | 1.3 g |
| Hydroxylamine sulfate | 3.2 g |
| Sodium chloride | 0.6 g |

-continued

| | |
|---|---|
| 4-amino-3-methyl-N-ethyl-N-(β-hydroxylethyl) aniline sulfate | 4.6 g |
| Diethylenetriamine pentaacetate | 3.0 g |
| Potassium hydroxide | 1.3 g |
| Add water to make | 1 liter |
| Adjust pH with potassium hydroxide or a 20% sulfuric acid solution to be | pH = 10.01 |

The composition of the color developer replenisher used therein was as follows:

| | |
|---|---|
| Potassium carbonate | 40 g |
| Sodium hydrogencarbonate | 3 g |
| Potassium sulfite | 7 g |
| Sodium bromide | 0.5 g |
| Hydroxylamine sulfate | 3.2 g |
| 4-amino-3-methyl-N-ethyl-N-(β-hydroxylethyl) aniline sulfate | 6.0 g |
| Diethylenetriamine pentaacetate | 3.0 g |
| Potassium hydroxide | 2 g |
| Add water to make | 1 liter |
| Adjust pH with potassium hydroxide or a 20% sulfuric acid solution to be | pH = 10.12 |

The composition of the bleacher used therein was as follows:

| | |
|---|---|
| Ferric ammonium 1,3-diaminopropane-tetraacetate | 0.35 mols |
| Disodium ethylenediaminetetraacetate | 2 g |
| Ammonium bromide | 150 g |
| Glacial acetic acid | 40 ml |
| Ammonium nitrate | 40 g |
| Add water to make | 1 liter |
| Adjust pH with aqueous ammonia or glacial acetic acid to be | pH = 4.5 |

The composition of the bleacher replenisher used therein was as follows:

| | |
|---|---|
| Ferric ammonium 1,3-diaminopropane tetraacetate | 0.40 mols |
| Disodium ethylenediaminetetraacetate | 2 g |
| Ammonium bromide | 170 g |
| Ammonium nitrate | 50 g |
| Glacial acetic acid | 61 ml |
| Add water to make | 1 liter |
| Adjust pH with aqueous ammonia or glacial acetic acid to be | pH = 3.5 |

An adjustment was so suitably made as to keep the pH value of the bleacher tank solution.

The compositions of the fixer and the fixer replenisher each used therein were as follows:

| | |
|---|---|
| Ammonium thiosulfate | 100 g |
| Ammonium thiocyanate | 150 g |
| Sodium bisulfite anhydride | 20 g |
| Sodium metabisulfite | 4.0 g |
| Disodium ethylenediaminetetraacetate | 1.0 g |
| Add water to make | 1 liter |
| Adjust pH with glacial acetic acid or aqueous ammonia to be | pH = 6.5 |

The compositions of the stabilizer and the stabilizer replenisher each used therein were as follows:

| | |
|---|---|
| 1,2-benzisothiazoline-3 one | 0.1 g |
| 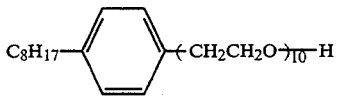 in a 50% solution | 0.2 ml |
| Hexamethylenetetramine | 0.2 g |
| Hexahydro-1,3,5-tris-(2-hydroxyethyl)-5-triazine | 0.3 g |
| Add water to make | 1 liter |
| Adjust pH with potassium hydroxide or a 50% sulfuric acid solution to be | pH = 7.0 |

Among the photographed negatives processed in process A, sample 101 photographically exposed to the light source having a color temperature of 5,800 K was so printed as to have a neutral grey having a reflectance of 18% on a sheet of Konica Color Paper at a 10×magnification —a 10×line magnification—. The remaining samples were so printed as to have a neutral grey having a reflectance of 18% and the magnification ratios thereof were so obtained as to have a similar graininess to that of the above-mentioned 10×magnified print Also, in process B, the magnification ratios of the samples were so obtained as to have a similar graininess to that of the 10×magnified print of sample 101 exposed to the light source having a color temperature of 5,800 K and processed in process B.

The results thereof are shown in Table-3 given below.

TABLE 3

| Sample No. | Remarks | Magnification ratios Process A 5800 K | Process A 3100 K | Process B 5800 K | Process B 3100 K |
|---|---|---|---|---|---|
| 101 | Comparison | 10x | 7.5 | 10x | 7.5 |
| | | Standard | | Standard | |
| 102 | " | 10 | 8.0 | 10 | 8.5 |
| 103 | " | 8.5 | 6.5 | 9 | 7.5 |
| 104 | Invention | 10 | 9.0 | 10 | 9.0 |
| 105 | " | 10 | 9.5 | 10 | 9.5 |
| 106 | " | 10.5 | 9.5 | 11 | 10.5 |
| 107 | " | 10.5 | 10.0 | 10.5 | 10.0 |
| 108 | " | 10.5 | 10.5 | 11.5 | 11.5 |

In Table-3, it means that the greater the magnification ratios are, the more the graininess of the samples are excellent. Even in any conditions remarkably different between the color temperatures such as 5,800 K and 3,100 K, it is found that the invention can provide the equivalently excellent graininess. In the cases of samples 101 through 103, on the other hand, it was confirmed that the graininess of the samples were seriously deteriorated when photographing at a color temperature of 3,100 K.

Further, in any one of processes A and B different from each other, it was confirmed that the similar results were obtained and the invention did not affect almost any processing conditions.

Example 2

Using a Konica camera, Model FT-1 Motor with Hexanon AR 50 mm f1.4 lens, in which samples 101 through 108 packed in cartridges were loaded, respectively, a night scene was photographed at an aperture of F5.6 for an exposure time of 30 seconds. After that, the samples were developed in process A of Example 1 and were each printed on Konica Color Paper in size of 203×254 mm, —8"×10"—, so as to have the color tone and color density each similar to each other prints and, then, the resulting prints thereof were observed and evaluated with the eye. The subjects of the evaluation were the portion of the road —having a color reflectance density of about 0.5— irradiated by a mercury lamp, and the portions from the skyline and the night sky —having a color reflectance density of about 0.4—. The resulting graininess were evaluated by the following three grades; the excellent graininess is marked by A, the slightly conspicuous graininess, by B, and the considerably conspicuous graininess, by C, respectively. The results thereof are shown in Table-4 given below.

TABLE 4

| Sample No. | Remarks | Road irradiated by a mercury lamp | Skyline to night sky |
|---|---|---|---|
| 101 | Comparison | C | C |
| 102 | " | C | B |
| 103 | " | C | C |
| 104 | Invention | B | B |
| 105 | " | B | A |
| 106 | " | B | A |
| 107 | " | B | A |
| 108 | " | A | A |

As is obvious from Table-4, even in the photographing conditions such as a night scene where a peculiar artificial light source is be used, it was confirmed that the invention can display the graininess improvement effects.

Even when photographing under a variety of light sources each having different color temperatures, other than the light sources having a daylight color, the invention can provide, as described above, a silver halide color negative photographic light sensitive material improved in graininess so that an excellent image quality can be obtained as same as in daylight photography.

Example 3

In the following examples 3-1 through 3-6, the emulsions applicable to the invention were each prepared.

Example 3-1

In this example, the following seed emulsions N-1 and N-2 were prepared.

<Preparation of seed emulsion N-1>

Following the procedures described in Japanese Patent O.P.I. Publication No. 50-45437/1975, 250 ml of an aqueous solution of 4M (in which M represents a mol concentration)—$AgNO_3$ and 250 ml of an aqueous solution of a mixture of 4M-KBr and KI [in which the total contents of KBr and KI were 4 mols in a concentration ratio of 98:2 (in terms of a mol concentration)], were added into 500 ml of an aqueous 2.0% gelatin solution which was heated up to a temperature of 40° C., in a controlled double jet method by taking a period of 35 minutes with controlling the pAg at 9.0 and pH at 2.0. After the pH of the resulting aqueous gelatin solution containing all the amount of silver halide grains added was adjusted with an aqueous potassium carbonate solution to have a pH value of 5.5, 364 ml of an aqueous 5 wt % solution of Demol N manufactured by Kao-Atlas Corp. as a precipitant, and 244 ml of an aqueous 20 wt % magnesium sulfate solution as polyvalent ions were so added as to be coagulated and then precipitated by allowing to stand. After the resulting supernatant was decanted, 1,400 ml of distilled water were added and the mixture was dispersed again. Further, 36.4 ml of an aqueous 20 wt % magnesium sulfate solution were so added as to be coagulated and then the resulting precipitated supernatant was decanted. An aqueous solution containing 28 g of osseous gelatin was so added as to make the total amount to be 425 ml. After then, the resulting solution was dispersed at a temperature of 40° C. by taking a period of 40 minutes, so that a silver halide seed emulsion was prepared.

After an electron microscopic observation of the resulting seed emulsion, it was proved to be a monodisperse type emulsion having an average grain size of 0.116 μm.

<Preparation of seed emulsion N-2>

In the same procedures of preparing seed emulsion N-1, silver iodobromide seed emulsion N-2 was prepared to have an average grain size of 0.33 μm and a silver iodide content of 2 mol %.

Example 3-2

The finely grained silver iodide emulsion applicable to the following examples was prepared in the manner described below.

An aqueous solution containing 5 wt % of osseous gelatin was put in a reaction chamber, and one mol each of an aqueous 3.5N silver nitrate solution and an aqueous 3.5N potassium iodide solution were then added by taking a period of 30 minuted with stirring at a temperature of 40° C.

The pAg thereof in the course of the addition of the above-mentioned solutions was kept at 13.5 by making use of an ordinary type of pAg controlling means. The resulting silver iodide was a mixture of β-AgI and γ-AgI having an average grain size of 0.06 μm.

Example 3-3

Emulsion Em-1 was prepared by making use of the following 5 kinds of solutions.

| | |
|---|---|
| <Solution 1> | |
| Gelatin | 236.5 g |
| A 28% aqueous ammonia | 1,056 ml |
| A 56% acetic acid solution | 1,590 ml |
| A 10% ethanol solution containing sodium polyisopyrene-polyethyleneoxy-disuccinate | 30 ml |
| Add distilled water to make | 10,385 ml |
| <Solution 2> | |
| $AgNO_3$ | 1,631 g |
| A 28% aqueous ammonia | 1,331 ml |
| Add distilled water to make | 2,743 ml |
| <Solution 3> | |
| KBr | 1,572 g |
| Add distilled water to make | 3,774 ml |
| <Solution 4> | |
| Finely grained silver iodide emulsion [1,507 ml/mol of AgI] | 1,305 ml |
| 4-hydroxy-6-methyl-1,3,3a,7-tetrazaindene | 5.16 g |
| An aqueous 10% potassium hydroxide solution | 14.63 ml |
| Add distilled water to make | 1,409 ml |
| <Solution 5> | |
| Seed emulsion N-1 | 0.129 mols |
| Sodium citrate | 1.39 g |
| Add distilled water to make | 1,520 ml |

Solution 5 was added, as the seed grains, into Solution 1 at a temperature of 40° C. by making use of the stirrer indicated in Japanese Patent Examined Publication Nos. 58-58288/1983 and 58-58289/1983, and the pH and pAg thereof were adjusted with acetic acid and an aqueous KBr solution. After then, Solutions 2, 3 and 4 were each added in a double jet precipitation method at the flow rates indicated in Tables 6 through 8 while controlling the pH and pAg shown in Table-5. Next, a phenylcarbamyl gelatin solution was added into the resulting mixture solution and the pH thereof was controlled with acetic acid and an aqueous potassium hydroxide solution, so that the salts were removed therefrom. The desalted emulsion was dispersed at a temperature of 50° C. and the pH and pAg were adjusted to be 8.1 and 5.80, respectively, so that the resulting emulsion was so finished as to have the solution amount of the emulsion of 4,500 ml and the weight of 6,240 g.

When making an electron microscopic observation, the resulting emulsion was proved to be comprised of octahedral monodisperse type grains having an average grain size of 0.47 μm. According to the results obtained by an X ray diffractometry, the resulting emulsion was an emulsion having an average silver iodide content of 8.2 mol %, 9.1% of relative standard deviation thereof and comprising the cores having a silver iodide content of 35 mol %.

TABLE 5

| Grain growth conditions | | | | | |
|---|---|---|---|---|---|
| Ag (%) | 0 | | 29 | 29* | 100 |
| pH | 7.0 | → | 7.0 | 6.0 | → 6.0 |
| pAg | 7.8 | → | 7.8 | 9.7 | Non-controlled |

In the above Table-5, The term, 'Ag(%)' means a ratio of an amount of silver used in the course of growing grains to an amount of silver necessary to grow the seed grains.

The symbol, →, means that a pH or a pAg is to be kept constant.

TABLE 6

| Time (min) | Flow rate (ml/min) |
|---|---|
| 0.00 | 9.76 |
| 1.11 | 10.62 |
| 2.48 | 11.45 |
| 6.17 | 12.41 |
| 11.29 | 12.83 |
| 20.20 | 12.76 |
| 23.22 | 8.24 |
| 38.25 | 11.52 |
| 51.24 | 20.45 |
| 54.56 | 22.08 |
| 55.05 | 22.08 |
| 55.06 | 44.88 |
| 57.06 | 58.11 |
| 57.11 | 63.60 |
| 58.15 | 78.05 |
| 63.46 | 151.48 |

TABLE 6-continued

| Time (min) | Flow rate (ml/min) |
|---|---|
| 69.17 | 202.57 |
| 70.19 | 202.57 |

TABLE 7

| Time (min) | Flow rate (ml/min) |
|---|---|
| 0.00 | 9.28 |
| 1.11 | 10.08 |
| 4.50 | 11.52 |
| 8.12 | 12.02 |
| 22.41 | 12.07 |
| 23.22 | 7.43 |
| 40.04 | 10.73 |
| 51.24 | 19.45 |
| 54.56 | 21.02 |
| 55.05 | 21.02 |
| 55.06 | 47.91 |
| 57.06 | 62.10 |
| 57.11 | 67.15 |
| 58.36 | 89.72 |
| 59.20 | 112.18 |
| 69.17 | 213.81 |
| 70.19 | 213.81 |

TABLE 8

| Time (min) | Flow rate (ml/min) |
|---|---|
| 0.00 | 0.00 |
| 23.21 | 0.00 |
| 23.22 | 72.07 |
| 31.31 | 87.02 |
| 31.54 | 30.72 |
| 35.16 | 33.02 |
| 35.37 | 9.51 |
| 51.12 | 12.85 |
| 54.56 | 13.96 |
| 55.05 | 13.96 |
| 55.06 | 28.38 |
| 57.06 | 37.02 |
| 57.11 | 11.24 |
| 59.03 | 17.01 |
| 63.51 | 26.82 |
| 69.25 | 35.91 |
| 69.26 | 0.00 |
| 70.19 | 0.00 |

Example 3-4

Emulsion Em-2 was prepared by making use of the following kinds of solutions:

| | |
|---|---|
| <Solution A> | |
| Ossein gelatin | 214 g |
| Distilled water | 7,070 ml |
| $NH_4OH$ | 13.6 mols |
| Seed emulsion* | 0.717 mols |
| Add distilled water to make | 11,300 ml |
| <Solution B> | |
| An aqueous 3.5N ammoniacal silver nitrate solution having a pH lowered to be pH = 9 with nitric acid after producing ammoniacal silver nitrate | 2,669 ml |
| <Solution C> | |
| An aqueous 3.5 N KBr solution | 3,774 ml |
| <Solution D> | |
| A finely grained silver iodide emulsion Refer to the foregoing Example-2 | 1.0 mol |
| 4-hydroxy-6-methyl-1,3,3a,7-tetrazaindene | 4.8 g |
| Add distilled water to make | 1,260 ml |
| <Solution E> | |

-continued

| | |
|---|---|
| An aqueous 1.75N KBr solution | An amount required |
| <Solution F> | |
| An aqueous 56 wt % acetic acid solution | An amount required |

*Seed emulsion was a silver iodobromide emulsion uniformly containing 2 mol % of silver iodide in the grains thereof and having an average grain size of 0.33 μm -in terms of one side length of each of the grains converted into the cubes having the same volume- Solutions B, C and D were added into Solution A, at a temperature of 60° C., by taking a period of 114 minutes, in a double jet precipitation method, and by making use of the stirrer indicated in Japanese Patent Examined Publication Nos. 58-058288/1983 and 58-058289/1983, so that the resulting seed crystal were grown up to the size of 0.81 μm. At that time, Solutions B and C were added at the suitable adding rates which were varied time-functionwise so as to meet the critical growth rate and not to produce any small sized grains other than the growing seed crystals and any polydispersion caused by an Ostwald ripening. Then, the supplying rate of Solution D, that was a finely grained silver iodide emulsion, to the aqueous ammoniacal silver nitrate solution was varied according to the growing rate of the grain size —or, the adding period—, as shown in Table-9, so that a core/shell type grains each having a multilayered structure could be prepared.

The pAg and pH values in the course of growing crystals were controlled by making use of Solutions E and F as shown in Table-5. The pAg and pH values were measured by making use of a silver sulfide electrode and a glass electrode, in an ordinary method.

Next, after the emulsion was desalted in an ordinary method and was then so added by gelatin as to be redissolved, distilled water was added thereto to make 4,250 ml of 10 mol-emulsion in total. At that time, the pH and pAg values were adjusted to be 5.80 and 8.1 at a temperature of 40° C., respectively. From the results of the electron microscopic observation, it was proved that the resulting emulsion was an emulsion comprising octahedral monodisperse type emulsion having an average grain size of 0.81 μm and 8.2% of relative standard deviation of silver iodide content of the grain.

As is understood from the presumptive AgI content shown in Table-9, it is required to add an excessive amount of AgI so as to have the composition desirable for producing a highly iodide containing silver bromide. According to the results obtained by carrying out an X ray diffractometry, the cores each having a composition of 35 mol % of silver iodide could be obtained in the preparation conditions of this example by adding a finely grained silver iodide emulsion in a certain excessive amount, in the early stage, at a 100% adding rate thereof to silver ions.

TABLE 9

| | Adding time (min) | Grain size | Flow-rate* ratio of Solution D | Presumptive** AgI content | pH | pAg |
|---|---|---|---|---|---|---|
| Core portion | 0.0 | 0.33 | 0 | 0 | 7.0 | 7.80 |
| | 29.0 | 0.43 | 0 | 0 | 7.0 | 7.80 |
| | 29.1 | 0.43 | 100 | 35 | 7.0 | 7.80 |
| | 35.0 | 0.45 | 100 | 35 | 7.0 | 7.80 |
| | 35.0 | 0.45 | 35 | 35 | 7.0 | 7.80 |
| | 59.2 | 0.52 | 35 | 35 | 7.0 | 7.80 |
| | 59.2 | 0.52 | 10 | 35 | 7.0 | 7.80 |
| | 67.3 | 0.55 | 10 | 35 | 7.0 | 7.80 |
| | 69.1 | 0.55 | 10 | 10 | 7.0 | 7.80 |
| | 72.7 | 0.56 | 10 | 10 | 7.0 | 7.80 |
| Shell | 72.7 | 0.56 | 10 | 10 | 6.0 | 9.70 |

TABLE 9-continued

| | Adding time (min) | Grain size | Flow-rate* ratio of Solution D | Presumptive** AgI content | pH | pAg |
|---|---|---|---|---|---|---|
| portion | 78.1 | 0.57 | 10 | 10 | 6.0 | 9.75 |
| | 78.1 | 0.57 | 3 | 3 | 6.0 | 9.75 |
| | 100.1 | 0.67 | 3 | 3 | 6.0 | 10.10 |
| | 112.4 | 0.79 | 3 | 3 | 6.0 | 10.10 |
| | 112.4 | 0.79 | 0 | 0 | 6.0 | 10.10 |
| | 114.3 | 0.81 | 0 | 0 | 6.0 | 10.10 |

*Flow-rate ratio of Solution D =

$$\frac{\text{Flow rate in mol of Solution D (mol/min)}}{[\text{Flow rate in mol of Solution D (mol/min)} + \text{Flow rate in mol of Solution B (mol/min)}]} \times 100$$

**Presumptive AgI content = The Ag I contents presumed, as the theoretical values, from the adding rates

Example 3-5

Silver halide emulsion Em-3 was prepared by making use of the following three kinds of aqueous solutions, an emulsion solution containing finely grained silver iodide, and the foregoing seed emulsion.

| | |
|---|---|
| <Aqueous solution b-1> | |
| Gelatin | 231.9 g |
| A 10 vol % methanol solution of the following compound I | 30.0 ml |
| 28% aqueous ammonia | 1,056 ml |
| Add water to make | 11,827 ml |
| <Compound I> | |

$$HO(CH_2CH_2O)_m(\overset{\overset{\displaystyle CH_3}{|}}{C}HCH_2O)_{17}(CH_2CH_2O)_nH$$

Average molecular weight ≈ 1,300

| | |
|---|---|
| <Aqueous solution b-2> | |
| $AgNO_3$ | 1,587 g |
| 28% aqueous ammonia | 1,295 ml |
| Add water to make | 2,669 ml |
| <Aqueous solution b-3> | |
| KBr | 1,572 g |
| Add water to make | 3,774 ml |
| <Emulsion solution containing finely grained silver iodide b-4> | |
| Finely grained silver iodide emulsion (The same as in Example 2) | 1,499.3 g |
| 4-hydroxy-6-methyl-1,3,3a,7-tetrazaindene | 5.2 g |
| Aqueous 10% potassium hydroxide solution | 14.75 ml |
| Add water to make | 1,373 ml |

Keeping a temperature of 60° C., the foregoing seed emulsion N-2 was added in an amount equivalent to 0.407 mols into aqueous solution b-1 having the above-given composition, which was being vigorously stirred, and the pH and pAg thereof were controlled by making use of acetic acid and an aqueous KBr solution.

After then, while controlling the pH and pAg as shown in Table-10, aqueous solutions b-2 and b-3 and emulsion solution b-4 containing finely grained silver iodide were each added at the flow rates each shown in Tables-11, 12 and 13, respectively.

After completing the addition, an aqueous phenylcarbamyl gelatin solution was further added. The pH of the resulting mixture solution was so controlled as to coagulate the emulsion, and the desalting and washing treatments were carried out. After that, the pH and pAg values were adjusted to be 5.80 and 8.06 at a temperature of 40° C., respectively.

Thereby, a monodisperse type silver iodobromide emulsion having an average grain size of 0.99 μm, an average silver iodide content of 8.0 mol %, 8.4% of relative standard deviation thereof and a grain size distribution of 11.2% was obtained.

The resulting emulsion is named Em-3.

In the prescribed grain structure of Em-3, the volume ratio of each of the phases is shown in Table-14.

TABLE 10

Grain growth conditions of Em-3

| Ag (%) | 0 | 29 | 29 | 56 | 100 |
|---|---|---|---|---|---|
| pH | 7.0 → | 7.0 ↓ | 6.0 → | 6.0 → | 6.0 |
| pAg | 7.8 → | 7.8 ↓ | 9.7 ↘ | 10.1 → | 10.1 |

In the above,

→ means that pH and pAg are to be kept constant;

↓ means that pH and pAg are to be continuously lowered; and

↓ means that pH and pAg are to be sharply lowered.

TABLE 11

| Adding pattern of b-2 | |
|---|---|
| Time (min) | Adding rate (ml/min) |
| 0 | 12.2 |
| 25.6 | 13.0 |
| 42.6 | 12.9 |
| 43.9 | 8.4 |
| 67.5 | 11.0 |
| 97.3 | 14.8 |
| 97.7 | 20.6 |
| 105.0 | 22.3 |
| 105.4 | 25.4 |
| 112.3 | 32.1 |
| 112.6 | 35.1 |
| 129.4 | 90.3 |
| 145.7 | 149.2 |
| 145.7 | 200.5 |
| 147.4 | 203.9 |

TABLE 12

| Adding pattern of b-3 | |
|---|---|
| Time (min) | Adding rate (ml/min) |
| 0 | 10.9 |
| 25.6 | 11.7 |
| 42.6 | 11.6 |
| 43.9 | 7.6 |
| 97.3 | 13.3 |
| 97.7 | 18.6 |
| 105.0 | 20.0 |
| 105.0 | 36.5 |
| 112.0 | 56.2 |
| 112.3 | 60.6 |
| 121.2 | 106.0 |
| 121.4 | 91.4 |
| 132.4 | 263.3 |
| 132.7 | 141.8 |
| 147.4 | 230.0 |

TABLE 13

| Time (min) | Adding pattern of b-4 Adding rate (ml/min) |
|---|---|
| 0 | 0 |
| 43.9 | 0 |
| 43.9 | 73.6 |
| 51.7 | 80.6 |
| 52.5 | 28.5 |
| 84.3 | 40.4 |
| 84.9 | 11.6 |
| 97.7 | 13.0 |
| 105.0 | 14.1 |
| 105.4 | 16.3 |
| 112.3 | 20.6 |
| 112.6 | 6.2 |
| 130.4 | 17.5 |
| 132.7 | 22.1 |
| 145.7 | 34.4 |

TABLE 14

| Phase | (Seed) 1 | 2 | | 3 | | 4 | 5 | 6 |
|---|---|---|---|---|---|---|---|---|
| Prescribed AgI content (mol %) | 2 | 0 | | 35 | | 10 | 3 | 0 |
| Mol addition ratio of b-4/b-2 (%) | 0 | 0 | 100* | 35 | 10 | 10 | 3 | 0 |
| Volumetric ratio (%) | 3.8 | 9.2 | 1.8 | 15.8 9.2 | 4.8 | 6.7 | 58.7 | 5.8 |

*When prepared high iodide containing silver iodobromide, an excessive amount of finely grained silver iodide should be required for obtaining a desired composition. Under the conditions of Example 3-5 according to the results obtained from the X ray diffractometry, the phase having a high iodide content of 35 mol % was obtained by adding a certain excessive amount of finely grained silver iodide so as to make the adding ratio thereof to silver ions to be 100% in the initial stage of formin the phase having a silver iodide content of 35 mol %.

Example 3-6

Emulsion Em-A was prepared in the following manner.

<Preparation of Emulsion Em-A>

By making use of the following 7 kinds of the solutions, core/shell type silver iodobromide emulsion Em-A was so prepared as to have the AgI contents of 15 mol %, 5 mol % and 3 mol % in order from the inside of the grains thereof, an average grain size of 0.47 μm and an average AgI content of 8.46 mol %.

| | |
|---|---|
| <Solution A-5> | |
| Ossein gelatin | 28.6 g |
| A 10% ethanol solution containing sodium polyisopropylene-polyethyleneoxy-disuccinate | 16.5 ml |
| 4-hydroxy-6-methyl-1,3,3a,7-tetrazaindene (hereinafter referred to as TAI) | 247.5 ml |
| An aqueous 56% acetic acid solution | 72.6 ml |
| A 28% aqueous ammonia solution | 97.2 ml |
| Seed emulsion having a grain size of 0.093 μm | An amount equivalent to 0.1552 mols |
| Add distilled water to make | 6,600 ml |
| <Solution B-5> | |
| Osseous gelatin | 13 g |
| KBr | 460.2 g |
| KI | 113.3 g |
| TAI | 665 mg |
| Add distilled water to make | 1,300 ml |
| <Solution C-5> | |
| Osseous gelatin | 17 g |
| KBr | 672.6 g |
| KI | 49.39 g |

-continued

| | |
|---|---|
| TAI | 840 mg |
| Add distilled water to make | 1,700 ml |
| <Solution D-5> | |
| Ossein gelatin | 8 g |
| KBr | 323.2 g |
| KI | 13.94 g |
| TAI | 409 mg |
| Add distilled water to make | 800 ml |
| <Solution E-5> | |
| $AgNO_3$ | 1,773.6 g |
| A 28% aqueous ammonia solution | 1,470 ml |
| Add distilled water to make | 2,983 ml |
| <Solution F-5> | |
| An aqueous 20% KBr solution | An amount required for controlling pAg |
| <Solution G-5> | |
| An aqueous 56% acetic acid solution | An amount required for controlling pH |

At a temperature of 40° C. and by making use of a mixing stirrer, solutions E-5 and B-5 were added into solution A-5 in a double jet precipitation method and, at the same time when completing the addition of solution B-5, solution C-5 was added. At the same time when completing the addition of solution C-5, solution D-5 was further added. In the course of carrying out the double jet precipitation, the pAg and pH, and the adding rates of solutions E-5, B-5, C-5 and D-5 were controlled as shown in Table-15 given below.

The pAg and pH were controlled by making use of a variable flow rate type roller tube pump and by changing the flow rates of solutions F-5 and G-5.

After completing the addition of solution E-5, the desalting.washing and redispersing treatments were carried out so that the pH and pAg were adjusted to be 6.0 and 7.7, at a temperature of 40° C., respectively.

Thus, emulsion Em-A was prepared. The resulting emulsion Em-A was proved to be an emulsion having an average grain size of 0.47 μm, a core/shell type structure, a silver iodide content of 8.46 mol % and a relative standard deviation of 25% with respect to silver iodide content.

TABLE 15

| Time (min) | Grain growth conditions of Em-A pH | pAg | Adding rate of solution (ml/min) E-5 | B-5 | C-5 | D-5 |
|---|---|---|---|---|---|---|
| 0 | 9.00 | 8.55 | 9.8 | 9.3 | | |
| 7.85 | 8.81 | 8.55 | 30.7 | 29.2 | | |
| 11.80 | 8.63 | 8.55 | 44.9 | 42.7 | | |
| 17.33 | 8.25 | 8.55 | 61.4 | 58.4 | | |
| 19.23 | 8.10 | 8.55 | 63.5 | 60.4 | | |
| 22.19 | 7.88 | 8.55 | 56.6 | 53.8 | | |
| 28.33 | 7.50 | 8.55 | 41.2 | 39.8 | 39.8 | |
| 36.61 | 7.50 | 9.38 | 31.9 | | 34.1 | |
| 40.44 | 7.50 | 9.71 | 30.6 | | 37.1 | |
| 45.14 | 7.50 | 10.12 | 34.6 | | 57.8 | |
| 45.97 | 7.50 | 10.20 | 37.3 | | 36.3 | |
| 57.61 | 7.50 | 10.20 | 57.3 | | 55.8 | 55.8 |
| 63.08 | 7.50 | 10.20 | 75.1 | | | 73.1 |
| 66.63 | 7.50 | 10.20 | 94.0 | | | 91.4 |

<Preparation of emulsion Em-B>

By making use of the following 8 kinds of solutions, core/shell type silver iodobromide emulsion Em-B was prepared to have the silver iodide contents of 15 mol %, 5 mol % and 3 mol % in order from the inside of the grains thereof, an average grain size of 0.81 μm and an average silver iodide content of 7.16 mol %, having 23% of a relative standard deviation thereof.

| | |
|---|---|
| <Solution A-1> | |
| Ossein gelatin | 10.8 g |
| Pronone, a 10% ethanol solution | 20.0 ml |
| 4-hydroxy-6-methyl-1,3,3a,7-tetrazaindene (hereinafter referred to as TAI) | 200 mg |
| An aqueous 56% acetic acid solution | 32.5 ml |
| A 28% aqueous ammonia solution | 58.7 ml |
| Seed emulsion N-2 | An amount equivalent to 0.4673 mols of AgX |
| Add distilled water to make | 4,000 ml |
| <Solution B-1> | |
| Ossein gelatin | 40 g |
| KBr | 404.6 g |
| KI | 99.6 g |
| TAI | 1,224 mg |
| Add distilled water to make | 1,300 ml |
| <Solution C-1> | |
| Ossein gelatin | 20 g |
| KBr | 791.4 g |
| KI | 58.1 g |
| TAI | 2,142 mg |
| Add distilled water to make | 1,700 ml |
| <Solution D-1> | |
| Ossein gelatin | 15 g |
| KBr | 606.0 g |
| KI | 26.15 g |
| TAI | 1,605 mg |
| Add distilled water to make | 800 ml |
| <Solution E-1> | |
| $AgNO_3$ | 310.4 g |
| A 28% aqueous ammonia solution | 253 ml |
| Add distilled water to make | 1,827 ml |
| <Solution F-1> | |
| $AgNO_3$ | 803.3 g |
| A 28% aqueous ammonia solution | 655 ml |
| Add distilled water to make | 1,351 ml |
| <Solution G-1> | |
| An aqueous 20% KBr solution | An amount required for adjusting pAg |
| <Solution H-1> | |
| An aqueous 56% acetic acid solution | An amount required for adjusting pH |

At a temperature of 40° C. and by making use of the same mixing stirrer as those given in Japanese Patent O.P.I. Publication Nos. 57-92523/1982 and 57-92524/1982, solutions E-1 and B-1 were added into solution A-1 in a double jet precipitation method and, at the same time when completing the addition of solution B-1, solutions C-1 and F-1 were added, and at the same time when completing the addition of solution C-1, solution D-1 was added. In the course of the double jet precipitation, the pAg and pH and the adding rates of solutions B-1, C-1 and those of solutions D-1, F-1, each were controlled as shown in Table-16.

The pAg and pH were controlled by making use of a variable flow rate type roller tube pump and by changing the flow rates of solutions G-1 and H-1.

Next, the desalting.washing treatment was carried out in an ordinary method and 197.4 g of osseous gelatin was dispersed in an aqueous solution and then the total amount of the resulting dispersion was made to be 3,000 ml by adding distilled water. At that time, the pH and pAg were adjusted to be 6.00 and 7.7, at a temperature of 40° C., respectively.

TABLE 16

| Time | Grain growth conditions of Em-B | | | | | | |
|---|---|---|---|---|---|---|---|
| | | | Adding rate of solution (ml/min) | | | | |
| (min) | pH | pAg | B-1 | C-1 | D-1 | E-1 | F-1 |
| 0 | 9.00 | 8.40 | | | | | |
| 6.58 | 9.00 | 8.40 | 81.5 | | | 82.8 | |

TABLE 16-continued

| Time | Grain growth conditions of Em-B | | | | | | |
|---|---|---|---|---|---|---|---|
| | | | Adding rate of solution (ml/min) | | | | |
| (min) | pH | pAg | B-1 | C-1 | D-1 | E-1 | F-1 |
| 10.13 | 9.00 | 8.40 | 100.1 | | | 101.7 | |
| 15.30 | 9.00 | 8.40 | 123.1 | | | 125.7 | |
| 21.62 | 9.00 | 8.40 | 140.5 | | | 145.2 | |
| 22.07 | 9.00 | 8.40 | | 44.7 | | | 42.8 |
| 24.06 | 8.87 | 8.85 | | 59.2 | | | 52.0 |
| 26.94 | 8.64 | 9.63 | | 197.4 | | | 98.2 |
| 27.11 | 8.62 | 9.71 | | 119.9 | | | 119.3 |
| 29.97 | 8.22 | 9.71 | | 110.4 | | | 109.9 |
| 32.03 | 7.97 | 9.71 | | | 90.1 | | 89.7 |
| 34.92 | 7.70 | 9.71 | | | 68.1 | | 67.8 |
| 37.30 | 7.50 | 9.71 | | | 68.1 | | 67.8 |

<Preparation of emulsion Em-C>

Silver iodobromide emulsion Em-C was prepared by making use of the following aqueous solutions a-1 through a-6.

| | |
|---|---|
| <Aqueous solution a-1> | |
| Gelatin | 51.93 g |
| A 28% aqueous ammonia solution | 88.0 ml |
| 4-hydroxy-6-methyl-1,3,3a,7-tetrazaindene | 300 mg |
| Add water to make | 5,827 ml |
| <Aqueous solution a-2> | |
| $AgNO_3$ | 1,277 g |
| A 28% aqueous ammonia solution | 1,042 ml |
| Add water to make | 2,148 ml |
| <Aqueous solution a-3> | |
| Gelatin | 40 g |
| KBr | 774.7 g |
| KI | 81.34 g |
| 4-hydroxy-6-methyl-1,3,3a,7-tetrazaindene | 2.06 g |
| Add water to make | 2 liters |
| <Aqueous solution a-4> | |
| $AgNO_3$ | 453.2 g |
| A 28% aqueous ammonia solution | 369.7 ml |
| Add water to make | 2,668 ml |
| <Aqueous solution a-5> | |
| Gelatin | 60 g |
| KBr | 285.6 g |
| KI | 94.88 g |
| 4-hydroxy-6-methyl-1,3,3a,7-tetrazaindene | 827 mg |
| Add water to make | 3 liters |
| <Aqueous solution a-6> | |
| Gelatin | 24 g |
| KBr | 498.3 g |
| KI | 2.09 g |
| 4-hydroxy-6-methyl-1,3,3a,7-tetrazaindene | 1.24 g |
| Add water to make | 1.2 liters |

Keeping a temperature at 50° C., a monodisperse type silver iodobromide emulsion, which contained silver iodide of 2 mol % and had an average grain size of 0.33 μm in an amount equivalent to 0.407 mols, was added as seed grains into aqueous solution a-1 having the above-given composition, which was being violently stirred. Next, the pH and pAg values thereof were controlled with acetic acid and an aqueous KBr solution.

After then, while controlling the pH and pAg values, first, aqueous solutions a-2 and a-3, next, aqueous solutions a-4 and a-5, further, aqueous solutions a-2 and a-3, and finally, aqueous solutions a-2 and a-6, each were added in a double jet precipitation method.

Next, the pH and pAg values of the resulting solution were adjusted to be 6.0 and 10.1, respectively, and was then desalted and washed. The pH and pAg values thereof were adjusted again to be 6.0 and 7.7 at a temperature of 40° C., so that monodisperse type emulsion Em-C having an average grain size of 0.99 μm and an average silver iodide content of 8.0 mol % having 22% of a relative standard deviation thereof could be obtained.

In this case, however, in the course of growing the grains, the conditions of the pH and pAg values adjusted to meet the proportions of the amounts of silver used for growing grains are as shown in Table-17 below.

TABLE 17

Grain growth conditions for Em-C

| Ag (%) | 0 | | 30 | | 45 | | 100 |
|---|---|---|---|---|---|---|---|
| pH | 9.0 | → | 9.0 | ↘ | ↘ | ↘ | 8.0 |
| pAg | 8.2 | → | 8.2 | ↘ | 9.97 | → | 9.97 |

In Table-17, Ag(%) means a proportion of silver used until the grains were grown partway to the amount of silver necessary to grown up the seed grains. The marks, →, indicate that a pH or a pAg is to be kept constant, and the marks, ↘, indicate that a pH or a pAg is to be lowered continuously. Relative standard deviations of silver iodide contents of Em-A, Em-B and Em-e were 25%, 23% and 22%, respectively.

Example 4

Emulsions Em-1 through Em-3 and Em-A through Em-C, obtained in Examples 3-3 through 3-6, were each chemically sensitized with sodium thiosulfate, chloroauric acid and ammonium thiocyanate, and the sensitizing dyes, stabilizers and antifoggants were suitably added so as to have the compositions given in the following layer compositions, so that multilayered color light sensitive material samples 111 through 116 each having the following compositions were prepared, respectively, according to the above-described Example 1.

In all the descriptions below, the amounts of the compounds each added into silver halide photographic light sensitive materials are indicated in terms of grams per sq. meter of the light sensitive material, unless otherwise expressly stated, and silver halide and colloidal silver are indicated in terms of the amount of silver used.

Multilayered color photographic light sensitive material sample 111 was prepared by forming each of the layers having the following compositions on a triacetyl cellulose film support, in order from the support side.

<Sample 111>

| | |
|---|---|
| Layer 1 : An antihalation layer HC-1 | |
| Black colloidal silver | 0.18 |
| UV absorbent UV-1 | 0.23 |
| High boiling solvent Oil-1 | 0.18 |
| Gelatin | 1.42 |
| Layer 2 : The first interlayer IL-1 | |
| Gelatin | 1.27 |
| Layer 3 : A low speed red sensitive emulsion layer RL | |
| Silver iodobromide emulsion Em-A | 0.78 |
| Sensitizing dye SD-1 | $1.8 \times 10^{-5}$ mols/mol of Ag |
| Sensitizing dye SD-2 | $2.8 \times 10^{-4}$ mols/mol of Ag |
| Sensitizing dye SD-3 | $3.0 \times 10^{-4}$ mols/mol of Ag |
| Sensitizing dye SD-4 | $4.1 \times 10^{-4}$ mols/mol of Ag |
| Cyan coupler C-1 | 0.70 |
| Colored cyan coupler CC-1 | 0.066 |
| DIR compound D-1 | 0.028 |
| High boiling solvent Oil-1 | 0.64 |
| Gelatin | 1.18 |
| Layer 4 : A medium speed red sensitive emulsion layer RM | |
| Silver iodobromide emulsion Em-B | 0.78 |
| Sensitizing dye SD-1 | $2.1 \times 10^{-5}$ mols/mol of Ag |
| Sensitizing dye SD-2 | $1.9 \times 10^{-4}$ mols/mol of Ag |
| Sensitizing dye SD-3 | $9.6 \times 10^{-5}$ mols/mol of Ag |
| Sensitizing dye SD-4 | $9.6 \times 10^{-5}$ mols/mol of Ag |
| Cyan coupler C-1 | 0.28 |
| Colored cyan coupler CC-1 | 0.027 |
| DIR compound D-1 | 0.01 |
| High boiling solvent Oil-1 | 0.26 |
| Gelatin | 0.58 |
| Layer 5 : A high speed red sensitive emulsion layer RH | |
| Silver iodobromide emulsion Em-C | 1.73 |
| Sensitizing dye SD-1 | $1.9 \times 10^{-5}$ mols/mol of Ag |
| Sensitizing dye SD-2 | $1.7 \times 10^{-4}$ mols/mol of Ag |
| Sensitizing dye SD-3 | $1.7 \times 10^{-4}$ mols/mol of Ag |
| Cyan coupler C-2 | 0.14 |
| DIR compound D-1 | 0.025 |
| High boiling solvent Oil-1 | 0.17 |
| Gelatin | 1.24 |
| Layer 6 : The second interlayer IL-2 | |
| Gelatin | 0.80 |
| Layer 7 : A low speed green sensitive emulsion layer GL | |
| Silver iodobromide emulsion Em-A | 1.1 |
| Sensitizing dye SD-4 | $6.8 \times 10^{-5}$ mols/mol of Ag |
| Sensitizing dye SD-5 | $6.2 \times 10^{-4}$ mols/mol of Ag |
| Magenta coupler M-1 | 0.54 |
| Magenta coupler M-2 | 0.19 |
| Colored magenta coupler CM-1 | 0.06 |
| DIR compound D-2 | 0.017 |
| High boiling solvent Oil-2 | 0.81 |
| Gelatin | 1.77 |
| Layer 8 : A medium speed green sensitive emulsion layer GM | |
| Silver iodobromide emulsion Em-B | 0.66 |
| Sensitizing dye SD-6 | $1.9 \times 10^{-4}$ mols/mol of Ag |
| Sensitizing dye SD-7 | $1.2 \times 10^{-4}$ mols/mol of Ag |
| Sensitizing dye SD-8 | $1.8 \times 10^{-5}$ mols/mol of Ag |
| Sensitizing dye SD-4 | $8.2 \times 10^{-5}$ mols/mol of Ag |
| Magenta coupler M-1 | 0.074 |
| Magenta coupler M-2 | 0.034 |
| Colored magenta coupler CM-1 | 0.043 |
| DIR compound D-2 | 0.018 |
| High boiling solvent Oil-2 | 0.30 |
| Gelatin | 0.76 |
| Layer 9 : A high speed green sensitive emulsion layer GH | |
| Silver iodobromide emulsion Em-C | 1.66 |
| Sensitizing dye SD-6 | $1.2 \times 10^{-4}$ mols/mol of Ag |
| Sensitizing dye SD-7 | $1.0 \times 10^{-4}$ mols/mol of Ag |
| Sensitizing dye SD-8 | $3.4 \times 10^{-6}$ mols/mol of Ag |
| Sensitizing dye SD-4 | $2.1 \times 10^{-5}$ mols/mol of Ag |
| Magenta coupler M-1 | 0.094 |
| Magenta coupler M-3 | 0.044 |
| Colored magenta coupler CM-1 | 0.038 |
| High boiling solvent Oil-2 | 0.31 |

-continued

| <Sample 111> | |
|---|---|
| Gelatin | 1.23 |
| Layer 10: A yellow filter layer YC | |
| Yellow colloidal silver | 0.05 |
| Anticolor-staining agent SC-1 | 0.1 |
| High boiling solvent Oil-2 | 0.125 |
| Gelatin | 1.33 |
| Formalin scavenger HS-1 | 0.088 |
| Formalin scavenger HS-2 | 0.066 |
| Layer 11: A low speed blue sensitive emulsion layer BL | |
| Silver iodobromide emulsion Em-A | 0.38 |
| Silver iodobromide emulsion Em-B | 0.12 |
| Sensitizing dye SD-9 | $5.2 \times 10^{-4}$ mols/mol of Ag |
| Sensitizing dye SD-10 | $1.9 \times 10^{-5}$ mols/mol of Ag |
| Yellow coupler Y-1 | 0.65 |
| Yellow coupler Y-2 | 0.24 |
| High boiling solvent Oil-2 | 0.18 |
| Gelatin | 1.25 |
| Formalin scavenger HS-1 | 0.08 |
| Layer 12: A high speed blue sensitive emulsion layer BH | |
| Silver iodobromide emulsion Em-C | 0.81 |
| Silver iodobromide emulsion Em-B | 0.14 |
| Sensitizing dye SD-9 | $1.8 \times 10^{-4}$ mols/mol of Ag |
| Sensitizing dye SD-10 | $7.9 \times 10^{-5}$ mols/mol of Ag |
| Yellow coupler Y-1 | 0.18 |
| High boiling solvent Oil-2 | 0.074 |
| Gelatin | 1.30 |
| Formalin scavenger HS-1 | 0.05 |
| Formalin scavenger HS-2 | 0.12 |
| Layer 13: The first protective layer Pro-1 | |
| Finely grained silver iodobromide emulsion having an average grain size of 0.08 μm and an AgI content of 1 mol % | 0.4 |
| UV absorbent UV-1 | 0.07 |
| UV absorbent UV-2 | 0.10 |
| High boiling solvent Oil-1 | 0.07 |
| High boiling solvent Oil-3 | 0.07 |
| Formalin scavenger HS-1 | 0.13 |
| Formalin scavenger HS-2 | 0.37 |
| Gelatin | 1.3 |
| Layer 14: The second protective layer Pro-2 | |
| Alkali soluble matting agent having an average particle size of 2 μm | 0.13 |

-continued

| <Sample 111> | |
|---|---|
| Polymethyl methacrylate having an average particle size of 3 μm | 0.02 |
| Lubricant WAX-1 | 0.04 |
| Gelatin | 0.6 |

Besides the above-given compositions, coating aid Su-1, dispersing aid Su-2, a viscosity controller, layer hardeners H-1 and H-2, stabilizer ST-1, and antifoggants AF-1 having $\overline{Mw}$:10,000 and AF-2 having $M_w$: 1,100,000, were added.

In addition to the above sample, samples 112 through 116 each relating to the invention were prepared in the same compositions as above, except that the whole or a part of comparative emulsions Em-A, Em-B and Em-C, which were used in layers 3 through 12 of the above sample 111, were replaced by Em-1 through Em-3, as shown in Table-18 given below.

TABLE 18

| | Red sensitive emulsion layer | | | Green sensitive emulsion layer | | | Blue sensitive emulsion layer | |
|---|---|---|---|---|---|---|---|---|
| Sample No. | Layer 3 | Layer 4 | Layer 5 | Layer 7 | Layer 8 | Layer 9 | Layer 11 | Layer 12 |
| 111 | Em-A | Em-B | Em-C | Em-A | Em-B | Em-C | Em-A<br>Em-B | Em-B<br>Em-C |
| 112 | Em-1 | Em-2 | Em-3 | Em-A | Em-B | Em-C | Em-A<br>Em-B | Em-B<br>Em-C |
| 113 | Em-A | Em-2 | Em-3 | Em-A | Em-2 | Em-3 | Em-A<br>Em-B | Em-2<br>Em-3 |
| 114 | Em-A | Em-B | Em-C | Em-I | Em-2 | Em-3 | Em-A<br>Em-B | Em-B<br>Em-C |
| 115 | Em-A | Em-B | Em-3 | Em-A | Em-B | Em-3 | Em-A<br>Em-B | Em-2<br>Em-3 |
| 116 | Em-1 | Em-2 | Em-3 | Em-I | Em-2 | Em-3 | Em-1<br>Em-2 | Em-2<br>Em-3 |

Light sensitive material samples 111 through 116 prepared in the above-described manners were each exposed to light, developed and measure in the foregoing RMS measuring method. The RMS values of the light sensitive layer units of the samples were measured, and the resulting RMS values are shown in Table-19, in terms of the values relative to the RMS values —each regarded as the controls each having a value of 100— of the minimum densities of the red, green and blue sensitive units of sample 111.

In the relation among the values of $RMS_0$, $RMS_1$, and $RMS_2$ shown in the table, the samples of the invention are those of which at least any one of the light sensitive layer units is capable of satisfying the the following two relations:

$$1.10 \leqq \frac{RMS_1}{RMS_0} \leqq 1.50,$$

and $$0.90 \leqq \frac{RMS_2}{RMS_0} \leqq 1.20$$

TABLE 19

| | Red sensitive layer unit | | | | | Green sensitive layer unit | | | | | Blue sensitive layer unit | | | | |
|---|---|---|---|---|---|---|---|---|---|---|---|---|---|---|---|
| Sample | Relative RMS value | | | $RMS_1/$ | $RMS_2/$ | Relative RMS value | | | $RMS_1/$ | $RMS_2/$ | Relative RMS value | | | $RMS_1/$ | $RMS_2/$ |
| No. | $R_0$ | $R_1$ | $R_2$ | $RMS_0$ | $RMS_0$ | $G_0$ | $G_1$ | $G_2$ | $RMS_0$ | $RMS_0$ | $B_0$ | $B_1$ | $B_2$ | $RMS_0$ | $RMS_0$ |
| 101 | 100 | 155 | 140 | 1.55 | 1.40 | 100 | 145 | 130 | 1.45 | 1.3 | 100 | 165 | 150 | 1.65 | 1.50 |
| 102 | 90 | 115 | 95 | 1.28 | 1.06 | 95 | 125 | 105 | 1.31 | 1.11 | 100 | 140 | 120 | 1.40 | 1.20 |
| 103 | 85 | 110 | 95 | 1.29 | 1.11 | 90 | 100 | 100 | 1.11 | 1.11 | 95 | 120 | 110 | 1.26 | 1.15 |

TABLE 19-continued

| Sample No. | Red sensitive layer unit: Relative RMS value $R_0$ | $R_1$ | $R_2$ | $RMS_1/RMS_0$ | $RMS_2/RMS_0$ | Green sensitive layer unit: Relative RMS value $G_0$ | $G_1$ | $G_2$ | $RMS_1/RMS_0$ | $RMS_2/RMS_0$ | Blue sensitive layer unit: Relative RMS value $B_0$ | $B_1$ | $B_2$ | $RMS_1/RMS_0$ | $RMS_2/RMS_0$ |
|---|---|---|---|---|---|---|---|---|---|---|---|---|---|---|---|
| 104 | 95 | 120 | 110 | 1.26 | 1.15 | 90 | 100 | 95 | 1.27 | 1.05 | 100 | 140 | 120 | 1.40 | 1.20 |
| 105 | 85 | 110 | 100 | 1.29 | 1.17 | 90 | 115 | 100 | 1.17 | 1.11 | 95 | 130 | 110 | 1.37 | 1.15 |
| 106 | 85 | 110 | 95 | 1.29 | 1.12 | 85 | 100 | 95 | | 1.12 | 95 | 120 | 105 | 1.26 | 1.11 |

$R_0$, $G_0$, $B_0$: A elative RMS value of a red, green or blue minimum density (= $RMS_0$ given in the columns of each color sensitive layer unit)
$R_1$, $G_1$, $B_1$: A relative RMS value of a red, green or blue minimum density + 0.15 (= $RMS_1$ given in the columns of each color sensitive layer unit)
$R_2$, $G_2$, $B_2$: A relative RMS value in an exposure quantity of $\log H_{R,G,B}$ + 0.5 to an exposure quantity ($\log H_{R,G,B}$) at the measuring point of $R_1$, $G_1$, $B_1$ (= $RMS_2$ given in the columns of each color sensitive layer unit)

Next, the samples 111 through 116 were each cut into a 35 mm size. The 35 mm sized samples were each put in ordinary type metal-made cartridges. Each of the samples in the cartridges was then loaded in a Konica FT-1 Motor camera with Hexanon AR 85 mm Fl.8 lens, manufactured by Konica Corp. A standard neutral grey reflector board having a reflectance of 18% was photographed in a full picture frame with a TTL automatic exposure metering system, by exposing to a blue lamp having a color temperature of 5,800 K, as the light source, —that was a daylight tungsten lamp—. Next, the same reflector board was again photographed in the same manner except that the light source was replaced by a tungsten lamp having a color temperature of 3,100 K. The exposed samples were developed in the same manner as in the foregoing RMS measurement method.

Among the resulting photographed negative samples, the negative of sample 111 exposed to the light source having a temperature of 5,800 K was printed at a 10× —linear— magnification on a sheet of Konica Color Paper so that the print could be finished up in a neutral grey having a reflectance of 18%. The remaining samples were also printed in a neutral grey having a reflectance of 18% and the magnification ratios thereof were so obtained as to have the same graininess as in the above-mentioned 10×magnified prints.

The results obtained are shown in Table-20 given below.

Next, samples 111 through 116 were each exposed wedgewise to the light sources of both of a tungsten lamp having a color temperature of 3,100 K and a three wavelength region emission type fluorescent tube, FL20SS, EX/18, manufactured by Matsushita Electric Co., and the samples were then developed and measured in the method used for the measurements of the RMS values, so that relative density curves D-(logE) were made out, respectively. In the relative density curves of the samples, the gradients of the relative blue, green and red density curves were obtained between their exposure quantities corresponding to the minimum green density+0.40 and the 10×exposure quantity thereof, and the resulting gradients were named $\gamma_B$, $\gamma_G$, and $\gamma_R$. In any one of the samples exposed to light, the relative density curves thereof showed the almost straight lines. The $\gamma_B/\gamma_G$ and $\gamma_R/\gamma_G$ of the respective samples were calculated out and shown in Table-20 given below.

TABLE 20

| Sample No. | Control light conditions for RMS judgements: $\gamma_B/\gamma_G$ | $\gamma_B/\gamma_G$ | 3,100 K tungsten lamp: $\gamma_B/\gamma_G$ | $\gamma_B/\gamma_G$ | 3-wavelength region fluorescent lamp: $\gamma_B/\gamma_G$ | $\gamma_B/\gamma_G$ | Print magnification: 5,800 K light source | 3,100 L light source |
|---|---|---|---|---|---|---|---|---|
| 111 | 1.02 | 1.00 | 0.92 | 1.08 | 0.97 | 0.92 | 10x (Control) | 7.5 |
| 112 | 1.03 | 1.03 | 1.03 | 1.00 | 1.02 | 1.04 | 10.8 | 9.5 |
| 113 | 1.05 | 1.02 | 1.04 | 1.01 | 1.00 | 1.02 | 10.5 | 9.0 |
| 114 | 1.03 | 1.00 | 1.00 | 1.01 | 1.00 | 1.02 | 10.8 | 9.5 |
| 115 | 0.98 | 0.98 | 1.00 | 1.02 | 0.99 | 0.98 | 10.8 | 10.0 |
| 116 | 1.00 | 0.98 | 1.04 | 1.02 | 1.02 | 1.00 | 11.0 | 10.5 |

In Table-20, the values of $\gamma_B/\gamma_G$ and $\gamma_R/\gamma_G$ each show that the smaller the variations caused by the kinds of the light sources are, the smaller the variations of the color balances are, and that the color reproduction is excellent in the high light and shadow portions. As is obvious from Table-20, with the sample 111, the above-mentioned values were varied considerably by the variations of the exposure conditions, while, with any one of the samples 112 through 116, the values were scarcely varied even by the exposure conditions so that excellent results could be obtained.

Also, in Table-20, it means that the larger the print magnification is, the more the graininess of a subject sample is excellent. From the samples 112 through 116, it can be found that the excellent graininess equivalent to the above-mentioned graininess can be obtained even when any photographs are taken under any conditions where a light source having any one of color temperatures which are quite different, for example, 5,800 K and 3,100 K. From the sample 111, on the other hand, it was confirmed that the graininess of each sample was seriously deteriorated when photographing at a color temperature of 3,100 K.

Example 5

When the samples 111 through 116 were processed in the same manner as in processing B in Example 1, the same results as in Example 1 could be obtained. It can be understood therefrom that the light sensitive materials of the invention could not be affected even when the development conditions should be varied, but they could display the same effects.

Example 6

In the following Examples 6-1 through 6-5, the emulsions applicable to the invention were prepared, respectively.

Example 6-1

<Preparation of globular shaped seed emulsion>

In accordance with the procedures described in Japanese Patent O.P.I. Publication No. 61-6643/1986, a monodisperse type globular shaped seed emulsion was prepared by making use of the following solutions $A_1$ through $D_1$.

| | |
|---|---|
| <Solution $A_1$> | |
| Ossein gelatin | 150 g |
| Potassium bromide | 53.1 g |
| Potassium iodide | 24 g |
| Add water to make | 7.2 liters |
| <Solution $B_1$> | |
| Silver nitrate | 1,500 g |
| Add water to make | 6 liters |
| <Solution $C_1$> | |
| Potassium bromide | 1,327 g |
| 1-phenyl-5-mercaptotetrazole, dissolved with methanol | 0.3 g |
| Add water to make | 3 liters |
| <Solution $D_1$> | |
| Aqueous ammonia in a 28% solution | 705 ml |

Solutions $B_1$ and $C_1$ were added into Solution $A_1$ which was being stirred vigorously at a temperature of 40° C., by taking a period of 30 seconds in a double jet precipitation method, so that the nuclei were produced. At that time, the pBr thereof was within the range of 1.09 to 1.15.

After taking a period of 1 minute 30 seconds, Solution $C_1$ was added by taking a period of 20 seconds, so that the resulting mixture was ripened for 5 minutes. At the time of the ripening, the KBr concentration thereof was 0.071 mols per liter and the ammonia concentration thereof was 0.63 mols per liter.

After that, the pH was adjusted to be 6.0 and, immediately, a desalting and washing were carried out. When observing the resulting seed emulsion through an electron microscope, it was a monodisperse type globular shaped emulsion having an average grain size of 0.36 μm and a distribution rate was 18%.

Example 6-2

<Preparation of emulsion>

In accordance with the following procedures, an emulsion having an average silver iodide content of 7.9% was prepared by making use of the following solutions $A_2$, $B_{2-1}$, $C_{2-1}$, $B_{2-2}$, and $C_{2-2}$.

| | |
|---|---|
| <Solution $A_2$> | |
| Ossein gelatin | 74.1 g |
| Seed grain of Example 6-1 | An amount equivalent to 0.372 mols |
| Add water to make | 4 liters |
| <Solution $B_{2-1}$> | |
| Silver nitrate | 591 g |
| Nitric acid having a specific gravity of 1.38 | 15.7 ml |
| Add water to make | 3,164 ml |
| <Solution $C_{2-1}$> | |
| Ossein gelatin | 127 g |
| Potassium bromide | 352 g |
| Potassium iodide | 86.7 g |

-continued

| | |
|---|---|
| Add water to make | 3,164 ml |
| <Solution $B_{2-2}$> | |
| Silver nitrate | 591 g |
| Nitric acid having a specific gravity of 1.38 | 3.8 ml |
| Add water to make | 925 ml |
| <Solution $C_{2-2}$> | |
| Ossein gelatin | 37 g |
| Potassium bromide | 381 g |
| Potassium iodide | 5.4 g |
| Add water to make | 925 ml |

Using an apparatus described in Japanese Patent O.P.I. Publication No. 62-160128/1987, the nozzles for supplying the solutions to the underneath of a mixing stirring propeller were set to have six orifices for supplying Solutions $B_2$ and $C_2$.

Solutions $B_{2-1}$ and $C_{2-1}$ were each added into Solution $A_2$ which was stirred at a high speed of 1,000 rpm at a temperature of 75° C., by taking a period of 120 minutes 17 seconds, while gradually raising the flow rates from 12.21 ml/min in the initial stage of the addition to 26.03 ml/min in the final stage, in a double jet precipitation method. After then, the addition was further continued for 33 minutes 11 seconds at a flow rate of 26.03 ml/min. In this course of the addition, the pAg thereof was kept at 8.0 and pH, at 2.0 —adjusted with nitric acid—, respectively.

In succession, Solutions $B_{2-2}$ and $C_{2-2}$ were each added into the resulting solution which was being stirred, by taking a period of 22 minutes 26 seconds in a double jet precipitation method. The addition rate thereof in the initial stage was 38.5 ml/min and that in the final stage was 44.0 ml/min, respectively. In the course of the addition, the pAg and pH thereof were kept at 8.0 and 2.0, respectively.

After completing the addition, the pH was adjusted to be 6.0 and a desalting treatment was carried out in an ordinary method.

When observing the grains through an electron microscope, the resulting emulsion was an emulsion comprising the 100% twinned crystal monodisperse type grains including the twinned crystal grains having two or more parallel twinned crystal surfaces in a proportion of 85% and having a distribution degree or variation coefficient of 13%. When photographing a (420) diffraction pattern of the emulsion by exposing to X rays —CuKα rays—, the signal width of the maximum peak height×0.13 was 1.60 degrees and that of the maximum peak height×0.15 was 1.50 degrees. FIG. 1 shows the diffraction pattern produced by exposing to the above-mentioned X rays. In the figure, P is the position of a maximum peak, P×0.13 is the position of a maximum peak height×0.13, and P×0.15 is the position of a maximum peak height×0.15. —And so forth in each of the other figures—.

In the twinned crystal grains having even-numbered twin planes, the average value of the ratios of the average grain diameter to the thickness of the grains was 2.8.

The resulting emulsion is named Em-4.

Example 6-3

<Preparation of emulsion>

In-accordance with the following procedures, an emulsion having an average silver iodide content of 8.0 mol % was prepared.

| | |
|---|---|
| <Solution $A_3$> | |
| Ossein gelatin | 74.1 g |
| Seed emulsion of Example 1 | An amount equivalent to 0.372 mols |
| Add water to make | 4,000 ml |
| <Solution $B_{3-1}$> | |
| Silver nitrate | 193.7 g |
| Nitric acid having a specific gravity of 1.38 | 10.3 ml |
| Add water to make | 2,074 ml |
| <Solution $C_{3-1}$> | |
| Ossein gelatin | 83 g |
| Potassium bromide | 95.0 g |
| Potassium iodide | 56.9 g |
| Add water to make | 2,074 ml |
| <Solution $B_{3-2}$> | |
| Silver nitrate | 943.1 g |
| Nitric acid having a specific gravity of 1.38 | 6.6 ml |
| Add water to make | 1,585 ml |
| <Solution $C_{3-2}$> | |
| Ossein gelatin | 13.0 g |
| Potassium bromide | 115.4 g |
| Potassium iodide | 28.4 g |
| Add water to make | 326 ml |
| <Solution $C_{3-3}$> | |
| Ossein gelatin | 50.4 g |
| Potassium bromide | 519.6 g |
| Potassium iodide | 7.32 g |
| Add water to make | 1,259 ml |

Using the same apparatus used in Example 6-2, an emulsion was prepared.

Solutions $B_{3-1}$ and $C_{3-1}$ were each added into Solution $A_3$ which was being stirred at a high speed of 1,000 rpm at a temperature of 75° C., in a double jet precipitation method. At that time, the initial flow rate was 24.2 ml/min and the final flow rate was 50.8 ml/min, and the adding time was 55 minutes 9 seconds. The pAg was kept at 8.0 and the pH at 2.0 adjusted with nitric acid, in the course of the addition, respectively.

Next, Solutions $B_{3-2}$ and $C_{3-2}$ were each added into the above-mentioned resulting solution in a double jet precipitation method. The initial adding rate was 7.98 ml/min, the final adding rate was 10.62 ml, and the adding time was 35 minutes 3 seconds, respectively. In the course of the addition, the pAg and pH were kept at 8.0 and 2.0, respectively.

In succession, Solutions $B_{3-2}$ and $C_{3-2}$ were each added into the resulting solution in a double jet precipitation method. The intial adding rate, the final adding rate and the adding time were 39.09 ml/min, 69.1 ml/min, and 24 minutes 19 seconds, respectively. In the course of the addition thereof, the pAg and pH were kept at 8.0 and 2.0, respectively. After completing the addition, the pH was adjusted to be 6.0 and a desalting and washing treatments were carried out.

The grains obtained were observed through an electron microscope. The resulting emulsion was comprised of 100% twinned crystal monodisperse type grains each having two or more parallel twin planes in a twinned crystal proportion of 82% and having a distribution degree of 14%.

In the twinned crystal grains having two or more parallel twin planes, the average value of the ratios of the average grain diameter to the grain thicknesses was 1.9.

Figure 2:
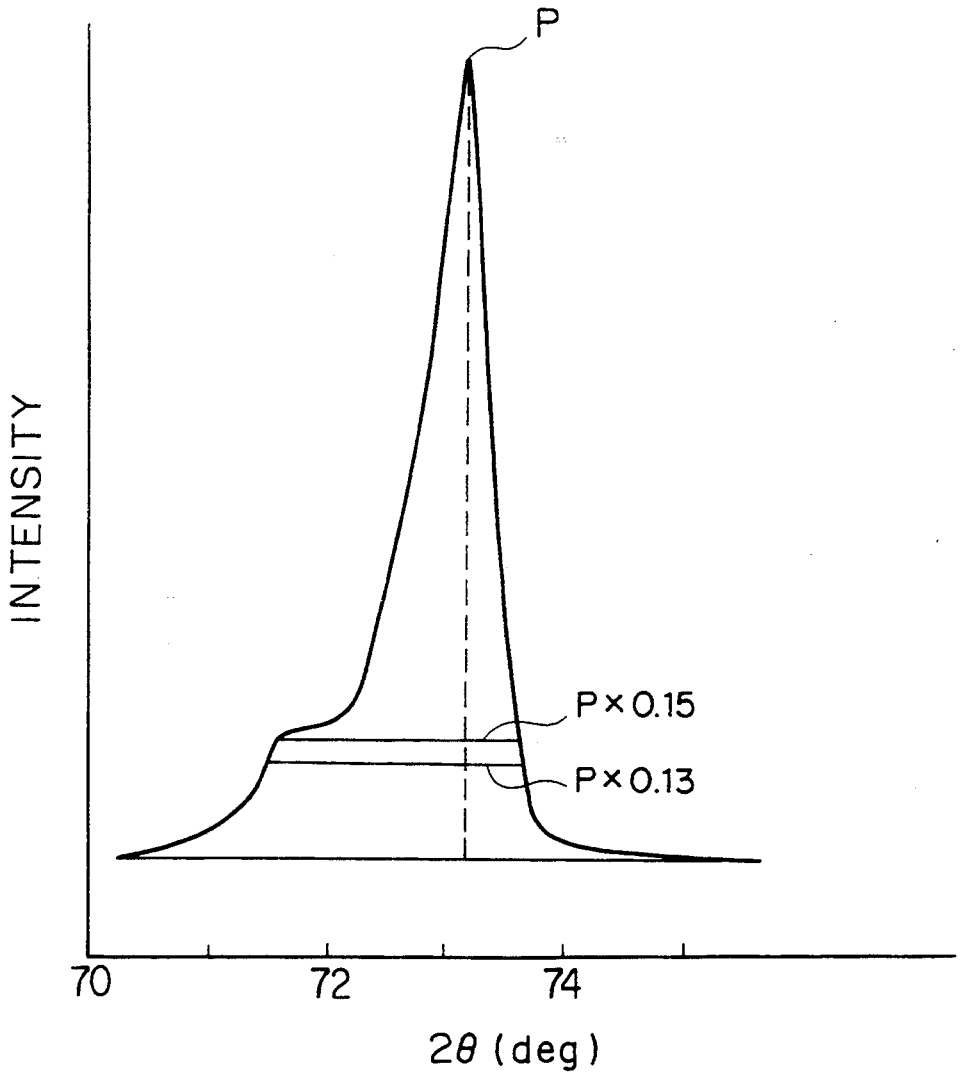

When photographing a (420) diffraction pattern produced by exposing to X-rays —CuKα rays—, the signal width of the maximum peak height×0.13 was 2.15 degrees and that of the maximum peak height×0.15 was 2.05 degrees. FIG. 2 shows the diffraction pattern produced by exposing to the above-mentioned X-rays.

The resulting emulsion is named Em-5.

Example 6-4

<Preparation of emulsion>

Using the seed emulsion prepared in Example 6-1 in the same manner as in Examples 6-2 and 6-3, emulsion Em-6 having. an average silver iodide content of 10.1% was prepared.

The resulting emulsion Em-3 was comprised of 100% twinned crystal monodisperse type grains having two or more parallel twin planes in a twinned crystal proportion of 78% and having a distribution degree of 14%.

Figure 3:
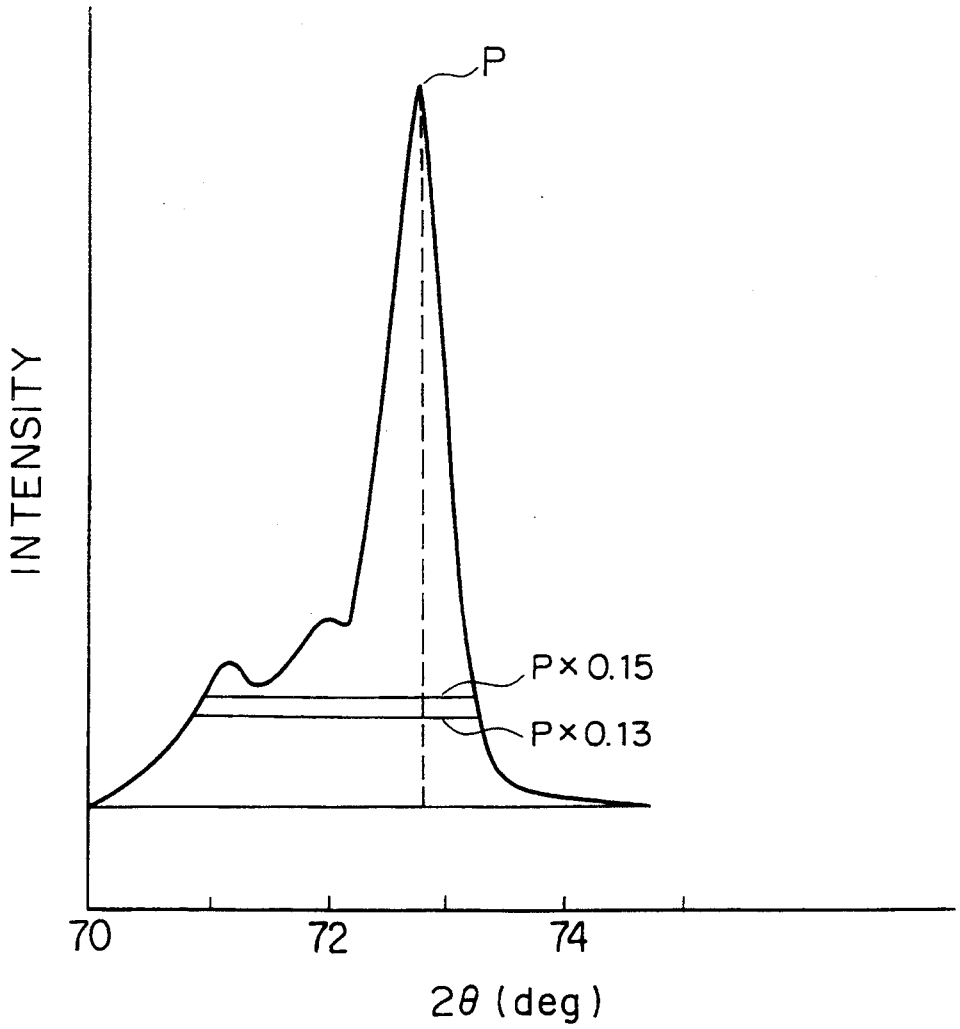

When photographing a (420) diffraction pattern produced by exposing to X-rays —CuKα rays—, it was proved that the emulsion had three peaks. The signal width of the maximum peak height×0.13 was 2.38 degrees and that of the maximum peak height×0.15 was 2.28 degrees. FIG. 3 shows the diffraction pattern produced by exposing to the above-mentioned X-rays.

Table-21 shows the volume proportions of the prescriptive seed phases, internal phases, intermediate phases and outermost phases of the grains of the emulsions Em-4 through Em-6, and the silver iodide contents of the respective phases.

TABLE 21

| Emulsion | Seed | | Internal phase | | Intermediate phase | | Outmost phase | | Average AgI |
|---|---|---|---|---|---|---|---|---|---|
| No. | Vol % | AgI % | Vol % | AgI % | Vol % | AgI % | Vol % | AgI % | content (%) |
| Em-4 | 5 | 1.4 | 49 | 15 | — | — | 46 | 1 | 7.9 |
| Em-5 | 5 | 1.4 | 16 | 30 | 16 | 15 | 62 | 1 | 8.0 |
| Em-6 | 5 | 1.4 | 17 | 35 | 17 | 20 | 61 | 1 | 10.1 |
| Em-D | 5 | 1.4 | 17 | 30 | — | — | 78 | 1 | 6.0 |
| Em-E | 5 | 1.4 | 30 | 38 | — | — | 65 | 1 | 12.1 |

Example 6-5

In the same manner as in the preparation procedures given in Examples 6-2 and 6-3, emulsions Em-D and Em-E were each prepared.

The volume proportions of the prescriptive seed phases, internal phases and outermost phases of Em-D and Em-E and the silver iodide contents of each of the phases thereof are also shown in Table-21 so as to correspond to those of the foregoing emulsions.

The resulting Em-D and Em-E each were comprised of an approximately 100% twinned crystal monodisperse type emulsion having a distribution ratio of 13%.

When analyzing the (420) X-ray diffraction patterns each of these emulsions, the following facts were proved:

Em-D:

This was comprised of two peaks;

The signal width of the maximum peak height×0.13 was 1.00 degree; and

The signal width of the maximum peak height×0.15 was 0.93 degrees.

Em-E:

This was comprised of two peaks;

The signal width of the maximum peak height×0.13 was 1.23 degrees; and

The signal width of the maximum peak height×0.15 was 1.13 degrees.

Figure 4:
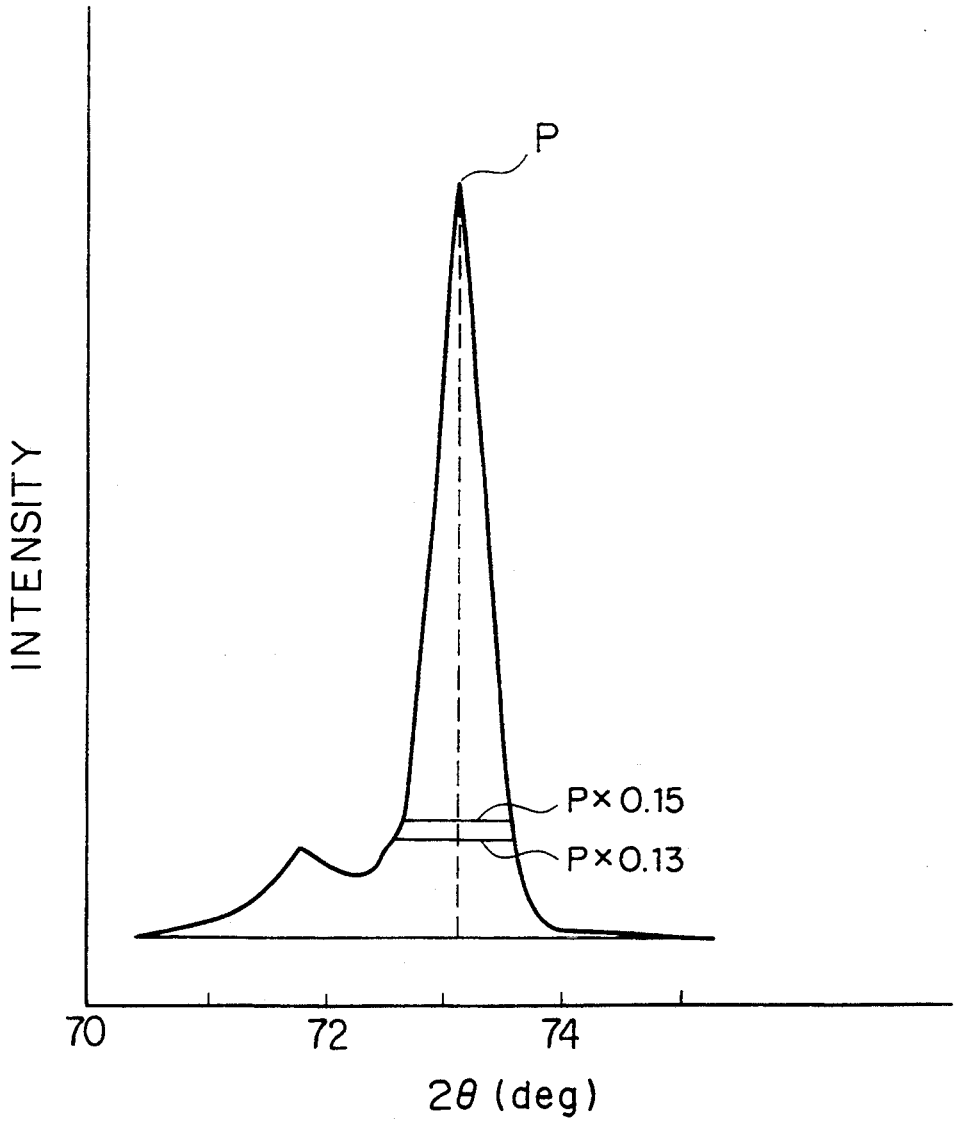
Figure 5:
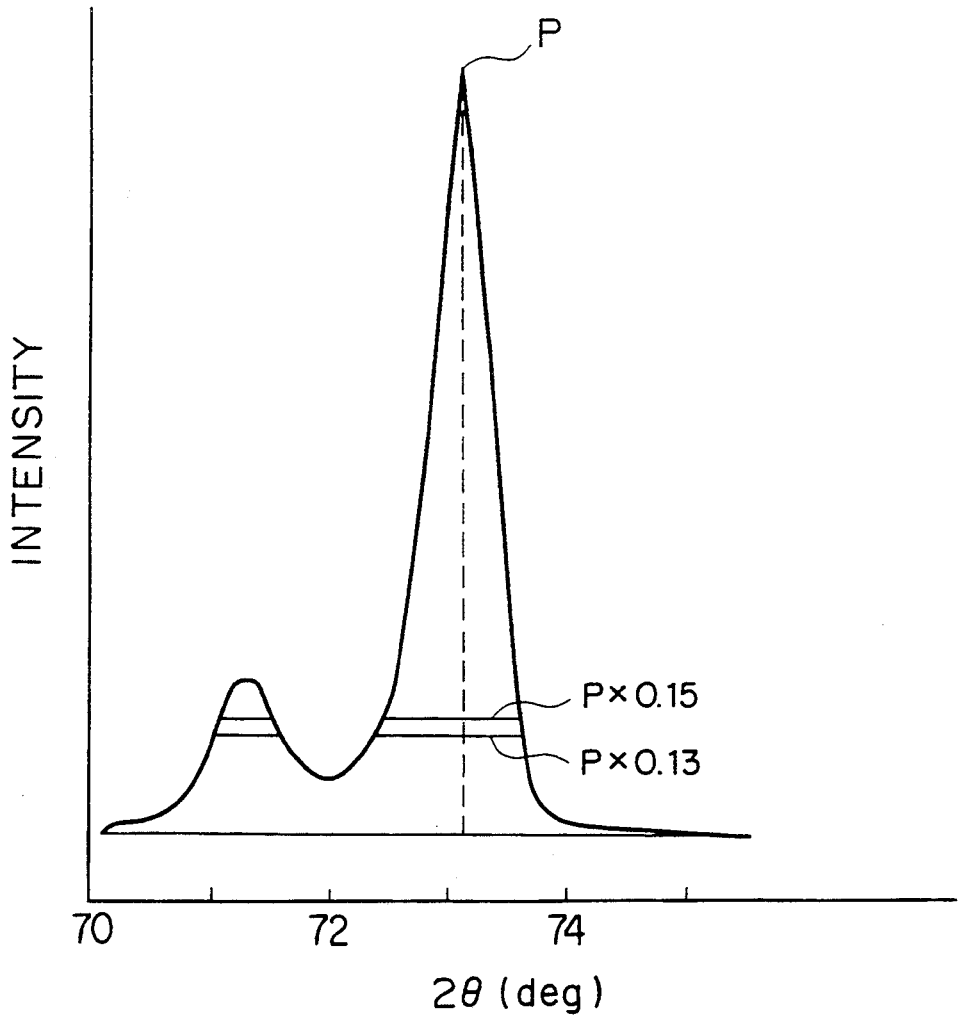

In either cases, none of any continuous signals each having not narrower than 1.50 degrees. FIGS. 4 and 5 shows the diffraction patterns produced with Em-D and Em-E by exposing to the above-mentioned X-rays.

Example 7

<Preparation of light sensitive material samples and the evaluation thereof>

Emulsions Em-4 through Em-6, Em-D and Em-E prepared in Examples 6-2 through 6-5 were each chemically sensitized with sodium thiosulfate, chloroauric acid and ammonium thiocyanate and, thereto, the sensitizing dyes, stabilizers and antifoggants were also suitably added as shown below, so that multilayered color negative photographic light sensitive materials 121 through 126 each having the following layer arrangements were prepared.

In all the descriptions below, the amounts of the compounds added in each of the silver halide photographic light sensitive materials are indicated in terms of grams per sq. meter, unless otherwise expressly stated, provided, the amounts of silver halides and colloidal silver added are indicated in terms of the amount of silver converted therefrom.

First, the multilayered color photographic light sensitive material samples 121 was prepared, on a triacetyl cellulose film support, by forming each of the layers having the following compositions in order from the support side.

| <Sample 121> | |
|---|---|
| Layer 1: An antihalation layer HC-1 | |
| Black colloidal silver | 0.18 |
| UV absorbent UV-1 | 0.23 |
| High boiling solvent Oil-1 | 0.18 |
| Gelatin | 1.42 |
| Layer 2: The first interlayer IL-1 | |
| Gelatin | 1.27 |
| Layer 3: A low speed red sensitive emulsion layer RL | |
| Silver iodobromide emulsion having an AgI content of 8 mol %, octahedral grains, and an average grain size of 0.38 μm | 0.78 |
| Silver iodobromide emulsion having an AgI content of 2 mol %, octahedral grains, and an average grain size of 0.27 μm | 0.20 |
| Sensitizing dye SD-1 | $1.8 \times 10^{-5}$ mols/mol of Ag |
| Sensitizing dye SD-2 | $2.8 \times 10^{-4}$ mols/mol of Ag |
| Sensitizing dye SD-3 | $3.0 \times 10^{-4}$ mols/mol of Ag |
| Sensitizing dye SD-4 | $4.1 \times 10^{-4}$ mols/mol of Ag |
| Cyan coupler C-1 | 0.70 |
| Colored cyan coupler CC-1 | 0.066 |
| DIR compound D-1 | 0.028 |
| High boiling solvent Oil-1 | 0.64 |
| Gelatin | 1.18 |
| Layer 4: A medium speed red sensitive emulsion layer RM | |
| Silver iodobromide emulsion having an AgI content of 8 mol %, octahedral grains, and an average grain size of 0.65 μm | 0.78 |
| Sensitizing dye SD-1 | $2.1 \times 10^{-5}$ mols/mol of Ag |

-continued

| <Sample 121> | |
|---|---|
| Sensitizing dye SD-2 | $1.9 \times 10^{-4}$ mols/mol of Ag |
| Sensitizing dye SD-3 | $9.6 \times 10^{-5}$ mols/mol of Ag |
| Sensitizing dye SD-4 | $9.6 \times 10^{-5}$ mols/mol of Ag |
| Cyan coupler C-1 | 0.28 |
| Colored cyan coupler CC-1 | 0.027 |
| DIR compound D-1 | 0.011 |
| High boiling solvent Oil-1 | 0.26 |
| Gelatin | 0.58 |
| Layer 5: A high speed red sensitive emulsion layer RH | |
| Silver iodobromide emulsion Em-D | 1.73 |
| Sensitizing dye SD-1 | $1.9 \times 10^{-5}$ mols/mol of Ag |
| Sensitizing dye SD-2 | $1.7 \times 10^{-4}$ mols/mol of Ag |
| Sensitizing dye SD-3 | $1.7 \times 10^{-4}$ mols/mol of Ag |
| Cyan coupler C-2 | 0.14 |
| DIR compound D-1 | 0.025 |
| High boiling solvent Oil-1 | 0.17 |
| Gelatin | 1.24 |
| Layer 6: The second interlayer IL-2 | |
| Gelatin | 0.80 |
| Layer 7: A low speed green sensitive emulsion layer GL | |
| Silver iodobromide emulsion having an AgI content of 8 mol %, octahedral grains, and an average grain size of 0.38 μm | 0.98 |
| Silver iodobromide emulsion having an AgI content of 2 mol %, octahedral grains, and an average grain size of 0.27 μm | 0.11 |
| Sensitizing dye SD-4 | $6.8 \times 10^{-5}$ mols/mol of Ag |
| Sensitizing dye SD-5 | $6.2 \times 10^{-4}$ mols/mol of Ag |
| Magenta coupler M-1 | 0.54 |
| Magenta coupler M-2 | 0.19 |
| Colored magenta coupler CM-1 | 0.06 |
| DIR compound D-2 | 0.017 |
| High boiling solvent Oil-2 | 0.81 |
| Gelatin | 1.77 |
| Layer 8: A medium speed green sensitive emulsion layer GM | |
| Silver iodobromide emulsion having an AgI content of 8 mol %, octahedral grains, and an average grain size of 0.65 μm | 0.66 |
| Sensitizing dye SD-6 | $1.9 \times 10^{-4}$ mols/mol of Ag |
| Sensitizing dye SD-7 | $1.2 \times 10^{-4}$ mols/mol of Ag |
| Sensitizing dye SD-8 | $1.5 \times 10^{-5}$ mols/mol of Ag |
| Sensitizing dye SD-4 | $8.2 \times 10^{-5}$ mols/mol of Ag |
| Magenta coupler M-1 | 0.074 |
| Magenta coupler M-2 | 0.034 |
| Colored magenta coupler CM-1 | 0.043 |
| DIR compound D-2 | 0.018 |
| High boiling solvent Oil-2 | 0.30 |
| Gelatin | 0.76 |
| Layer 9: A high speed green sensitive emulsion layer GH | |
| Silver iodobromide emulsion Em-D | 1.66 |
| Sensitizing dye SD-6 | $1.2 \times 10^{-4}$ mols/mol of Ag |
| Sensitizing dye SD-7 | $1.0 \times 10^{-4}$ mols/mol of Ag |
| Sensitizing dye SD-8 | $3.4 \times 10^{-6}$ mols/mol of Ag |
| Sensitizing dye SD-4 | $2.1 \times 10^{-5}$ mols/mol of Ag |
| Magenta coupler M-1 | 0.094 |
| Magenta coupler M-3 | 0.044 |
| Colored magenta coupler CM-1 | 0.038 |
| High boiling solvent Oil-2 | 0.31 |
| Gelatin | 1.23 |
| Layer 10: A yellow filter layer YC | |
| Yellow colloidal silver | 0.05 |
| Anticolor staining agent SC-1 | 0.1 |
| High boiling solvent Oil-2 | 0.125 |

-continued

| <Sample 121> | |
|---|---|
| Gelatin | 1.33 |
| Formalin scavenger HS-1 | 0.088 |
| Formalin scavenger HS-2 | 0.066 |
| Layer 11: A low speed blue sensitive emulsion layer BL | |
| Silver iodobromide emulsion having an AgI content of 2 mol %, octahedral grains, and an average grain size of 0.27 μm | 0.12 |
| Silver iodobromide emulsion having an AgI content of 8 mol %, octahedral grains, and an average grain size of 0.38 μm | 0.24 |
| Silver iodobromide emulsion having an AgI content of 8 mol %, octahedral grains, and an average grain size of 0.65 μm | 0.12 |
| Sensitizing dye SD-9 | $5.2 \times 10^{-4}$ mols/mol of Ag |
| Sensitizing dye SD-10 | $1.9 \times 10^{-5}$ mols/mol of Ag |
| Yellow coupler Y-1 | 0.65 |
| Yellow coupler Y-2 | 0.24 |
| High boiling solvent Oil-2 | 0.18 |
| Gelatin | 1.25 |
| Formalin scavenger HS-1 | 0.08 |
| Layer 12: A high speed blue sensitive emulsion layer BH | |
| Silver iodobromide emulsion Em-D | 0.81 |
| Silver iodobromide emulsion having an AgI content of 8 mol %, octahedral grains, and an average grain size of 0.65 μm | 0.14 |
| Sensitizing dye SD-9 | $1.8 \times 10^{-4}$ mols/mol of Ag |
| Sensitizing dye SD-10 | $7.9 \times 10^{-5}$ mols/mol of Ag |
| Yellow coupler Y-1 | 0.18 |
| High boiling solvent Oil-2 | 0.074 |
| Gelatin | 1.30 |
| Formalin scavenger HS-1 | 0.05 |
| Formalin scavenger HS-2 | 0.12 |
| Layer 13: The first protective layer Pro-1 | |
| Finely grained silver iodobromide emulsion having an average grain size of 0.08 μm and an AgI content of 1 mol % | 0.4 |
| UV absorbent UV-1 | 0.07 |
| UV absorbent UV-2 | 0.10 |
| High boiling solvent Oil-1 | 0.07 |
| High boiling solvent Oil-3 | 0.07 |
| Formalin scavenger HS-1 | 0.13 |
| Formalin scavenger HS-2 | 0.37 |
| Gelatin | 1.3 |
| Layer 14: The second protective layer Pro-2 | |
| Alkali soluble matting agent having an average particle size of 2 μm | 0.13 |
| Polymethyl methacrylate having an average particle size of 3 μm | 0.02 |
| Lubricant WAX-1 | 0.04 |
| Gelatin | 0.6 |

Besides the above-given compositions, coating aid Su-1, dispersing aid Su-2, a viscosity controller, layer hardeners H-1 and H-2, stabilizer ST-1, and two kinds of antifoggants, AF-1 having $M_w$: 10,000 and AF-2 having $M_w$: 1,100,000, were added.

The average grains sizes of the emulsions used in the above-mentioned samples are indicated by the sizes of grains each converted into a cube.

Next, samples 122 through 127 each were prepared in the same manner as in sample 121, except that the emulsions applied to layers 5, 9 and 12 of sample 121 were replaced by those shown in Table-22 given below.

TABLE 22

| Sample No. | Layer 5 silver halide emulsion | Layer 9 silver halide emulsion | Layer 12 silver halide emulsion |
|---|---|---|---|
| 121 | Em-D | Em-D | Em-D |
| 122 | Em-E | Em-E | Em-E |
| 123 | Em-4 | Em-4 | Em-4 |

TABLE 22-continued

| Sample No. | Layer 5 silver halide emulsion | Layer 9 silver halide emulsion | Layer 12 silver halide emulsion |
|---|---|---|---|
| 124 | Em-5 | Em-5 | Em-5 |
| 125 | Em-E | Em-E | Em-6 |
| 126 | Em-E | Em-6 | Em-6 |
| 127 | Em-6 | Em-6 | Em-6 |

Next, sample 128 was so prepared as to have the following composition.

| <Sample 128> | |
|---|---|
| Layer 1: An antihalation layer HC-1 | |
| Black colloidal silver | 0.18 |
| UV absorbent UV-1 | 0.29 |
| High boiling solvent Oil-1 | 0.23 |
| High boiling solvent Oil-2 | 0.011 |
| Colored magenta coupler CM-3 | 0.011 |
| Gelatin | 1.57 |
| Layer 2: The first interlayer IL-1 | |
| Gelatin | 1.27 |
| Layer 3: A low speed red sensitive emulsion layer RL | |
| Silver iodobromide emulsion having an AgI content of 8 mol %, octahedral grains, and an average grain size of 0.38 μm | 0.80 |
| Silver iodobromide emulsion having an AgI content of 8 mol %, octahedral grains, and an average grain size of 0.65 μm | 1.21 |
| Sensitizing dye SD-1 | $1.3 \times 10^{-5}$ mols/mol of Ag |
| Sensitizing dye SD-2 | $2.2 \times 10^{-4}$ mols/mol of Ag |
| Sensitizing dye SD-3 | $2.2 \times 10^{-4}$ mols/mol of Ag |
| Cyan coupler C-1 | 1.21 |
| Colored cyan coupler CC-1 | 0.032 |
| DIR compound D-1 | 0.05 |
| High boiling solvent Oil-1 | 1.04 |
| Gelatin | 2.00 |
| Layer 4: The second interlayer IL-2 | |
| Gelatin | 0.80 |
| Layer 5: A high speed red sensitive emulsion layer RH | |
| Silver iodobromide emulsion having an AgI content of 2 mol %, octahedral grains, and an average grain size of 0.27 μm | 0.30 |
| Silver iodobromide emulsion having an AgI content of 2 mol %, octahedral grains, and an average grain size of 0.65 μm | 0.54 |
| Silver iodobromide emulsion Em-A | 1.61 |
| Sensitizing dye SD-1 | $7.1 \times 10^{-6}$ mols/mol of Ag |
| Sensitizing dye SD-2 | $1.2 \times 10^{-4}$ mols/mol of Ag |
| Sensitizing dye SD-3 | $1.2 \times 10^{-4}$ mols/mol of Ag |
| Cyan coupler C-1 | 0.05 |
| Cyan coupler C-2 | 0.19 |
| DIR compound D-3 | 0.0066 |
| DIR compound D-1 | 0.0076 |
| High boiling solvent Oil-1 | 0.28 |
| Gelatin | 1.37 |
| Layer 6: The second interlayer IL-2 | |
| Gelatin | 0.80 |
| High boiling solvent Oil-2 | 0.08 |
| SC-2 | 0.071 |
| Layer 7: A low speed green sensitive emulsion layer GL | |
| Silver iodobromide emulsion having an AgI content of 8 mol %, octahedral grains, and an average grain size of 0.65 μm | 0.46 |
| Silver iodobromide emulsion having an AgI content of 8 mol %, octahedral grains, and an average grain size of 0.38 μm | 0.69 |
| Sensitizing dye SD-4 | $2.7 \times 10^{-5}$ mols/mol of Ag |
| Sensitizing dye SD-5 | $2.5 \times 10^{-4}$ mols/mol of Ag |
| Sensitizing dye SD-7 | $8.0 \times 10^{-5}$ |

-continued

| <Sample 128> | |
|---|---|
| | mols/mol of Ag |
| Sensitizing dye SD-8 | $1.9 \times 10^{-5}$ mols/mol of Ag |
| Sensitizing dye SD-11 | $1.4 \times 10^{-4}$ mols/mol of Ag |
| Magenta coupler M-4 | 0.34 |
| Colored magenta coupler CM-3 | 0.048 |
| DIR compound D-3 | 0.0025 |
| DIR compound D-4 | 0.013 |
| DIR compound D-2 | 0.02 |
| High boiling solvent Oil-4 | 0.38 |
| Gelatin | 1.13 |
| Layer 8: The third interlayer IL-3 | |
| High boiling solvent oil-1 | 0.17 |
| Gelatin | 0.83 |
| Layer 9: A high speed green sensitive emulsion layer GH | |
| Silver iodobromide emulsion having an AgI content of 8 mol %, octahedral grains, and an average grain size of 0.65 μm | 0.56 |
| Silver iodobromide emulsion Em-A | 2.26 |
| Sensitizing dye SD-11 | $4.5 \times 10^{-5}$ mols/mol of Ag |
| Sensitizing dye SD-6 | $9.6 \times 10^{-5}$ mols/mol of Ag |
| Sensitizing dye SD-7 | $8.8 \times 10^{-5}$ mols/mol of Ag |
| Sensitizing dye SD-8 | $1.4 \times 10^{-5}$ mols/mol of Ag |
| Magenta coupler M-1 | 0.14 |
| Magenta coupler M-3 | 0.068 |
| Colored magenta coupler CM-2 | 0.11 |
| DIR compound D-5 | 0.0015 |
| High boiling solvent Oil-2 | 0.57 |
| Gelatin | 1.97 |
| Layer 10: A yellow filter layer YC | |
| Yellow colloidal silver | 0.05 |
| Anticolor staining agent SC-2 | 0.054 |
| High boiling solvent Oil-2 | 0.063 |
| Gelatin | 0.49 |
| Formalin scavenger HS-1 | 0.08 |
| Formalin scavenger HS-2 | 0.10 |
| Layer 11: A low speed blue sensitive emulsion layer BL | |
| Silver iodobromide emulsion having an AgI content of 8 mol %, octahedral grains, and an average grain size of 0.38 μm | 0.226 |
| Silver iodobromide emulsion having an AgI content of 8 mol %, octahedral grains, and an average grain size of 0.65 μm | 0.239 |
| Sensitizing dye SD-12 | $5.5 \times 10^{-4}$ mols/mol of Ag |
| Sensitizing dye SD-10 | $5.0 \times 10^{-5}$ mols/mol of Ag |
| Yellow coupler Y-1 | 0.99 |
| Yellow coupler Y-2 | 0.085 |
| DIR compound D-1 | 0.012 |
| High boiling solvent Oil-2 | 0.25 |
| Gelatin | 1.60 |
| Formalin scavenger HS-1 | 0.12 |
| Formalin scavenger HS-2 | 0.29 |
| Layer 12: A high speed blue sensitive emulsion layer BH | |
| Silver iodobromide emulsion having an AgI content of 2 mol %, octahedral grains, and an average grain size of 0.27 μm | 0.20 |
| Silver iodobromide emulsion having an AgI content of 8 mol %, octahedral grains, and an average grain size of 0.65 μm | 0.20 |
| Silver iodobromide emulsion Em-A | 0.80 |
| Sensitizing dye SD-12 | $2.0 \times 10^{-4}$ mols/mol of Ag |
| Sensitizing dye SD-10 | $4.8 \times 10^{-5}$ mols/mol of Ag |
| Yellow coupler Y-2 | 0.27 |
| High boiling solvent Oil-2 | 0.17 |
| Gelatin | 1.22 |
| Formalin scavenger HS-2 | 0.083 |
| Layer 13: The first protective layer Pro-1 | |
| Finely grained silver iodobromide emulsion having an average grain size of 0.08 μm and an AgI content of 1 mol % | 0.4 |
| UV absorbent UV-1 | 0.058 |
| UV absorbent UV-2 | 0.083 |
| High boiling solvent Oil-1 | 0.06 |
| High boiling solvent Oil-3 | 0.06 |
| Formalin scavenger HS-1 | 0.047 |
| Formalin scavenger HS-2 | 0.22 |
| Gelatin | 1.49 |
| Layer 14: The second protective layer Pro-2 | |
| Alkali soluble matting agent having an average particle size of 2 μm | 0.12 |
| Polymethyl methacrylate having and average particle size of 3 μm | 0.018 |
| Gelatin | 0.55 |

Besides the above-given compositions, coating aid Su-1, dispersing aid Su-2, a viscosity controller, layer hardeners H-1 and H-2, stabilizer ST-1, and antifoggants AF-1 and AF-2 having $M_w$: 1,100,000, were added.

In the emulsions applied to the above-mentioned samples, the average grainsizes thereof are indicated by the one side length of the cube having the same volume as is converted from the volume of each grain. Each of the emulsions was subjected to an optimum gold.sulfur sensitization.

Samples 121 through 128 thus prepared were exposed to light, developed, and measured in the foregoing RMS measurement method and, in Table-23, the RMS values of the red, green and blue sensitive layer units of the samples are each shown in terms of the values relative to each of the minimum density RMS values of the sensitive layer units set at a value of 100, respectively.

The samples of the invention are those in which, in the relation among the $RMS_0$, $RMS_1$ and $RMS_2$ values shown in Table 23, at least any one of the sensitive layer units can satisfy the following two relations:

$$1.10 \leqq \frac{RMS_1}{RMS_0} \leqq 1.50,$$

and $$0.90 \leqq \frac{RMS_2}{RMS_0} \leqq 1.20$$

TABLE 23

| Sample No. | Red sensitive layer unit: Relative RMS value $R_0$ | $R_1$ | $R_2$ | $RMS_1/RMS_0$ | $RMS_2/RMS_0$ | Green sensitive layer unit: Relative RMS value $G_0$ | $G_1$ | $G_2$ | $RMS_1/RMS_0$ | $RMS_2/RMS_0$ | Blue sensitive layer unit: Relative RMS value $B_0$ | $B_1$ | $B_2$ | $RMS_1/RMS_0$ | $RMS_2/RMS_0$ |
|---|---|---|---|---|---|---|---|---|---|---|---|---|---|---|---|
| 121 | 100 | 155 | 140 | 1.55 | 1.40 | 100 | 145 | 130 | 1.45 | 1.30 | 100 | 165 | 150 | 1.65 | 1.50 |
| 122 | 95 | 130 | 125 | 1.37 | 1.32 | 90 | 125 | 125 | 1.39 | 1.39 | 95 | 140 | 135 | 1.47 | 1.42 |
| 123 | 95 | 120 | 110 | 1.26 | 1.16 | 95 | 125 | 105 | 1.31 | 1.11 | 100 | 140 | 120 | 1.40 | 1.18 |
| 124 | 90 | 115 | 95 | 1.28 | 1.06 | 95 | 115 | 100 | 1.21 | 1.05 | 95 | 130 | 110 | 1.37 | 1.16 |
| 125 | 95 | 130 | 125 | 1.37 | 1.32 | 90 | 125 | 120 | 1.39 | 1.33 | 95 | 125 | 105 | 1.32 | 1.11 |

TABLE 23-continued

| Sample No. | Red sensitive layer unit Relative RMS value $R_0$ | $R_1$ | $R_2$ | $RMS_1/RMS_0$ | $RMS_2/RMS_0$ | Green sensitive layer unit Relative RMS value $G_0$ | $G_1$ | $G_2$ | $RMS_1/RMS_0$ | $RMS_2/RMS_0$ | Blue sensitive layer unit Relative RMS value $B_0$ | $B_1$ | $B_2$ | $RMS_1/RMS_0$ | $RMS_2/RMS_0$ |
|---|---|---|---|---|---|---|---|---|---|---|---|---|---|---|---|
| 126 | 95 | 130 | 130 | 1.37 | 1.37 | 85 | 105 | 90 | 1.23 | 1.06 | 95 | 130 | 110 | 1.37 | 1.16 |
| 127 | 85 | 110 | 95 | 1.29 | 1.12 | 85 | 110 | 90 | 1.29 | 1.06 | 95 | 125 | 105 | 1.32 | 1.16 |
| 128 | 135 | 155 | 170 | 1.15 | 1.25 | 130 | 130 | 137 | 1.00 | 1.05 | 115 | 160 | 150 | 1.40 | 1.32 |

$R_0$, $G_0$, $B_0$: Relative RMS values in each of the minimum red, green and blue densities (=RMS in the column of each color sensitive layer unit)
$R_1$, $G_1$, $B_1$: Relative RMS values in each of the minimum red, green and blue sensities + 0.15 (-$RMS_1$ in the column of each color sensitive layer unit)
$R_2$, $G_2$, $B_2$: Relative RMS values of an exposure quantity of $\log H_{R,G,B}$ + 0.5 to an exposure quantity ($\log H_{R,G,B}$) at the measurement points of $R_1$, $G_1$, $B_1$ (= $RMS_2$ in the column of each color sensitive layer unit)

Next, the resulting samples 121 through 128 were each cut into 35 mm size. They were put in ordinary type metal-made cartridges, and were then loaded in a Konica FT-1 Motor camera (with Hexanon AR 85 mm F 1.8 lens), respectively. A standard neutral grey reflection board having a reflectance of 18% was photographed in full frame size, with a TTL automatic metering system, on each of the samples by exposing to a blue lamp —a daylight type tungsten lamp— having a color temperature of 5,800 K as a light source. Next, the standard reflection board was photographed in the similar manner by replacing the light source by a tungsten lamp having a color temperature of 3,100 K. The photographed samples were each developed in the same developing process as in the foregoing RMS measurement method.

Among the resulting photographed negatives, the negative of sample 121 exposed to the 5,800 K light source was printed on a sheet of Konica Color Paper by a 10×magnification—of linear magnification—so as to finish in a netral grey having a reflectance of 18%. The printing magnification of the remaining samples were obtained so that the graininess thereof could be judged as same as that of the foregoing 10×magnified print when they were printed in neutral grey having a reflectance of 18%.

The results thereof are shown in Table-24 given below.

Next,the samples 121 through 128 were each exposed wedgewise to each of the light sources, namely, a tungsten lamp having a color temperature of 3,100 K, and a three-wavelength region type luminous fluorescent lamp, FL20SS.EX18 manufactured by Matsushita Electric Co. Then, the samples were each developed and measured in the method of measuring the foregoing RMS values, so that the relative density curves D-(logE) of each sample were made out. In the curves of the samples, the inclinations —gradients— of the relative density curves of the red, green and blue densities were obtained between the exposure quantity corresponding to the minimum green density+0.40 and the exposure quantity magnified by 10 and, the resulting inclinations are named $\gamma_B$, $\gamma_G$ and $\gamma_R$. In any one of the exposed samples, the relative density curves showed each the approximately straight lines between the two exposure quantities. The $\gamma_B/\gamma_G$ and $\gamma_R/\gamma_G$ values of each sample were calculated out and the results thereof are shown in Table-24 given below.

TABLE 24

| Sample No. | Standard light conditions applied to RMS judgement $\gamma_B/\gamma_G$ | $\gamma_B/\gamma_G$ | Tingsten lamp of 3,100 K $\gamma_B/\gamma_G$ | $\gamma_B/\gamma_G$ | 3 wavelength region fluorescent lamp $\gamma_B/\gamma_G$ | $\gamma_B/\gamma_G$ | Print magnification 5,800 K light source | 3,100 L light source |
|---|---|---|---|---|---|---|---|---|
| 121 | 1.02 | 1.00 | 0.92 | 1.08 | 0.97 | 0.92 | 10 × (Control) | 7.5 |
| 122 | 1.04 | 0.98 | 0.94 | 1.05 | 1.01 | 0.92 | 9.0 | 7.5 |
| 123 | 1.05 | 1.02 | 1.02 | 1.04 | 1.02 | 1.00 | 10.5 | 9.5 |
| 124 | 1.02 | 0.98 | 0.98 | 1.00 | 1.01 | 0.97 | 10.5 | 10.0 |
| 125 | 1.03 | 0.98 | 0.98 | 1.03 | 1.00 | 0.94 | 9.5 | 8.5 |
| 126 | 1.02 | 0.98 | 1.01 | 1.03 | 1.01 | 0.96 | 10.0 | 9.5 |
| 127 | 1.03 | 1.00 | 1.03 | 1.01 | 1.02 | 0.99 | 10.5 | 10.5 |
| 128 | 1.07 | 1.03 | 0.90 | 1.10 | 1.0 | 0.88 | 8.0 | 7.0 |

In Table-24, the $\gamma_B/\gamma_G$ and $\gamma_R/\gamma_G$ values each indicates that the fewer the variations caused by the kinds of the light sources used are, the fewer the variations of the color balance are and that the highlight and shadow portions are excellent in color reproduction.

As is obvious from Table-24, the samples 121 and 122 were considerably varied in the above-mentioned values by varying the exposure conditions, while any one of the samples 123 through 128 was scarcely varied in the values even in the exposure conditions so that the excellent results could be obtained.

In Table-24, it can be proved that the greater the printing magnification is, the more the graininess of the subject sample is excellent and, it can also be found that the samples applied with Em-4 through Em-6 could obtained the excellent graininess similar to those of the other samples of the invention even in any photographic conditions different remarkably in the color temperatures, such as 5,200 K and 3,100 K, of the light sources used. On the other hand, the samples applied with Em-D and Em-E proved to be seriously deteriorated in graininess when they were exposed to a light source having a temperature of 3,100 K.

Example 8

When embodying a sample in the same manner as in Example 7, except that the development process of Example 7, was replaced by the development process B of Example 1, the same results could be obtained. It can, therefore, be proved that the light sensitive materials of the invention cannot be affected even if the developing conditions should be varied, but they can display the same effects.

What is claimed is:

1. A silver halide color photographic light-sensitive material having an ISO speed of not less than 300, said material comprising a support having provided thereon a light-sensitive layer unit containing a red-sensitive silver halide emulsion and a cyan coupler, a light-sensitive layer unit containing a green-sensitive silver halide emulsion and a magenta coupler, and a light-sensitive layer unit containing a blue-sensitive silver halide emulsion and a yellow coupler, wherein RMS granularity of said light-sensitive layer unit containing said blue-sensitive silver halide emulsion and said yellow coupler conforms to the following relationships:

$$1.1\ RMS_0 \leqq RMS_1 \leqq 1.5\ RMS_0 \text{ and}$$

$$0.9\ RMS_0 \leqq RMS_2 \leqq 1.2\ RMS_0$$

wherein $RMS_0$ is a RMS value at a minimum density portion of the layer unit, $RMS_1$ is a RMS value at a density portion of the minimum density plus 0.15 of the layer unit which is produced by an exposure amount in terms of logH, and $RMS_2$ is a RMS value at a density portion produced by an exposure of logH+0.5.

2. A silver halide color photographic material of claim 1, wherein said $RMS_1$ and $RMS_2$ are within the following range; $1.25\ RMS_0 \leqq RMS_1 \leqq 1.35\ RMS_0$ and $1.05\ RMS_0 \leqq RMS_2 \leqq 1.15\ RMS_0$.

3. A silver halide color photographic material of claim 1, wherein at least one of said layer units contains silver halide grains each consisting of a core substantially comprising silver iodobromide, and a shell covering the core and substantially comprising silver bromide or silver iodobromide having a silver iodide content less than that of the core; and the silver iodide contents of the individual grains have a relative standard deviation of not more than 20%.

4. A silver halide color photographic material of claim 3, wherein said relative standard deviation of the silver iodide contents is not more than 15%.

5. A silver halide color photographic material of claim 4, wherein said relative standard deviation of the silver iodide contents is not more than 10%.

6. The silver halide color photographic material of claim 1, where at least one of said layer units contains a silver halide emulsion comprising monodispersed silver halide twinned crystal grains, said silver halide grains having an inner portion and an outer portion, said inner portion having a silver iodide content greater than that in said outer portion.

7. A silver halide color photographic material of claim 6, wherein said silver halide emulsion contains said twinned crystal grains of not less than 80% in number.

8. A silver halide color photographic material of claim 6, wherein a silver iodide content of said inner portion is within the range of 15 to 45 mol %.

9. A silver halide color photographic material of claim 6, wherein said twinned crystal grains provide an X-ray diffraction pattern having a signal whose width at a height of a maximum peak height$\times$0.13 is 1.5 degree or more in a diffraction angle $2\theta$ when a diffraction pattern of a (420) face of said grains is measured with an X-ray diffractometer using CuK$\alpha$ rays as a radiation source.

* * * * *